US012782088B2

(12) United States Patent
Roberts et al.

(10) Patent No.: US 12,782,088 B2
(45) Date of Patent: Nov. 3, 2026

(54) FIREARM CASE WITH PASSIVE AIR REGULATION

(71) Applicant: Magpul Industries Corp., Austin, TX (US)

(72) Inventors: Timothy Eric Roberts, Broomfield, CO (US); Tyler Heighes, Fort Collins, CO (US)

(73) Assignee: Magpul Industries Corp., Austin, TX (US)

( * ) Notice: Subject to any disclaimer, the term of this patent is extended or adjusted under 35 U.S.C. 154(b) by 3 days.

(21) Appl. No.: 18/908,768

(22) Filed: Oct. 7, 2024

(65) Prior Publication Data

US 2025/0102270 A1 Mar. 27, 2025

Related U.S. Application Data

(63) Continuation-in-part of application No. 18/029,267, filed as application No. PCT/US2023/010367 on Jan. 8, 2023, now Pat. No. 12,259,213.

(60) Provisional application No. 63/588,525, filed on Oct. 6, 2023, provisional application No. 63/319,221, filed on Mar. 11, 2022, provisional application No. 63/319,194, filed on Mar. 11, 2022.

(51) Int. Cl.
*F41C 33/06* (2006.01)

(52) U.S. Cl.
CPC ..... *F41C 33/06* (2013.01)

(58) Field of Classification Search
CPC ..... A45C 2013/026; A45C 13/1084; A45C 13/02
USPC ..... 206/317
See application file for complete search history.

(56) References Cited

U.S. PATENT DOCUMENTS 144,431 A 11/1873 Beck
985,385 A 2/1911 Bayles
(Continued)

FOREIGN PATENT DOCUMENTS

CN 1648390 B 1/2011
CN 212165168 U 12/2020
(Continued)

OTHER PUBLICATIONS

"Draw Latches", McMaster-Carr, 2 pages, online available at <https://www.mcmaster.com/draw-latches/>, retrieved on: Jul. 7, 2022.
(Continued)

*Primary Examiner* — Ernesto A Grano
(74) *Attorney, Agent, or Firm* — NOD Law PC

(57) ABSTRACT

A locking case comprising a base and a lid, where the base and/or the lid comprises a double wall design including a first wall, a second wall, and a channel formed between the first and the second wall; a gasket positioned within the channel; at least one pressure equalization element integrated into the case; a latch comprising a first end and a second end, and a first one or more protrusions positioned between the first end and the second end, the second end comprising a second protrusion configured for removably engaging with a third protrusion of the base, where the first end is rotatably coupled to the lid; and where, closure of the latch is configured to cause the first one or more protrusions of the latch to interface with one or more of the base and the lid to compress the gasket between the base and the lid.

20 Claims, 34 Drawing Sheets

(56) References Cited

U.S. PATENT DOCUMENTS 2,420,347 A 5/1947 Baldwin
2,519,662 A 8/1950 Kempken
2,621,807 A 12/1952 Rendich
2,695,112 A 11/1954 Francois
3,138,306 A 6/1964 Bare
3,381,782 A 5/1968 Ikelheimer
3,421,679 A 1/1969 Goldman
3,811,562 A 5/1974 Smith
4,192,421 A 3/1980 Oglesbee
4,239,230 A 12/1980 Shoptaugh
D268,130 S 3/1983 Easton
4,433,781 A 2/1984 Hummel
4,446,900 A 5/1984 Markovich
4,446,982 A 5/1984 Corse
4,485,919 A 12/1984 Sandel
4,523,704 A 6/1985 Washington
D283,164 S 3/1986 Pandya
4,620,579 A 11/1986 Lowe
4,714,158 A 12/1987 Oltman et al.
4,733,806 A 3/1988 Sloop
4,890,466 A 1/1990 Cislo
D307,997 S 5/1990 Bernstein
D319,348 S 8/1991 Monteleon
5,055,081 A 10/1991 Nayak
D323,447 S 1/1992 Booz
5,106,132 A 4/1992 Bako et al.
5,133,132 A 7/1992 Yu
5,199,563 A 4/1993 Goodman
5,207,150 A 5/1993 Wellman
D337,886 S 8/1993 Feinbloom
D337,887 S 8/1993 Feinbloom
5,294,413 A 3/1994 Riihimaki
5,350,150 A 9/1994 Fiore
5,375,440 A 12/1994 Patterson
5,384,103 A 1/1995 Miller
5,472,110 A 12/1995 Boyd
5,492,671 A 2/1996 Krafft
5,605,167 A 2/1997 Montoli
5,681,539 A 10/1997 Riley
D389,408 S 1/1998 Rask
D393,543 S 4/1998 Wilkening
5,759,502 A 6/1998 Spencer
5,843,387 A 12/1998 Dane
5,860,518 A 1/1999 Axelrod
D411,308 S 6/1999 Pandey
D416,405 S 11/1999 Thoesen
D430,399 S 9/2000 Pawuk
6,145,719 A 11/2000 Robert
6,244,447 B1 6/2001 Frieze
6,331,280 B1 12/2001 Wood
6,390,294 B1 5/2002 Fiore, Jr.
6,527,309 B1 3/2003 Gaydos et al.
6,575,313 B1 6/2003 Chen
6,769,538 B2 8/2004 Oswald
6,874,628 B2 4/2005 Hammill
6,880,698 B2 4/2005 Fiore, Jr.
6,955,381 B2 10/2005 Parker et al.
D518,737 S 4/2006 Zalzal
D520,734 S 5/2006 Henning et al.
D527,181 S 8/2006 Henning et al.
7,104,398 B1 9/2006 Wisecarver
7,121,407 B2 10/2006 Hurt et al.
D538,538 S 3/2007 Espinosa
7,246,704 B2 7/2007 Brunson et al.
D555,902 S 11/2007 Pendergraph
7,370,891 B1 5/2008 Schmitt et al.
7,401,698 B2 7/2008 Dost et al.
7,424,958 B1 9/2008 Eley
7,451,872 B1 11/2008 Allen
7,513,364 B2 4/2009 Tsai
7,540,364 B2 6/2009 Sanderson
7,546,920 B1 6/2009 Horn et al.
7,573,385 B2 8/2009 Tonelli
7,837,053 B2 * 11/2010 Arnett ..... E05B 65/5276 220/326
D633,298 S 3/2011 Tonelli
D638,217 S 5/2011 von Gottberg
8,141,723 B2 3/2012 Whalen et al.
8,297,464 B2 10/2012 Grenier et al.
8,328,247 B2 12/2012 Tonelli
8,371,444 B1 2/2013 Huang
8,381,912 B2 2/2013 Dalhamer
D695,078 S 12/2013 Hertaus
D703,004 S 4/2014 Tsai
D708,763 S 7/2014 Smeja
D709,323 S 7/2014 Brown
D709,718 S 7/2014 Snyder
D713,051 S 9/2014 Smeja
D714,958 S 10/2014 Smeja
8,944,476 B1 * 2/2015 Henderson ..... E05B 15/02 292/285
8,960,430 B2 2/2015 Roach et al.
8,985,385 B2 3/2015 Parker et al.
D734,867 S 7/2015 Smeja
D739,680 S 9/2015 Smeja
9,169,059 B2 10/2015 Shen
RE45,787 E 11/2015 Hurt et al.
D742,666 S 11/2015 Akana
9,187,933 B2 11/2015 Lucas
D744,994 S 12/2015 Akana
9,199,370 B2 12/2015 Crull
D749,845 S 2/2016 Tonelli
D763,104 S 8/2016 Akana
9,408,447 B1 8/2016 Divinity
D767,309 S 9/2016 Akana
D778,707 S 2/2017 Tonelli
D779,822 S 2/2017 Grenier et al.
D781,148 S 3/2017 Kemp
D787,186 S 5/2017 Thurbin
9,656,384 B1 5/2017 Tsai
D810,432 S 2/2018 Ballou et al.
D810,433 S 2/2018 Ballou et al.
D811,084 S 2/2018 Ballou et al.
D811,742 S 3/2018 Ballou et al.
D811,744 S 3/2018 Ballou et al.
9,975,672 B2 5/2018 Crull
D819,331 S 6/2018 Ballou et al.
D820,623 S 6/2018 Akana
D820,690 S 6/2018 Canuto
10,012,632 B2 7/2018 Tomellini et al.
D826,425 S 8/2018 Muller
D826,426 S 8/2018 Muller
D827,432 S 9/2018 Akana
10,182,628 B2 1/2019 Tonelli et al.
D840,053 S 2/2019 Kamees
10,231,524 B2 3/2019 Tonelli et al.
D854,826 S 7/2019 Tonelli
D873,007 S 1/2020 Tonelli
D873,660 S 1/2020 Akana
10,618,159 B2 4/2020 Maruzzo et al.
D886,202 S 6/2020 Hsu
10,716,399 B2 7/2020 Brown et al.
D897,746 S 10/2020 Gady
D898,357 S 10/2020 Chagnon et al.
D898,358 S 10/2020 Chagnon et al.
D898,546 S 10/2020 Tonelli
D904,088 S 12/2020 Gady
10,858,160 B2 12/2020 Yang
D915,069 S 4/2021 Tonelli
11,064,778 B2 7/2021 Tonelli
11,203,465 B2 12/2021 Seiders
D945,192 S 3/2022 Gady
11,358,272 B2 6/2022 Buhl et al.
11,419,364 B2 8/2022 Slate et al.
D994,401 S 8/2023 Gady
11,771,256 B1 10/2023 Suteerawanit
D1,005,128 S 11/2023 Akana
D1,005,133 S 11/2023 Romanov
D1,006,883 S 12/2023 Peeters
D1,028,505 S 5/2024 Roberts et al.
11,976,498 B2 5/2024 Seiders
D1,037,666 S 8/2024 Hwang
D1,038,770 S 8/2024 Akana
2002/0023855 A1 2/2002 Cho

(56) References Cited

U.S. PATENT DOCUMENTS

| | | | |
|---|---|---|---|
| 2002/0034321 | A1 | 3/2002 | Saito |
| 2003/0121741 | A1 | 7/2003 | Japchen |
| 2004/0144664 | A1 | 7/2004 | Hammill |
| 2004/0154935 | A1 | 8/2004 | Kaminski |
| 2004/0178202 | A1 | 9/2004 | Serio, Jr. |
| 2005/0269340 | A1 | 12/2005 | Chuan |
| 2005/0279123 | A1 | 12/2005 | Maldonado et al. |
| 2006/0070900 | A1 | 4/2006 | Brunson et al. |
| 2006/0186003 | A1 | 8/2006 | Dost |
| 2006/0266666 | A1 | 11/2006 | Bettenhausen et al. |
| 2007/0007291 | A1 | 1/2007 | Gunn |
| 2007/0012694 | A1 | 1/2007 | Duvigneau |
| 2007/0039445 | A1 | 2/2007 | Nitsch |
| 2007/0051722 | A1 | 3/2007 | Van Zee |
| 2007/0262038 | A1 | 11/2007 | Harbison et al. |
| 2007/0272572 | A1 | 11/2007 | Chen |
| 2008/0136301 | A1 | 6/2008 | Harbison et al. |
| 2008/0264815 | A1 | 10/2008 | Allen |
| 2009/0107875 | A1 | 4/2009 | Carroll et al. |
| 2009/0114646 | A1 | 5/2009 | Whalen |
| 2009/0145913 | A1 | 6/2009 | Panosian |
| 2009/0146032 | A1 | 6/2009 | Bettenhausen et al. |
| 2010/0071216 | A1 | 3/2010 | Novak |
| 2011/0147386 | A1 | 6/2011 | Whalen |
| 2012/0199513 | A1 | 8/2012 | Wagner |
| 2014/0157607 | A1 | 6/2014 | McFarland |
| 2014/0265197 | A1 | 9/2014 | Russell et al. |
| 2014/0346068 | A1 | 11/2014 | Omura et al. |
| 2015/0251311 | A1 | 9/2015 | Huang |
| 2016/0073751 | A1 | 3/2016 | Charlebois et al. |
| 2016/0262408 | A1 | 9/2016 | Kennedy |
| 2016/0280421 | A1 | 9/2016 | Lee et al. |
| 2016/0303747 | A1 | 10/2016 | Dovel |
| 2017/0008688 | A1 | 1/2017 | Barattin et al. |
| 2017/0361987 | A1 | 12/2017 | Lee et al. |
| 2018/0265249 | A1 | 9/2018 | Grutt |
| 2019/0255717 | A1 | 8/2019 | Pustilnik |
| 2019/0271433 | A1 | 9/2019 | Tonelli |
| 2019/0315005 | A1 | 10/2019 | Jen |
| 2020/0039056 | A1 | 2/2020 | Damberg |
| 2020/0180180 | A1 | 6/2020 | Pesavento |
| 2020/0216224 | A1* | 7/2020 | Nichols ..... B65D 51/28 |
| 2020/0229568 | A1 | 7/2020 | Nichols et al. |
| 2020/0275750 | A1 | 9/2020 | Dawe |
| 2020/0324943 | A1 | 10/2020 | Mattila |
| 2020/0353612 | A1 | 11/2020 | McCune et al. |
| 2020/0354117 | A1 | 11/2020 | Whalen et al. |
| 2021/0080224 | A1 | 3/2021 | Searle |
| 2021/0137294 | A1 | 5/2021 | Beyer et al. |
| 2021/0204663 | A1 | 7/2021 | Nichols |
| 2021/0339408 | A1 | 11/2021 | Dickinson |
| 2021/0365917 | A1 | 11/2021 | Tusia Cohen |
| 2022/0316840 | A1 | 10/2022 | Ryder et al. |
| 2023/0011990 | A1 | 1/2023 | Makos |
| 2023/0120366 | A1 | 4/2023 | Stevens |
| 2023/0243619 | A1 | 8/2023 | Searle |
| 2024/0053121 | A1 | 2/2024 | Searle |
| 2024/0164559 | A1 | 5/2024 | Mirza |
| 2024/0209675 | A1 | 6/2024 | Curtis |
| 2024/0280346 | A1 | 8/2024 | Roberts et al. |
| 2024/0316801 | A1 | 9/2024 | Berman |

FOREIGN PATENT DOCUMENTS

| | | | |
|---|---|---|---|
| DE | 10-2010-037350 | A1 | 4/2011 |
| DE | 2020-12103961 | U1 | 1/2014 |
| DE | 2020-17105501 | U1 | 9/2017 |
| DE | 2020-18105387 | U1 | 1/2019 |
| EP | 2 130 451 | B1 | 8/2014 |
| EP | 2 315 895 | B1 | 1/2015 |
| EP | 3 438 385 | B1 | 6/2020 |
| EP | 3 598 917 | B1 | 9/2021 |
| EP | 3 911 199 | A1 | 11/2021 |
| JP | 6964508 | B2 | 11/2021 |
| WO | 2011/066217 | A3 | 9/2011 |
| WO | 2018/131054 | A1 | 7/2018 |
| WO | 2020/148495 | A1 | 7/2020 |
| WO | 2020/227523 | A1 | 11/2020 |
| WO | 2021/213718 | A1 | 10/2021 |

OTHER PUBLICATIONS

"1720 Protector Long Case", Pelican, 3 pages, online available at <https://www.pelican.com/us/en/product/cases/long-case/protector/1720>, retrieved on: Jul. 7, 2022.

"1750 Protector Long Case", Pelican, 4 pages, online available at <https://www.pelican.com/US/en/product/cases/long-case/protector/1750>, retrieved on: Jul. 7, 2022.

"Pistol Cases", Pelican, 2 pages, online available at <https://www.pelican.com/us/en/products/cases/pistol-cases>, retrieved on: Jul. 7, 2022.

"Rustrictor™ AW2 42" Rifle Case, Plano, 2 pages,online available at <https://planomolding.com/products/rustrictor-aw2-42in-rifle-case-pla11842r?variant=40468122796192>, retrieved on: Jul. 7, 2022.

Guidry, Abigial E., Office Action re U.S. Appl. No. 18/029,304, filed Dec. 18, 2023, 65 Pages, United States Patent and Trademark Office, US.

School Supply, Discount. "Excellerations earlySTEMTM Translucent Stacking Pegs." Discount School Supply, Discount School Supply, 8 pages, Nov. 13, 2020, www.discountschoolsupply.com/stem-curriculum/stem/earlystem-/excellerations-earlystem--translucent-stacking-pegs/p/s650981. Year: 2020.

Taiwanese Patent Application No. 112100930, Search Report dated Dec. 16, 2024. 1 page.

Pelican Storm iM3100 Case With Foam (Black), 4 pages, announced Jun. 17, 2003 [online], [site visited Dec 12, 2023]. Available from internet, URL: <https://www.amazon.com/dp/B005NOKR14/> (Year: 2003).

Merdia Gun Case Precision Hard Rifle Gun Case, 2 pages, announced Aug. 15, 2018 [online], [site visited Dec 12, 2023]. Available from internet, URL: <https://www.amazon.com/Merdia-Precision-Protective-Convoluted-Case-34-05/dp/B07GGS8NM9/?th=1> (Year: 2018).

Pelican Vault V800 Multi, 4 pages, announced Jul. 1, 2019 [online], [site visited Dec 12, 2023]. Available from internet, URL: <https://www.amazon.com/dp/B07TB649F9/?th=1 (Year: 2019).

"R40 Personal Utility Ruck Case", Pelican, 4 pages, online available at <https://www.pelican.com/us/en/product/cases/ruck-case/personal-utility/r40?sku=RKR400-0000-TAN>, retrieved on: Jan. 7, 2023.

"RC42T—Tactical Rifle Case 42", MTM Case-Gard, 2 pages, online available at <https://mtmcase-gard.com/products/tactical-rifle-case-42>, retrieved on: Jan. 7, 2023.

International Search Report and Written Opinion received for International PCT Application Serial No. PCT/US2023/010367 dated May 8, 2023, 8 pages.

Non Final Office Action received for U.S. Appl. No. 17/974,418 dated Jan. 15, 2025, 7 pages.

Notice of Allowance received for U.S. Appl. No. 18/029,267 dated Feb. 20, 2025, 2 pages.

Notice of Allowance received for U.S. Appl. No. 29/879,032 dated Feb. 18, 2025, 11 pages.

Final Office Action received for U.S. Appl. No. 18/029,304 dated Mar. 11, 2025, 24 pages.

English of Search Report received for Taiwan Application Serial No. 112100930 dated Dec. 16, 2024, 1 page.

Notice of Allowance received for U.S. Appl. No. 29/879,032 dated Apr. 2, 2025, 2 pages.

Partial Supplementary European Search Report received for European Application Serial No. 23767275.3 dated Jun. 5, 2025, 13 pages.

* cited by examiner

1100

FIREARM CASE WITH PASSIVE AIR REGULATION

CROSS-REFERENCE TO RELATED APPLICATIONS

The present application claims priority to U.S. Provisional Patent Application No. 63/588,525 filed Oct. 6, 2023, and entitled "Firearm Case with Locking Latches". The present application is also a Continuation-in-Part of U.S. patent application Ser. No. 18/029,267 filed Mar. 29, 2023, and entitled "Firearm Case with Locking Latches," which is a national stage filing of PCT Application No. PCT/US2023/010367, filed Jan. 8, 2023, which claims priority to U.S. Provisional Patent Application Nos. 63/319,194 and 63/319,221, both filed Mar. 11, 2022, and respectively entitled "Firearm Case with Locking Latches," and "Storage Case Organizational System." All of the above referenced applications are incorporated herein by reference in their entirety.

FIELD OF THE DISCLOSURE

The present disclosure relates to cases. In particular, but not by way of limitation, the present disclosure relates to a lockable firearm case with a pressure equalization feature, such as a valve or a vent, for regulating a pressure gradient between the interior and exterior of the case.

BACKGROUND

Transport and storage cases are used across a variety of industries, such as for scientific equipment, sporting goods, photography equipment, mechanical tools, electronics devices, military gear, and other valuables that are susceptible to damage during transport or storage. Such cases often suffer from a drawbacks, such as fragility of the cases themselves and difficulties in preventing unwanted access to the contents. In particular, cases used to store and/or transport firearms are typically made of plastic and feature small latches, rudimentary provisions for padlocks, relatively smooth exteriors, molded-in or folding handles, and/or basic foam interiors. While some aspects of cases have improved over time, there remain unmet needs within this space.

For example, currently used cases, such as those used to transport firearms and/or their accessories, are not suited to be used across a wide range of environments. That is, while some of these cases may be suitable enough to be used in temperate locations (e.g., most of western Europe or the north-eastern United States), they may be inadequate for use in locations with more extreme climates (e.g., very hot and arid deserts, high-altitude cold deserts, polar or tundra regions, tropical rainforest or monsoon regions with high humidity and plentiful rainfall throughout the year, to name a few non-limiting examples). Specifically, some prior art cases may be unable to prevent water, moisture, sand, and/or dust from entering the case, and thus may not be able to provide adequate protection to the contents stored within them. Furthermore, when cases are transported between locations that are at substantially different elevations or altitudes (i.e., above mean sea-level), the pressure differential between the starting and ending locations may cause a variety of adverse effects, ranging from minor damage to the case (e.g., small cracks and/or dents may form on the case to relieve the stress induced by the pressure differential) to more severe irreparable damage to the case, which may not only permanently deform the case, but may also result in damage to the components stored within the case. In some instances, the damage may be severe enough to not only render the case unusable, but also cause substantial damage to the components stored within the case (e.g., musical or photograph instruments, scientific equipment, and/or firearm accessories). Furthermore, such cases can also hamper user experience by making it more difficult to open the case due to the significant pressure difference between the inside and outside of the case. Thus, there is a need for case that can help mitigate some of the issues seen in prior art cases.

The description provided in the background section should not be assumed to be prior art merely because it is mentioned in or associated with the background section. The background section may include information that describes one or more aspects of the subject technology.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

In some embodiments, a firearm case with locking latches comprises a weather-resistant seal that is fitted in a channel within the double wall of the case. In some embodiments, the double wall is configured with one or more pass-through channels adjacent to one or more portions of the weather-resistant seal, along with one or more gaps in the weather-resistant seal, to alleviate air pressure differentials between the outside of the case and the interior of the case.

In some aspects, the techniques described herein relate to a locking case including: a base and a lid, wherein at least one of the base and the lid includes a double wall design, the double wall design including a first wall, a second wall, and a channel formed between the first and the second wall; a gasket positioned within the channel; at least one passive pressure equalization element integrated into the case; a latch including a first end and a second end, and a first one or more protrusions positioned between the first end and the second end, the second end including a second protrusion configured for removably engaging with a third protrusion of the base, wherein the first end is rotatably coupled to the lid; and wherein, closure of the latch is configured to cause the first one or more protrusions of the latch to interface with one or more of the base and the lid to compress the gasket between the base and the lid.

In some aspects, the techniques described herein relate to a locking case, wherein, when the closing force is applied between the base and the lid, the locking case is in a closed position and the latch is engaged with both the base and the lid; and when the locking case is in an open position, the second end of the latch is disengaged from the first portion of the base.

In some aspects, the techniques described herein relate to a case, wherein, the first portion of the base includes a shelf feature for engaging with the second end of the latch, and the shelf feature is configured to transfer an engagement force from the latch toward the lid when the second end of the latch is engaged with the first portion of the base, such that the gasket becomes more compressed between the base and the lid than when the second end of the latch is not engaged with the first portion of the base.

In some aspects, the techniques described herein relate to a locking case, wherein the one or more protrusions includes a second protrusion configured to interface with one of a protruding edge on the base or a protruding edge on the lid.

In some aspects, the techniques described herein relate to a locking case, wherein the one or more protrusions include the second protrusion and a third protrusion, and wherein the third protrusion is configured to interface with another one of the protruding edge on the base or the protruding edge on the lid.

In some aspects, the techniques described herein relate to a locking case, wherein, when the closing force is applied between the base and the lid: the gasket becomes more compressed between the base and the lid when the latch includes both the second and third protrusions as compared to when the latch only includes the second protrusion.

In some aspects, the techniques described herein relate to a locking case, wherein the at least one passive pressure equalization element includes one or more of a valve and a vent, and wherein the at least one passive pressure equalization element is configured to regulate pressure gradients between an internal pressure in an interior of the locking case and an atmospheric pressure external of the locking case.

In some aspects, the techniques described herein relate to a locking case, wherein the gasket includes a weather-resistant seal that is configured to be fitted within the channel and shaped and sized to encircle a perimeter of the locking case, and wherein one of: the weather-resistant seal is formed as a unitary piece; or the weather-resistant seal includes one or more seal sections and one or more seal butt joints.

In some aspects, the techniques described herein relate to a locking case, wherein the one or more seal sections include a plurality of seal sections, and wherein the one or more seal butt joints include a plurality of seal butt joints, and wherein each of the plurality of seal butt joints is placed between adjacent seal sections, and wherein one or more of the plurality of seal butt joints are configured to vent or allow passage of air.

In some aspects, the techniques described herein relate to a locking case, wherein the one or more of the plurality of seal butt joints are configured to vent or allow passage of air when a pressure differential between the internal pressure and the atmospheric pressure exceeds a pressure vent threshold, and wherein the pressure vent threshold is based at least in part on a tightness or compression level of the one or more seal butt joints.

In some aspects, the techniques described herein relate to a locking case, wherein, the tightness or compression level is based on a corresponding spacing between adjacent seal sections and a length of a respective seal butt joint positioned between the adjacent seal sections; the weather-resistant seal is fixedly seated within the channel or removably seated within the channel; and the weather-resistant seal is fabricated of a low density polyethylene (LDPE) material, an elastomeric material, or a combination thereof.

In some aspects, the techniques described herein relate to a locking case, wherein the double-wall design of at least one of the lid and the base includes one or more pass-through channels, and wherein the one or more pass-through channels are configured to allow passage of air into the channel and through the weather-resistant seal to reduce the pressure differential between the internal pressure in an interior of the locking case and an atmospheric pressure external of the locking case.

In some aspects, the techniques described herein relate to a locking case, including: a base having: an outer wall integrated into an outer profile of the case, and an inner wall facing an interior portion of the locking case, a lid having: an outer wall integrated into an outer profile of the case, and an inner wall facing an interior portion of the locking case, wherein, at least one the base and the lid includes: a channel formed between the respective outer and inner walls, a seal arranged within the respective channel, and one or more pass-through channels; and at least one latch configured to be rotatable between an open position and a closed position, each of the at least one latch having: a first end pivotably coupled to the lid, a second end configured to removably engage with the base, wherein the rotation of the at least one latch between the open position and the closed position is based at least in part on an engagement or disengagement of the second end of the respective latch with the base, and at least one protrusion arranged between the first end and the second end; and wherein rotation of the at least one latch to the closed position exerts a compressive force on the gasket, based at least in part on one or more of the plurality of protrusions interfacing with one or more of the base and the lid to compress the gasket between the base and the lid.

In some aspects, the techniques described herein relate to a locking case, wherein the second end of a respective latch includes an end-protrusion configured for removably engaging with a first protruding edge of the base, and wherein the at least one protrusion arranged between the first end and the second end includes a first protrusion arranged at or near the first end of a respective latch and a second protrusion arranged between the first protrusion and the end-protrusion.

In some aspects, the techniques described herein relate to a locking case, wherein the at least one protrusion includes a first protrusion, and wherein, the first protrusion is configured to interface with one of a second protruding edge on the base or a protruding edge on the lid; and the second protrusion is configured to interface with another one of the protruding edge on the base or the protruding edge on the lid.

In some aspects, the techniques described herein relate to a locking case, wherein the at least one passive pressure equalization element includes one or more of a valve and a vent, and wherein the at least one passive pressure equalization element is configured to regulate pressure gradients between an internal pressure in an interior of the locking case and an atmospheric pressure external of the locking case.

In some aspects, the techniques described herein relate to a locking case, wherein the gasket includes a weather-resistant seal that is configured to be fitted within the channel and shaped and sized to encircle a perimeter of the locking case, and wherein one of: the weather-resistant seal is formed as a unitary piece; or the weather-resistant seal includes one or more seal sections and one or more seal butt joints.

In some aspects, the techniques described herein relate to a locking case, wherein the weather-resistant seal includes a plurality of seal sections and a plurality of seal butt joints, and wherein: each of the plurality of seal butt joints is placed between adjacent seal sections; one or more of the plurality of seal butt joints are configured to vent or allow passage of air when a pressure differential between the pressure inside the locking case and the atmospheric pressure outside the locking case exceeds a pressure vent threshold, the pressure vent threshold based at least in part on a tightness or compression level of the one or more seal butt joints of the plurality of seal butt joints.

In some aspects, the techniques described herein relate to a locking case, wherein, the tightness or compression level is based on a corresponding spacing between adjacent seal sections and a length of a respective seal butt joint positioned between the adjacent seal sections, the weather-resistant seal is fixedly seated within the channel or removably seated within the channel, and the weather-resistant seal is fabricated of a low density polyethylene (LDPE) material, an elastomeric material, or a combination thereof.

In some aspects, the techniques described herein relate to a method of using a weather-resistant locking case, including: providing a base and a lid, wherein at least one of the base and the lid is constructed to have a double wall design, wherein constructing the double wall design includes forming a first wall, a second wall, and a channel between the first and the second wall; positioning a gasket or weather-resistant seal within the channel; integrating at least one passive pressure equalization element into the locking case; installing a latch within a latch recess, wherein the latch includes: a first end; a second end opposing the first end, the second end having an end-protrusion configured for removably engaging with a first portion of the base; and at least one protrusion arranged between the first and the second end of the latch; and wherein installing the latch within the latch recess includes: coupling, using an elongated rod or pin, a first end of the latch to the lid such that the latch is rotatable along a direction of motion, the direction of motion including at least an unlatched position and a latched position; and wherein rotating the latch to the latched position causes: the end-protrusion of the latch to engage with the first portion of the base such that the locking case is in a closed position and the latch is engaged with both the base and the lid; and compression of the gasket or weather-resistant seal between the base and the lid, based at least in part on the one or more protrusions interfacing with one or more of the base and the lid.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and in the claims, the singular form of 'a', 'an', and 'the' include plural referents unless the context clearly dictates otherwise.

DETAILED DESCRIPTION

The word "exemplary" is used herein to mean "serving as an example, instance, or illustration." Any embodiment described herein as "exemplary" is not necessarily to be construed as preferred or advantageous over other embodiments. In the following detailed description, references are made to the accompanying drawings that form a part hereof, and in which are shown by way of illustrations or specific examples. These aspects may be combined, other aspects may be utilized, and structural changes may be made without departing from the present disclosure. Example aspects may be practiced as methods, systems, or apparatuses. The following detailed description is therefore not to be taken in a limiting sense, and the scope of the present disclosure is defined by the appended claims and their equivalents.

Figure 1:
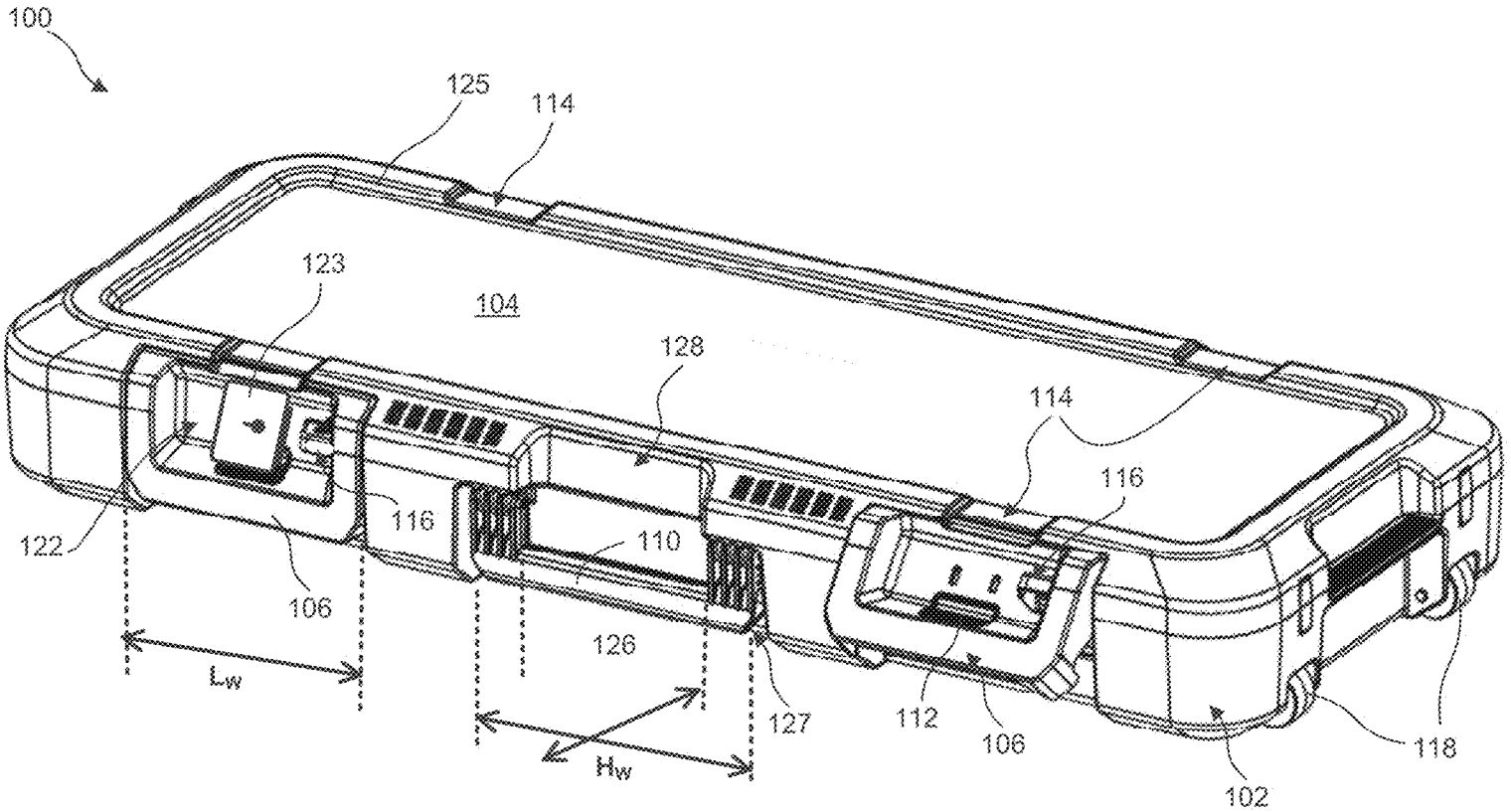
FIG. 1 illustrates a perspective view of a lockable case having a pressure equalization mechanism, according to various aspects of the present disclosure.

FIG. 1 illustrates a top perspective view of a lockable case 100 (also referred to as case 100), according to various aspects of the present disclosure. Case 100 may be implemented, for example, as a firearm case. Although, it is contemplated that case 100 may be utilized for other purposes, besides storing and carrying firearms or their components, such as, but not limited to, musical instruments (e.g., violins, guitars), tools, or any other applicable components/items. As seen, case 100 includes a base 102, a lid 104, a plurality of latches 106, at least one handle 110, one or more wheels 118, and a plurality of lid channels 114. Base 102 and lid 104 may be coupled on one side (or along one edge, such as one of the longer edges) using one or more hinges or pivots, shown as hinges/pivots 120 in FIG. 2, while latches 106 (also referred to as locking latches 106, or lockable latches 106) may be positioned on the opposing edge (e.g., the other of the two longer edges) of case 100. Optionally, lid 104 may include a ridge feature 125 for cooperating with one or more boss features on the base of a second case (not shown) to securely stack multiple cases atop each other. In some cases, latches 106 may be rotatably and/or pivotally coupled to lid 104. For instance, latches 106 may be coupled to lid 104 when case 100 is open and may help secure the lid 104 to the base 102 when the case 100 is closed. This securement may be achieved by snapping one or more inward facing protrusions of the latch 106 on corresponding mating retention features (e.g., one or more outward facing protrusions/lips) of the base 102 and/or lid 104. In some examples, when the latch 106 is coupled to both the lid 104 and the base 102, the latch 106 is said to be in a "closed position" or "engaged position". Similarly, when the latch 106 is only coupled to one of the lid 104 or the base 102, the latch is said to be in an "open position" or "disengaged position". In some other cases, latches 106 may be pivotally coupled to base 102, and similar principles described above may apply (i.e., when the latches are pivotably coupled to the lid 104).

Each one of the plurality of latches 106 may have a latch width ($L_W$) of several inches, such as two (2) inches or longer. For example, each latch 106 may have a latch width ($L_W$) of six (6) inches to be readily grasped by an adult hand. Alternatively, the size of the latch (e.g., latch 106) may be designed such that a commonly used locking mechanism, such as a padlock, may be secured within a latch recess 122 (indicated by an arrow) without protruding from the external profile of case 100. That is, latch width ($L_W$) as well as the dimensions of latch recess 122 may be configured to fully accommodate a locking mechanism (e.g., padlock 123 in FIG. 8) therein, without exposing the locking mechanism from protruding or extending outside of the external/outer profile of the lockable case 100. In some cases, the latches 106 are at least six (6) inches in width, eight (8) inches in width, or nine (9) inches in width, to name a few non-limiting examples. However, latches 106 of other lengths than those described herein may be utilized in different embodiments without departing from the scope and/or spirit of the present disclosure. Further, as shown in FIG. 1, latch 106 may be arranged with a general U-shape with a cut-out to further facilitate grasping of latch 106 even while wearing gloves or other protective gear or in adverse environmental conditions, such as in rain or snow.

In some cases, case 100 further includes at least one pivotable handle 110 (e.g., a carrying handle), where handle 110 is pivotally coupled with one of base 102 and lid 104. In a manner similar to the sizing of latches 106, handle 110 may be formed with a handle width ($H_W$) of sufficient width for comfortable gripping by an adult hand. For example, handle 110 may have a $H_W$ of eight (8) inches, with an internal width 126 of six (6) inches. In an embodiment, a handle recess 127 may be formed into the outer profile of the lockable case 100 such that the handle 110 can be stored within the handle recess 127 (i.e., within the external profile of case 100) when not in use. Additionally, the lockable case 100 may include a grip recess 128 to assist with grasping of the handle 110 by a user. Further functional advantages provided by the latches 106, handle 110, and overall case 100 design of the described embodiments will be discussed in more detail below. Lockable case 100 may additionally include one or more wheels, such as wheels 118, along one edge, for instance, along one of the shorter edges of the base 102. In the illustrated example, a pair of wheels 118 are positioned within wheel recesses on one of the two short edges of base 102.

It should be noted that the number and/or dimensions of the latches 106 described herein are exemplary only and not intended to limit the scope and/or spirit of the present disclosure. In other words, the number and dimensions of the latches used may be adjusted according to the dimensions of the lockable case 100. For instance, while two latches are shown in FIG. 1, a fewer number of latches may be required for a smaller case, such as that used for the transport and storage of a pistol. Conversely, larger latches, or more than four latches or latches placed on more than one edge of the case, may be appropriate for securing a longer or larger case or a case intended for storing and transporting a very heavy object (e.g., Rocket Propelled Grenade Launcher (RPG), sniper rifle). In certain use scenarios, such as for cases intended for use in harsh environmental conditions (e.g., extremely cold or hot temperatures, very wet or dry conditions, or even for extraterrestrial uses), the latches 106 may be required to be larger and ruggedized to withstand such conditions. Various features of the case and latch embodiments described herein are still applicable for these various use cases, with modifications in dimensions, material composition, number, and location. Such modifications are considered a part of the present disclosure, and the examples described herein are not considered to be limiting.

Figure 2:
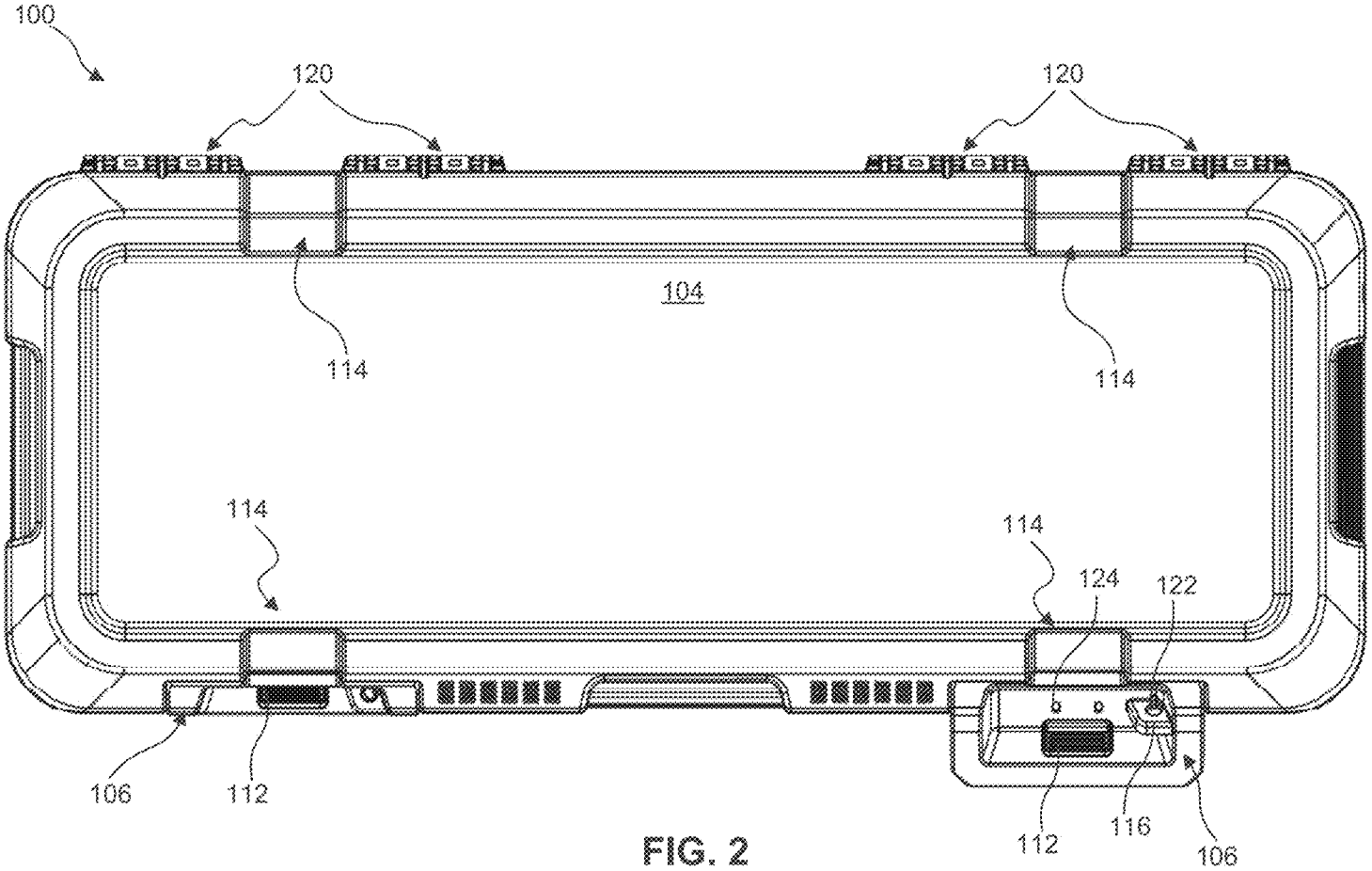
FIG. 2 illustrates a top view of the lockable case in FIG. 1, according to various aspects of the disclosure.

FIG. 2 illustrates a top view of case 100 of FIG. 1, in accordance with an embodiment. As can be seen in FIG. 2, one or more hinges/pivots 120 are positioned on one edge (e.g., one of the two long edges of case 100), while latches 106 are pivotally coupled with an opposing edge of case 100 (e.g., on a long edge of lid 104 opposite hinges/pivots 120). Further, each one of latches 106 may include a button 112 positioned within a recess in the respective latch 106. In an embodiment, button 112 may be configured to cooperate with a respective latch 106 such that a user/operator may push button 112 to disengage latch 106 from base 102 to open the lid 104 of the lockable case 100. Further details of the operation of latch 106 and button 112 will be described with respect to FIGS. 11-13 below. FIG. 2 also depicts one of the latches 106 (e.g., the latch 106 shown on the left side of the page) in a closed/engaged position, and the other latch 106 (i.e., the latch on the right side of the page) in an open/disengaged position. In the engaged position, latch 106 is configured to engage and/or interface with both the base 102 and the lid 104. Furthermore, in the disengaged position, the latch 106 is pivotally coupled with the lid 104 and not engaged with the base 102.

Currently used latches for cases, such as firearm cases, often include padlock passthroughs (i.e., holes for receiving a padlock therethrough) that are separate from the latches. In some cases, these padlock passthroughs are positioned such that a padlock may be passed through both a portion of the lid and the base of the case to prevent the case from being fully opened with the padlock in place. In some instances, however, the latches may be operated independently of the padlock such that the case may be at least partially opened even with a padlock in place. Such a partial opening may result in one or more of: small parts stored in the firearm case to fall out of the case, entry of moisture or water into the case, entry of sand and/or dust into the case, all of which may be detrimental to the components stored in the case. Furthermore, in some cases, the partial opening may present a sufficiently large gap to allow a pry bar or another tool to be used to access the contents of the firearm case. In some circumstances, prior art designs of padlock passthroughs suffered some deficiencies. For example, some padlock pass through designs left the padlocks exposed and/or left them protruding outside of the case, making the padlocks susceptible to damage during transport or storage. Such placement of the padlock outside of the firearm case also caused the padlock to rattle and/or damage objects in the vicinity of the case during transport of the case. To alleviate such issues, aspects of the present disclosure are directed to a firearm case utilizing a latch mechanism that: a) prevents the latches from being released from a closed/engaged position when a padlock is in place; and/or b) contains the padlock, when attached to the case, within the case profile (e.g., a front profile). Further details of an exemplary padlock passthrough, in accordance with an embodiment, are described with respect to FIG. 8 below.

Figure 8:
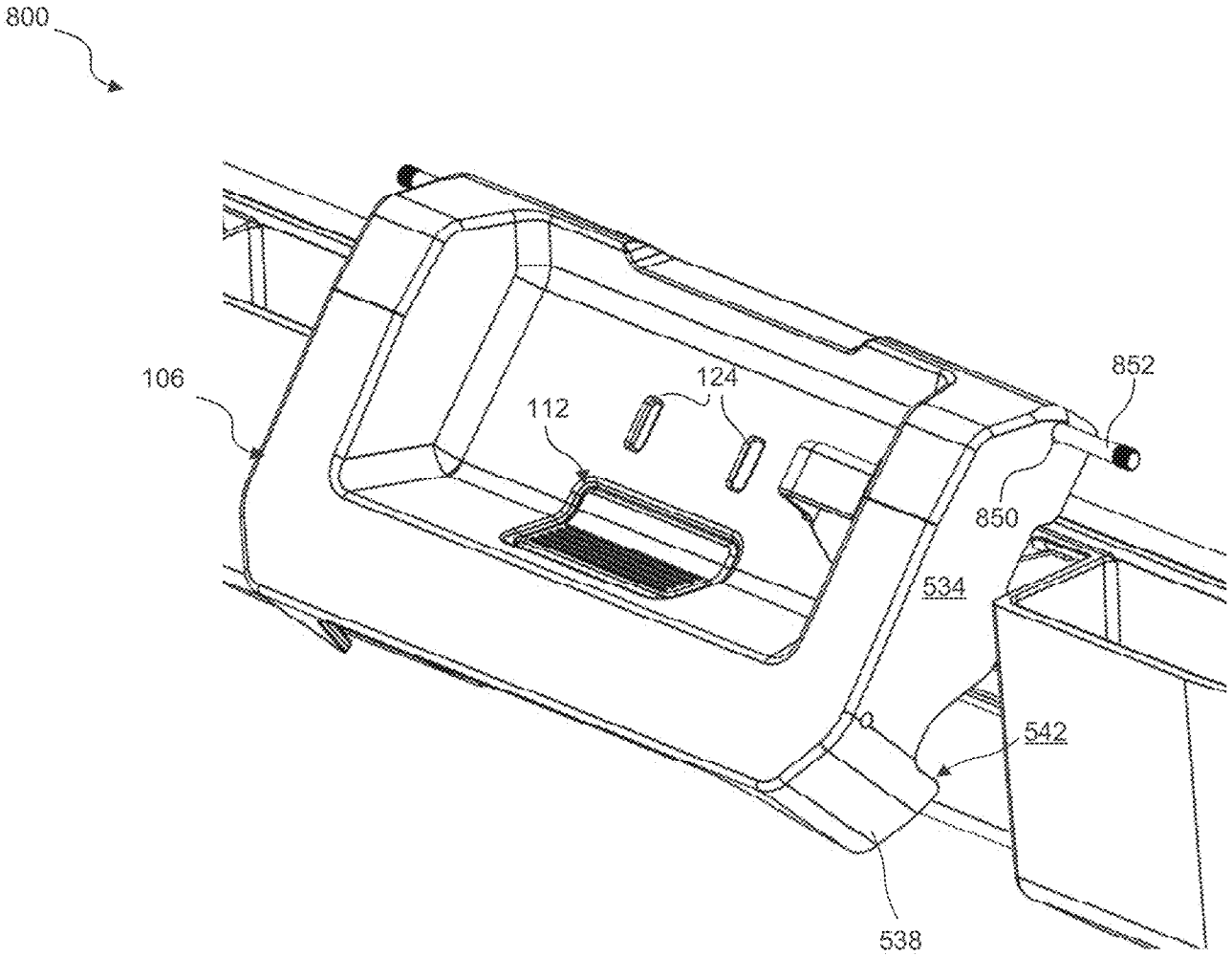
FIG. 8 illustrates a detailed perspective view of a latch configured for use with the lockable case in FIG. 1, according to various aspects of the disclosure.

FIG. 8 shows a partial close-up, top view of an area around one of latches 106, in accordance with an embodiment. As shown in FIG. 8, latch 106 includes a passthrough feature 116, including a hole 122 for receiving a lock mechanism, such as a padlock 123 (shown), a zip-tie, a wire, a cable, or another lock. Passthrough feature 116 and hole 122 are configured to cooperate with corresponding features formed into base 102, for instance. In an example, passthrough feature 116 may be positioned to cooperate with a corresponding feature in base 102 such that, when a padlock or another lock mechanism is engaged with hole 122, the lock mechanism passes through both the latch 106 and the base 102, which helps prevent disengagement of the latch 106. Further details of the corresponding feature in base 102 are discussed with respect to FIG. 18 at an appropriate juncture below. For instance, when a lock mechanism is engaged with passthrough feature 116, the lock mechanism may physically prevent latch 106 from disengaging from base 102 and/or prevent the button 112 from being accessible to the user for disengaging the latch 106. In some cases, passthrough feature 116 may be positioned within a recessed area of latch 106, wherein the recessed area may be specifically shaped and sized to accommodate a typical padlock. It should be noted that the dimensions of the recessed area may be dependent on the overall dimensions of the lockable case. For example, a lockable case designed to store a small item (e.g., handgun or pistol) may have a substantially smaller area than a lockable case designed to store a larger item (e.g., long range rifle, shotgun, cross-bow, to name a few non-limiting examples). In this way, the padlock or another applicable lock mechanism may be accommodated within a cross-sectional profile of the lockable case 100. Such a design may help prevent the lock mechanism from snagging on or damaging other objects placed in close proximity with the lockable case 100.

Figure 10:
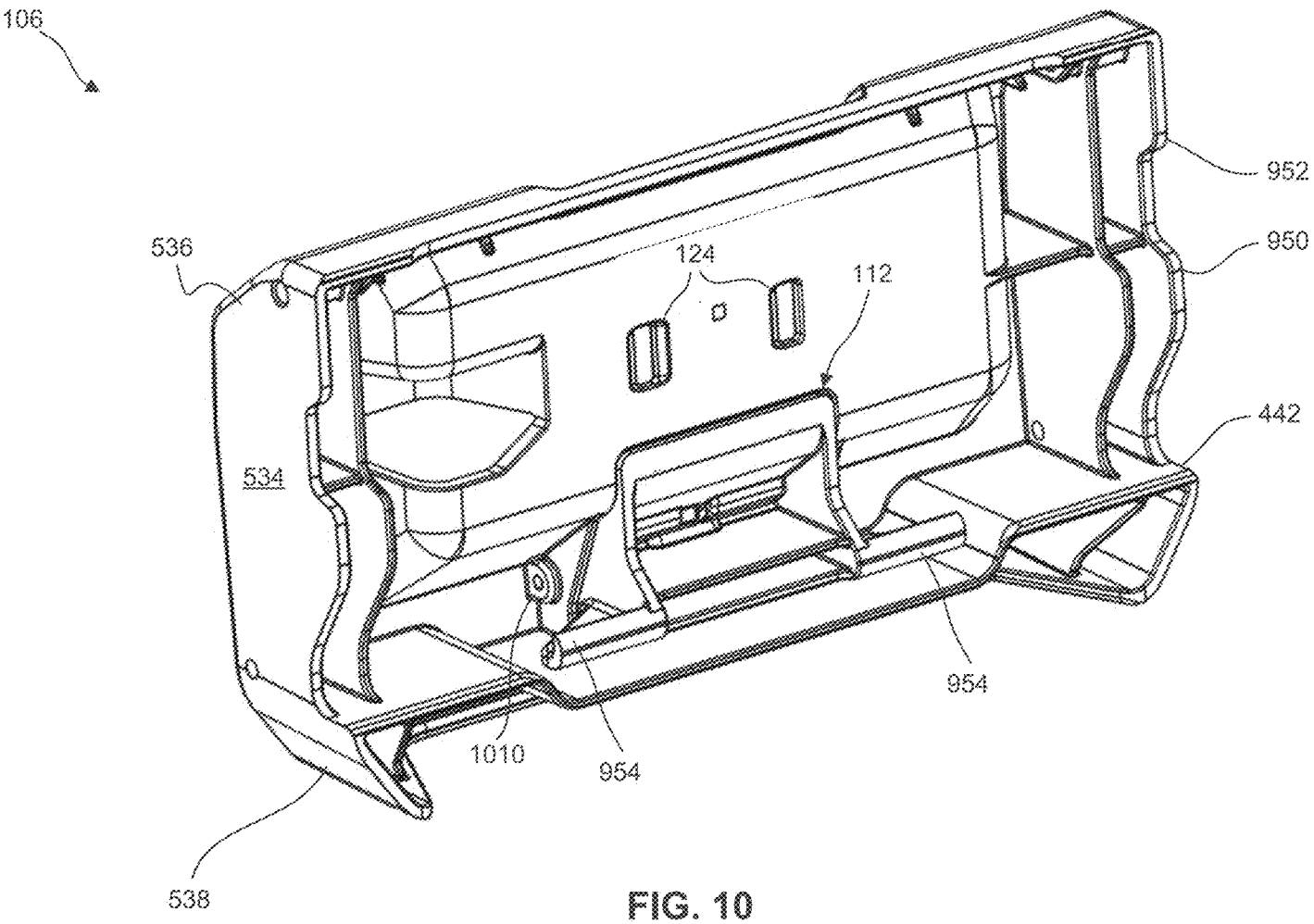
FIG. 10 illustrates a rear perspective view of the latch in FIG. 8, in isolation, in accordance with one or more aspects of the disclosure.

In some embodiments, a latch 106 may include one or more slotted holes 124, for instance, to accommodate one or more elongated lock mechanisms, such as zip-ties, wires, cables, or any other applicable elongated locking mechanisms (e.g., chain, rope, etc.) therein for securing the lockable case 100 in a closed position. For example, the elongated lock mechanism (e.g., wire) may be placed through the slotted holes 124 and around a lock mechanism, where the lock mechanism may be installed into the passthrough feature 116. Such a design may help prevent the lock mechanism, from snagging/catching on luggage handling equipment, a user or operator's clothing, or any other obstruction that can remove or damage the lock mechanism. In an embodiment, a small gap may be provided between the rear portion of the latch (i.e., the portion of the latch facing the outer wall of the lockable case) and the outer wall of the case. That is, a sufficient space may be provided behind the latch 106, which may allow a user to use a zip-tie or similar component to enter through one slotted hole 124 of the latch and exit through an adjacent slotted hole 124 of the latch 106. Such a design may further help secure the latch 106 from protruding past the outer profile of the case 100 and inadvertently interact with other objects in the vicinity of the case 100 during transport. In an optional embodiment, one or more of the base 102 and the lid 104 may include corresponding openings or features (not shown) aligned with slotted holes 124 such that, when the elongated locking mechanism (e.g., wire or chain) is directed through one slotted hole (e.g., slotted hole 124 on the left in FIG. 2) and out the other (e.g., slotted hole 124 on the right in FIG. 2), the elongated locking mechanism also passes through the corresponding openings or features in the base 102 and/or the lid 104 in order to further secure latch 106 form inadvertent disengagement. Although FIG. 2 depicts the slotted holes 124 as having an elongated shape, other shapes, such as a more symmetric shape (e.g., circle or square) may be implemented in different embodiments. Further details of slotted holes 124, in accordance with an embodiment, are shown in FIG. 10, described at an appropriate juncture below.

Returning to FIGS. 1 and 2, in some embodiments, the lid 104 includes one or more channels 114 for accommodating a strap or a belt (e.g., ratchet straps) therein. In an example, these macro-sized channels 114 may keep such straps (not shown) from slipping, migrating, or shifting along the lockable case 100 as the case is transported. In some regards, channels 114 may help alleviate some of the issues seen in prior art designs of cases, which typically included a surface texture for preventing slippage of a strap. Conversely, the channels 114 described herein may help provide a more robust engagement surface as compared to prior art designs. Additionally, or alternatively, the disclosed channels 114 may be configured to interface with the strap(s), which may help reduce strap slippage as compared to the prior art. Said another way, the channels 114 may help to reduce slippage of different types of straps over a wider range of conditions than otherwise would be possible without such channels 114, as numerous factors (e.g., moisture, load shifting, vibration, and/or dynamic forces encountered while traversing rough terrain) are known to adversely affect the strap tension of many prior art straps.

Figure 3:
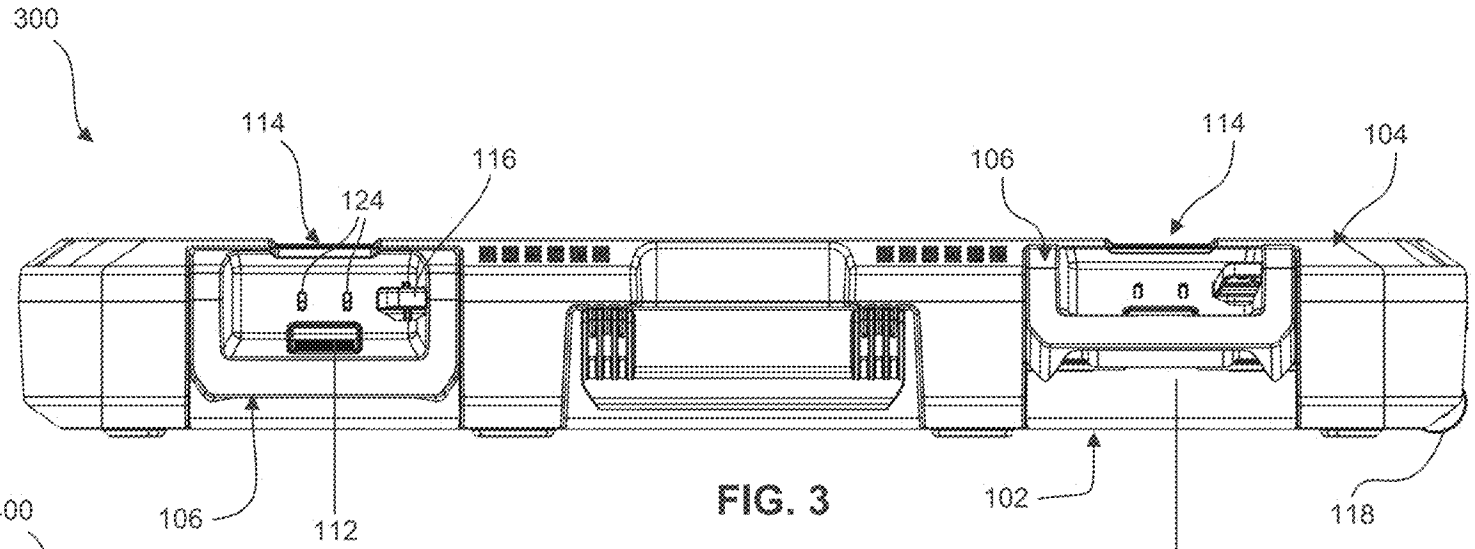
FIG. 3 illustrates a front view of the lockable case in FIG. 1, according to various aspects of the disclosure.
Figure 4:
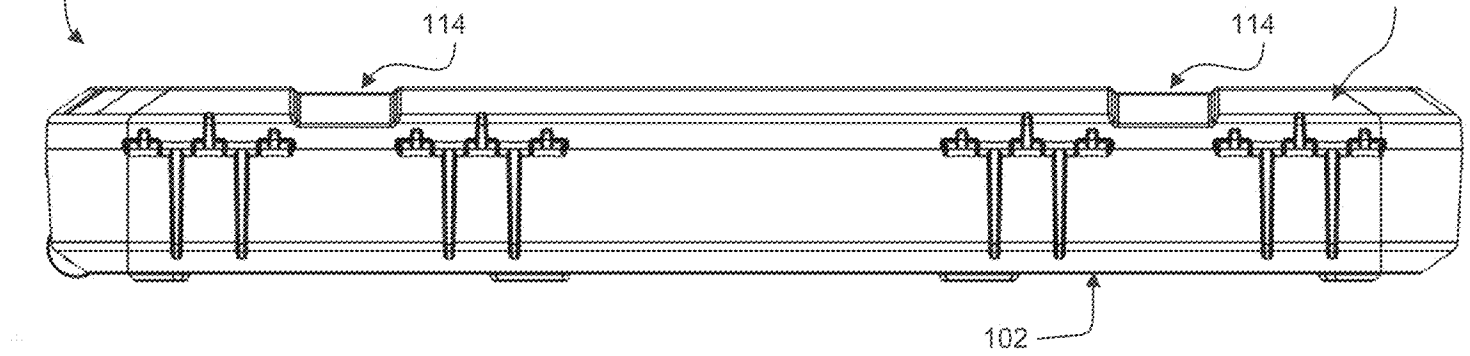
FIG. 4 illustrates a rear view of the lockable case in FIG. 1, according to various aspects of the disclosure.

FIGS. 3 and 4 illustrate a front view (300) and a rear view (400), respectively, of the case 100 of FIGS. 1 and 2, according to various aspects of the disclosure.

Figure 5:
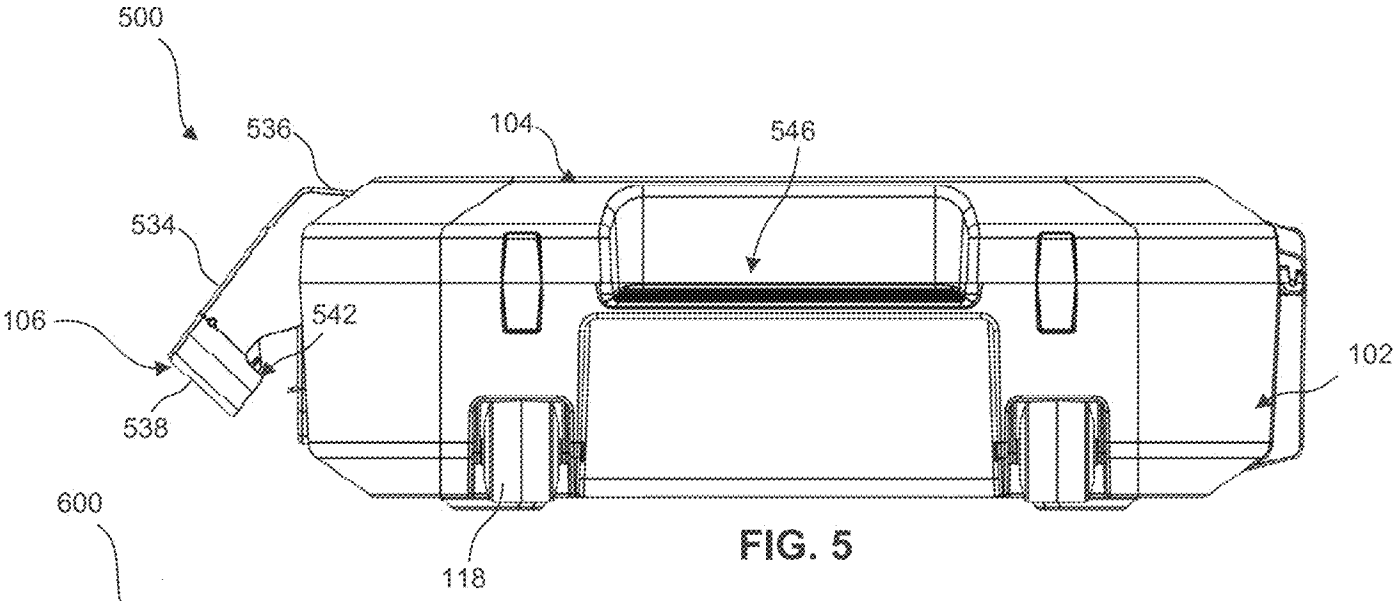
FIG. 5 illustrates a side view of the lockable case in FIG. 1, according to various aspects of the disclosure.
Figure 6:
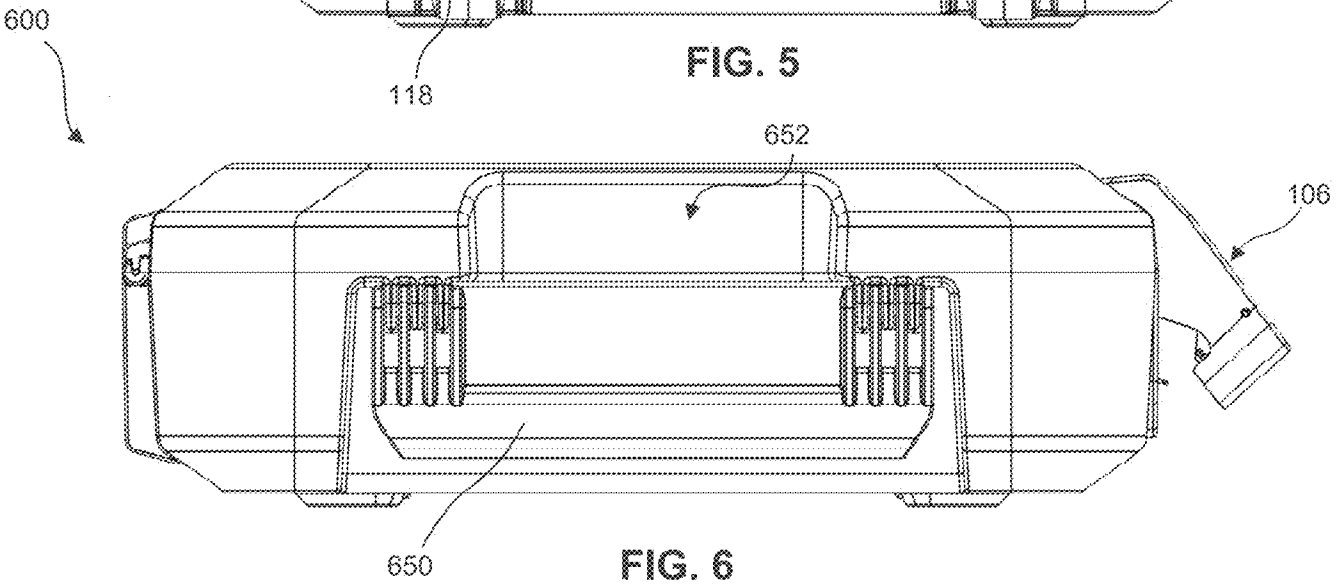
FIG. 6 illustrates an alternate side view of the lockable case in FIG. 1, according to various aspects of the disclosure.

FIGS. 5 and 6 illustrate two different side views along the short edges of the lockable case 100, according to various aspects of the disclosure. Specifically, FIG. 5 illustrates a side view (500) showing the rear or bottom end of the lockable case, as the side view 500 depicts the wheels 118. Additionally, FIG. 6 illustrates a side view (600) showing the top or front end of the lockable case 100 due to the presence of the handle 650, which may allow a user to drag the lockable case 100 along the ground (i.e., instead of physically carrying it).

As is more visible in FIG. 5, the latch 106 includes a latch body 534, a first end 536 pivotally coupled with the lid 104, and a second end 538 configured for interfacing with the base 102. In some embodiments, at least a portion of the latch, such as the second end 538 may be configured to be gripped by a user while engaging the latch 106 (i.e., closing the lockable case 100) and disengaging the latch 106 (i.e., opening the lockable case 100). As seen, the second end 538 includes a protrusion 542, which is shaped and sized to mate with a protruding edge of the base 102 (not visible in FIG. 5). For instance, protrusion 542 may be configured to cooperate with the protruding edge of the base 102 to snap the latch 106 over the protruding edge, e.g., during closure of the case 100 and/or when the latch 106 is in a closed/engaged position.

FIG. 5 further depicts a wheel-sided handle 546 and exemplary locations of wheels 118 as seen from a wheel-side edge of case 100. As shown in the embodiment illustrated in FIG. 5, wheel-sided handle 546 is integrated with and recessed into case 100 such that, when wheels 118 are placed on the ground, the case 100 may be rolled with minimal to no interference from the handle 546. In some aspects, the recessed handle design of the wheel-sided handle 546 may help overcome a problem with currently available cases, which frequently include a wheel-sided handle that protrudes from the case profile such that the wheel-sided handle must be folded and/or tucked away in order for the wheels to function properly. Further, the recessed handle design of the wheel-sided handle 546 may also provide additional clearance from the ground surface for the case 100, for example, when the lockable case 100 is standing vertically on the wheel-side edge. Additionally, or alternatively, the recessed handle design may also facilitate the use of a sufficiently wide and/or deep handle, which may serve to enhance user experience since a user may be able to grasp the handle despite wearing gloves.

FIG. 6 shows details (600) of a third handle 650 disposed on an opposing short side of the case 100 (i.e., the short side of the case 100 positioned away from the wheel-side where wheels 118 are located). As shown in FIG. 6, third handle 650 may be formed with a folding design, similar to handle 110 on the long edge of case 100, with sufficient width for comfortable gripping. Further, the lockable case 100 may include an optional grip recess 652, again with sufficient width and depth for providing a comfortable space for the user to insert their hand when gripping the third handle 650, for instance, even while wearing gloves or other protective gear on the hand. In this way, the lockable case 100 may include various features that help make it more versatile and enable it to be used in a wide range of environments (e.g., desert, tropical rainforest, polar and tundra climates, to name a few non-limiting examples). As described in further detail below, the lockable case 100 may include a weather-resistant seal, such as a gasket, which may assist in one or more of pressure equalization between the pressure in the interior of the case and the atmospheric pressure external to the case. Additionally, the weather-resistant seal may also help provide a tight seal and help prevent moisture laden air, water, and other liquids from entering the interior of the case and potentially damaging the sensitive equipment stored within the case 100.

Figure 7:
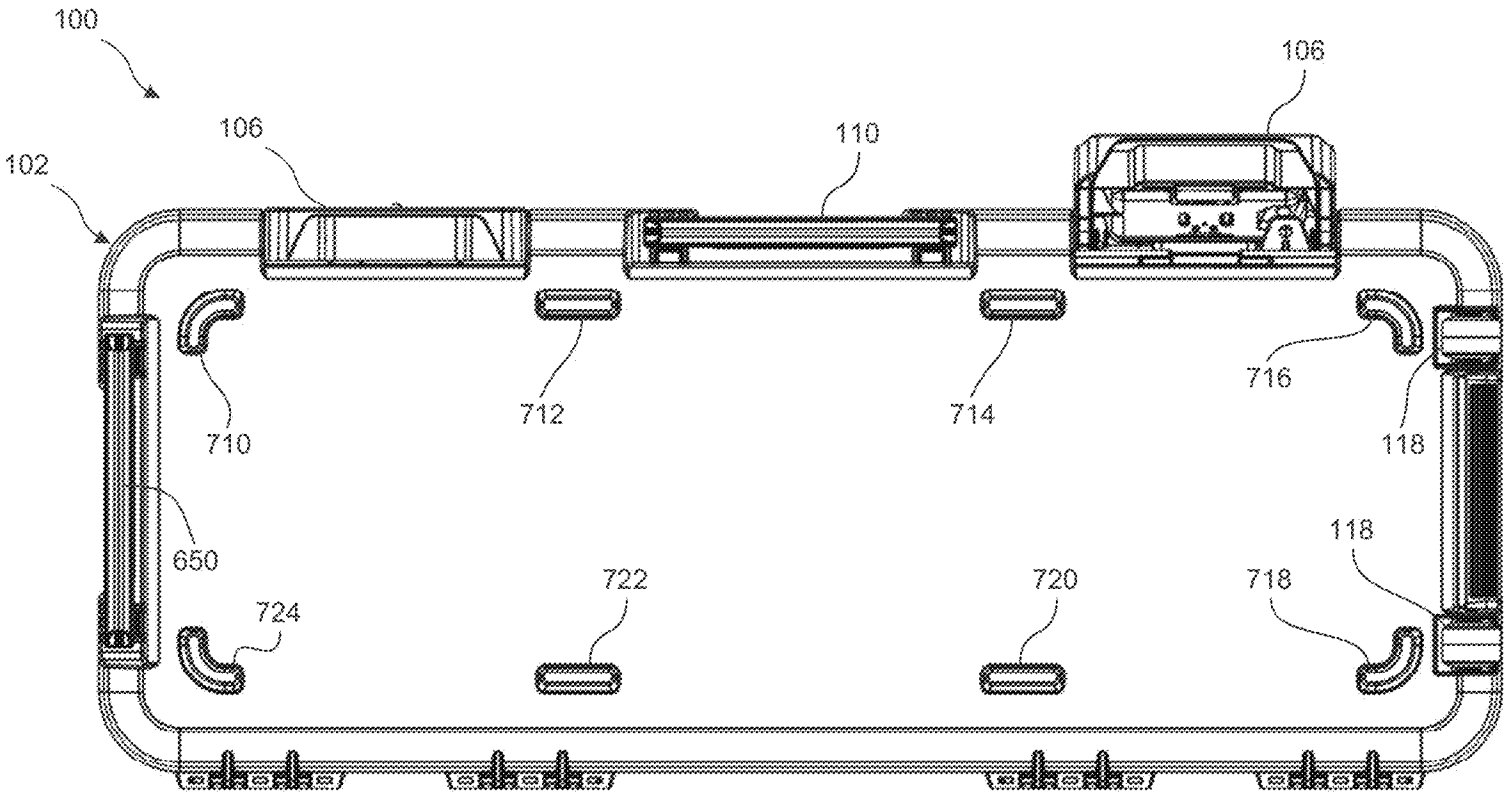
FIG. 7 illustrates a bottom view of the lockable case in FIG. 1, according to various aspects of the disclosure.

FIG. 7 illustrates a bottom view of case 100, according to various aspects of the disclosure. As is visible in FIG. 7, base 102 includes a plurality of bosses 710-724 (eight bosses are shown in the example illustrated in FIG. 7) arranged to cooperate with the ridge features 125 (not visible from this angle, but the ridge features 125 are shown in FIGS. 1 and 2) on the lid 104. For instance, when multiple cases are stacked atop each other, the bosses 710-724 on the base of the upper case may be configured to interface with the ridge features 125 on the lid of the lower case. This snug interface between the ridge features and the bosses may help prevent lateral movement of the stacked cases relative to each other, which enables multiple cases to be stacked on top of each other. In other words, the snug interface between the ridge features 125 of the lid on a lower case and the bosses 710-724 on the upper case (i.e., case above the lower case) may help reduce the risk of lateral movement of the upper cases relative to the bottom-placed case, as such lateral movement may lead to the toppling of the entire stack of cases above the bottom-placed case.

FIG. 8 illustrates a detailed perspective view (800) of latch 106 of a lockable case, such as case 100 in FIG. 1, according to various aspects of the disclosure. In this example, the lid is hidden to better illustrate the interaction of the latch 106 with the internal mechanisms of the lid. As can be seen in FIG. 8, latch 106 includes a recess or hole 850 on each side of first end 534 for receiving a rod or pin 852 such that latch 106 is rotatably coupled with the lid (not shown) via the pin 852. In an example, latch 106 may be configured to rotate or pivot about pin 852, where one end of pin 852 is received in the hole 850 of the first end 534, while the other end of pin 852 is received in another receiving hole in the lid (not shown). For example, the pin 852 may be shaped and sized to extend through the width of the latch 106, such that the opposing end of the pin exits through another hole that is positioned on an opposing end (i.e., end opposing side 534 and/or hole 850) of the latch 106. Furthermore, this opposing end of the pin 852 may be configured to be received in another receiving hole in the lid. In other words, each end of the pin 852 may be configured to be received in different holes (not shown) positioned on either side of the latch, which helps secure the latch 106 within the latch recess of the lid.

Figure 9:
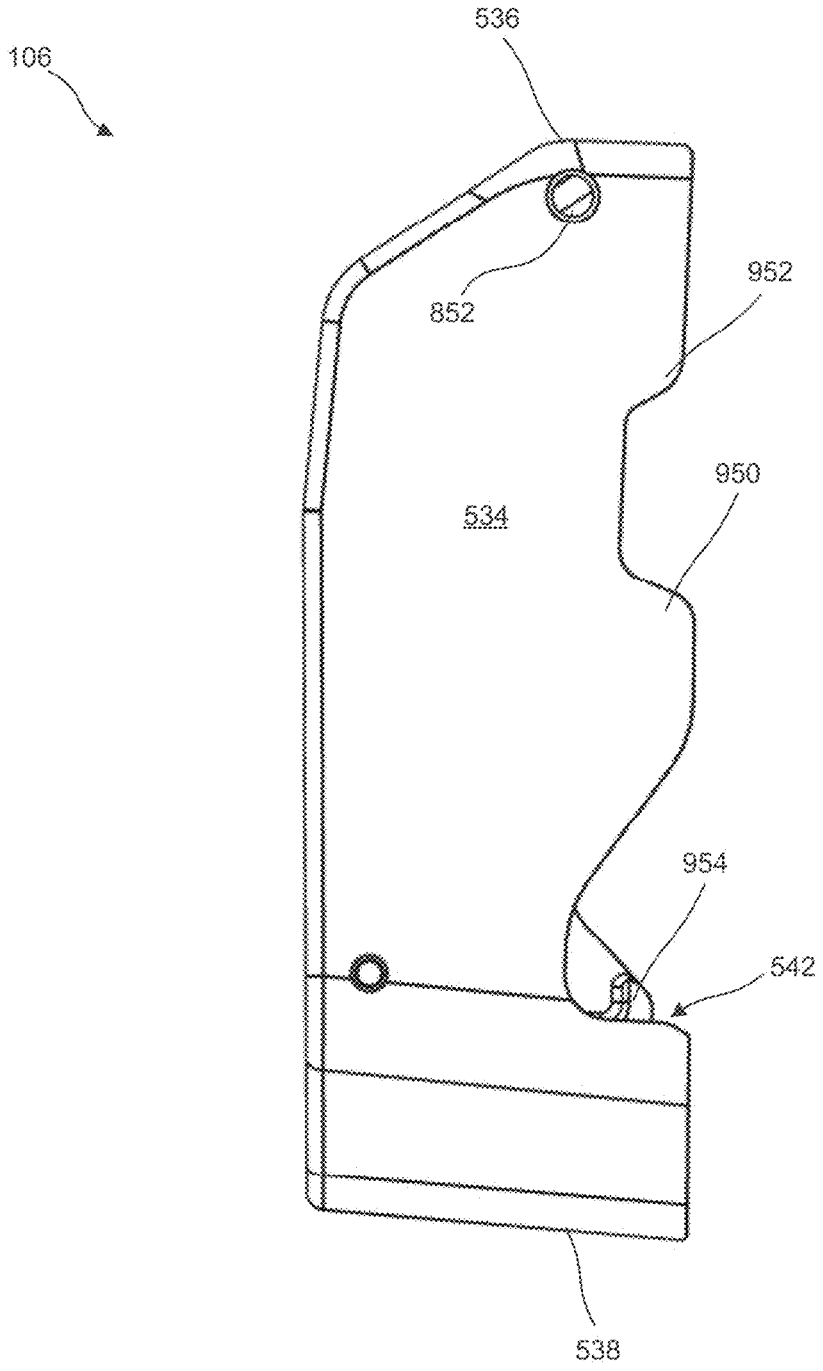
FIG. 9 shows a side view of the latch in FIG. 8, in isolation, according to various aspects of the disclosure.

FIG. 9 illustrates a side view of a latch 106 (i.e., shown in isolation without the lid), in accordance with one or more implementations. Latch body 534 of latch 106 includes one or more inward protrusions or detents for engaging with at least one mating retention feature, such as a protruding edge, on the base 102 or lid 104 of the lockable case 100. In the exemplary embodiment illustrated in FIG. 9, the latch body 534 includes, in addition to the protrusion 542 discussed above, a second protrusion 950 and a third protrusion 952. In some embodiments, the protrusion 542 may be configured to cooperate with a protrusion feature on base 102 (not shown), which helps snap the latch 106 into a closed position when engaged with the base 102. In some embodiments, the second and/or third protrusions 950 and 952 may serve to provide similar or substantially similar snap-fit functionality as the protrusion 54. For example, the protrusions 950 and/or 952 may assist guiding the latch 106 into place with respect to the base 102, or simply provide additional strength and stability to the latch 106, which may help prevent the latch from inadvertently disengaging from the base.

Also in FIG. 9, the backside of button 112 (see, for example, FIGS. 1, 2, and 6 discussed above) includes a hook 954 for engaging base 102 (e.g., see FIGS. 11 and 12 below), separately from latch 106, when lid 104 is in a closed position with respect to base 102. That is, hook 954 of button 112 may optionally engage base 102 to keep case 100 closed even while latch 106 is has started to open (e.g., see FIG. 11 below). In some cases, hook 954 may be spring-loaded (see, for example, the torsion spring shown in FIG. 16 below) and may be biased to rotate toward base 102 (i.e., counterclockwise or upward as shown in FIG. 7) into a closed position to reduce the amount of force required to engage latch 106 with base 102. Hook 954 may be further rotated against the bias, which may be based on contact with the base 102 as the latch 106 is being engaged. In some instances, the hook 954 may be configured to rotate back into a locked position once the latch 106 is fully engaged with the base 102. Optionally, a user may control the movement of spring-loaded hook 954 by pushing on the button 112 of the latch 106. For instance, to open the case 100 after disengaging latches 106, the user may be required to push on button 112 to force the hook 954 to rotate in a clockwise or downward manner, which may help disengage the hook 954 from the base 102 and enable the user to pull the lid 104 away from the base 102 (i.e., pull the second end 538 away from the base 102). Such a two-step process for opening the case may serve to provide additional security from unintentional opening of the case. The mechanism of this action will be described in further detail with respect to FIG. 11 below.

FIG. 10 shows a rear view (1000) of latch 106, in isolation from the other components of the case, in accordance with various aspects of the disclosure. As can be seen in FIG. 10, button 112 includes one or more hooks 954 for engaging with the base 102 when the latch 106 is fully closed. Button 112 may be, for example, separately formed from the rest of latch 106, then attached to latch 106 via a tab 1010, where the tab 1010 is configured for cooperating with a notch (not visible in FIG. 10) in the button 112, e.g., for rotatably coupling the button 112 with the latch 106. In an embodiment, button 112 may be spring-loaded with a spring (not shown) to bias the button 112 in a particular orientation, for instance, to bias the hooks 954 such that they engage with the base 102 when the button 112 is not depressed by a user.

Figure 11:
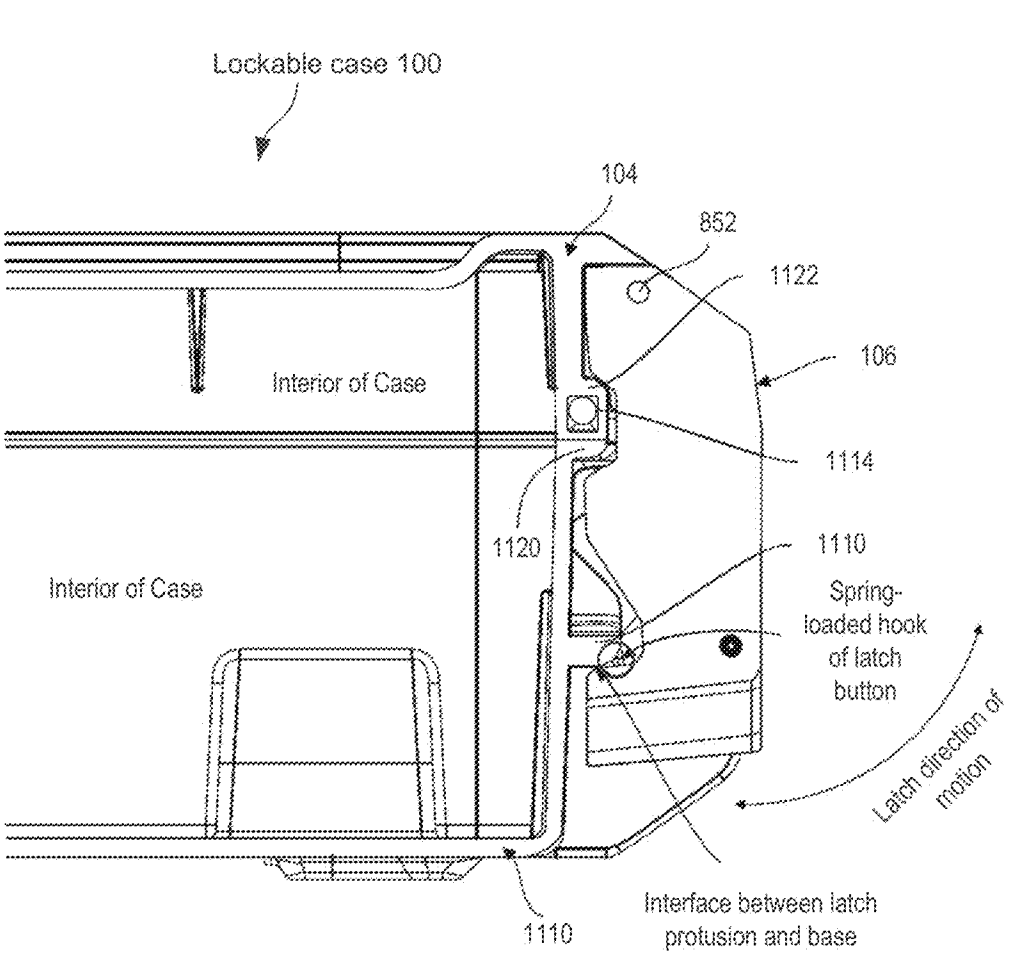
FIG. 11 depicts a side, partial cross-sectional view of the lockable case, as well as a side view of a latch, shown here to illustrate the operations of the engagement and disengagement of the latch, in accordance with one or more aspects of the disclosure.

FIG. 11 depicts a side, partial cross-sectional view (1100) of the assembled case 100 (or lockable case 100), according to various aspects of the present disclosure. In this example, FIG. 11 depicts a side view of the latch 106, which helps illustrate the operations of the engagement and disengagement of the latch 106 with the base, in accordance with one or more embodiments. As can be seen in FIG. 11, latch 106 is pivotally coupled to the lid 104 via a pin 852, which allows the latch 106 to swing from an open position (i.e., where the bottom end of the latch is disengaged from the base) and a closed position (i.e., where the bottom end of the latch is engaged with the base, which may be based on the interface between the protruding edge(s) of the base and the protrusions on the latch). FIG. 11 shows the latch direction of motion (i.e., indicated as a double-headed arrow) to depict the open and closed movement of the latch 106. In an example, when the latch 106 is rotated clockwise, the second end 538 of latch 106 contacts a shelf 1110 protruding from base 102 to provide a frictional contact of latch 106 with base 102. In an embodiment, second end 538 may include a lip feature configured to snap onto shelf 1110. In this way, closure of the lockable case 100 is based on a snap-fit interaction between one end (i.e., bottom end) of the latch 106 and a protruding edge or shelf of the base.

Furthermore, as latch 106 is further rotated in the clockwise direction, hook 954 of button 112 may be configured to engage with a corresponding feature (not shown) formed on base 102. As discussed above, hook 954 may be spring-loaded to bias the hook 954, such that the hook 954 remains engaged with the corresponding feature on the base 102 until button 112 is depressed. In some cases, depressing the button 112 enables the hook 954 to be released from the corresponding feature on the base 102. In some cases, the user must apply a threshold amount of force to depress the button 112, i.e., in order to release the hook 954 and allow the latch 106 to be disengaged from the base 102. In other words, opening the latch 106 may require one or more of: (1) application of sufficient torque (or a torque above a pre-defined threshold) to overcome a friction fit or snap fit between the lip feature of the second end 538 of the latch and the shelf 1110 of the base, and (2) depression of the release button 112 such that the release hook 954 disengages from the base 102.

In some embodiments, the lockable case 100 may include a passive pressure equalization element, such as a vent, valve, and/or a gasket, described in further detail below. As used herein, the terms "passive pressure equalization element", "pressure equalization element", and "pressure equilibrium element", "pressure control element", and "pressure stabilization element" may be used interchangeably throughout the disclosure. Specifically, the use of a pressure equalization or pressure equilibrium element may help smoothen the steep pressure gradient formed when there is a drastic difference between the pressure in the interior of the case (which may be at or equal to the atmospheric pressure at the location where the case was closed and locked) and the atmospheric pressure external to the case. For example, as shown in FIG. 11, a gasket 1114 may be incorporated or integrated into at least a portion of one or both of the base 102 and the lid 104. Such a gasket may provide a water-tight or water-resistant seal when base 102 and lid 104 are engaged together using the latch 106. This can help prevent moisture permeation into and out of the interior of case 100. As an option, second protrusion 950 (e.g., shown in FIGS. 9 and 10) and optionally third protrusion 952 (e.g., also shown in FIGS. 9 and 10) on the latch 106 may be configured to interface with a protruding edge 1120 on the base 102 and a protruding edge 1122 on the lid 104. Such a design can help apply a closing force between the base 102 and the lid 104, which in turn serves to compress the gasket 1114. This compression of gasket 1114 may further enhance the seal provided by the gasket 1114. In the embodiment shown in FIG. 11, this compressive force is provided by both the second and third protrusions 950 and 952, though in other embodiments, the second or third, but not both, protrusions 950 and 952 may be configured to provide this compressive force (e.g., see FIG. 26, where the indicated interface between latch protrusion and base applies the compressive force on gasket 1114). In some embodiments, a passive pressure equalization element, such as a valve or a vent (not shown), may be integrated into case 100 for regulating pressure gradients between the interior of the lockable case 100 and the external atmosphere during transport between different elevations (e.g., from a naval base to a military site in the higher elevations of Colorado or Utah; when transported via airplane).

In an embodiment, base 102 and/or lid 104 may be constructed of a double wall design, where an outer wall of case 100 exhibits a continuous form with a smooth and streamlined design. Such a continuous form mitigates issues seen in currently available firearm cases, which often include interrupted outer surfaces, which tend to snag on surrounding items and/or collect dirt and debris therein.

Further, third protrusion 952 (not shown in FIG. 11, but shown in FIGS. 9 and 10) and the protruding edge 1122 on the lid 104 may be configured to provide an intermediate point between the latched (i.e., fully engaged) and unlatched (i.e., fully disengaged) positions. For instance, after a user has depressed button 112 to release hook 954 from base 102, a frictional interaction between third protrusion 952 and protruding edge 1122 may prevent latch 106 from immediately opening—for instance, where latch 106 only moves a few millimeters toward an open position. At this point, the user may be required to apply an extra pulling force (e.g., a force exceeding a pre-defined threshold frictional force present between third protrusion 952 and protruding edge 1122) to enable third protrusion 952 to clear protruding edge 1122, thus allowing latch 106 to become fully disengaged and enabling the user to open lid 104. Similarly, the user may be required to apply an extra pushing force on latch 106 to enable third protrusion 952 to overcome protruding edge 1122. Such a configuration of third protrusion 952 and protruding edge 1122 may provide a more secure fit of latch 106 onto base 102 and/or prevent unintentional latching or locking of case 100.

Figure 12:
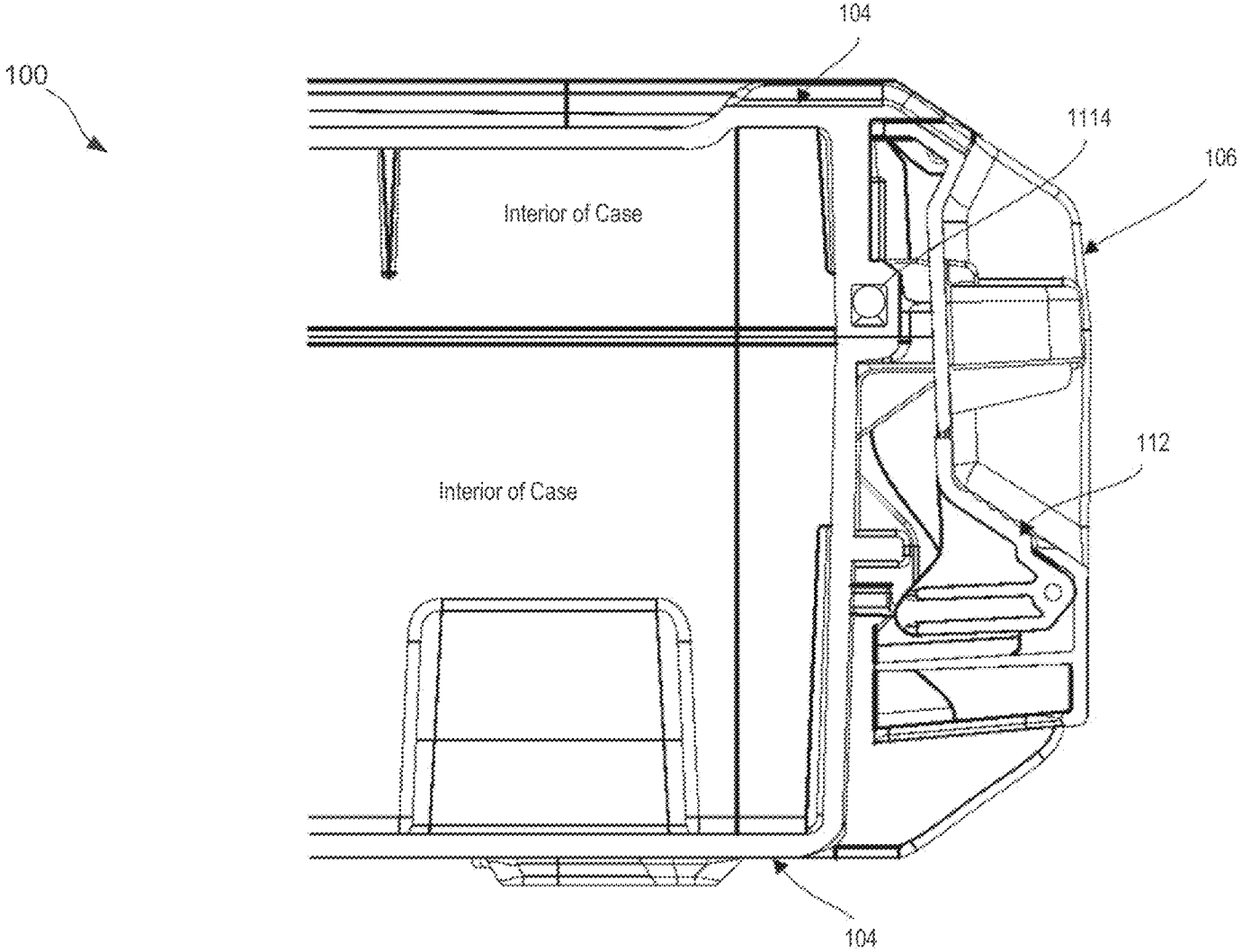
FIG. 12 depicts a side, partial cross-sectional view of the lockable case, as well as a cross-sectional side view of the latch, shown here to illustrate further details of the operation of a button of the latch, in accordance with one or more aspects of the disclosure.

FIG. 12 shows a side, partial cross-sectional view of the assembled case 100, this time including a cross-sectional side view of latch 106, shown here to illustrate further details of the operation of button 112, in accordance with an embodiment. It is noted that features visible in FIG. 12 particularly related to the walls of the case and latch 106, including button 112, have been described in detail above with respect to, for example, FIGS. 9 and 10.

Figure 13:
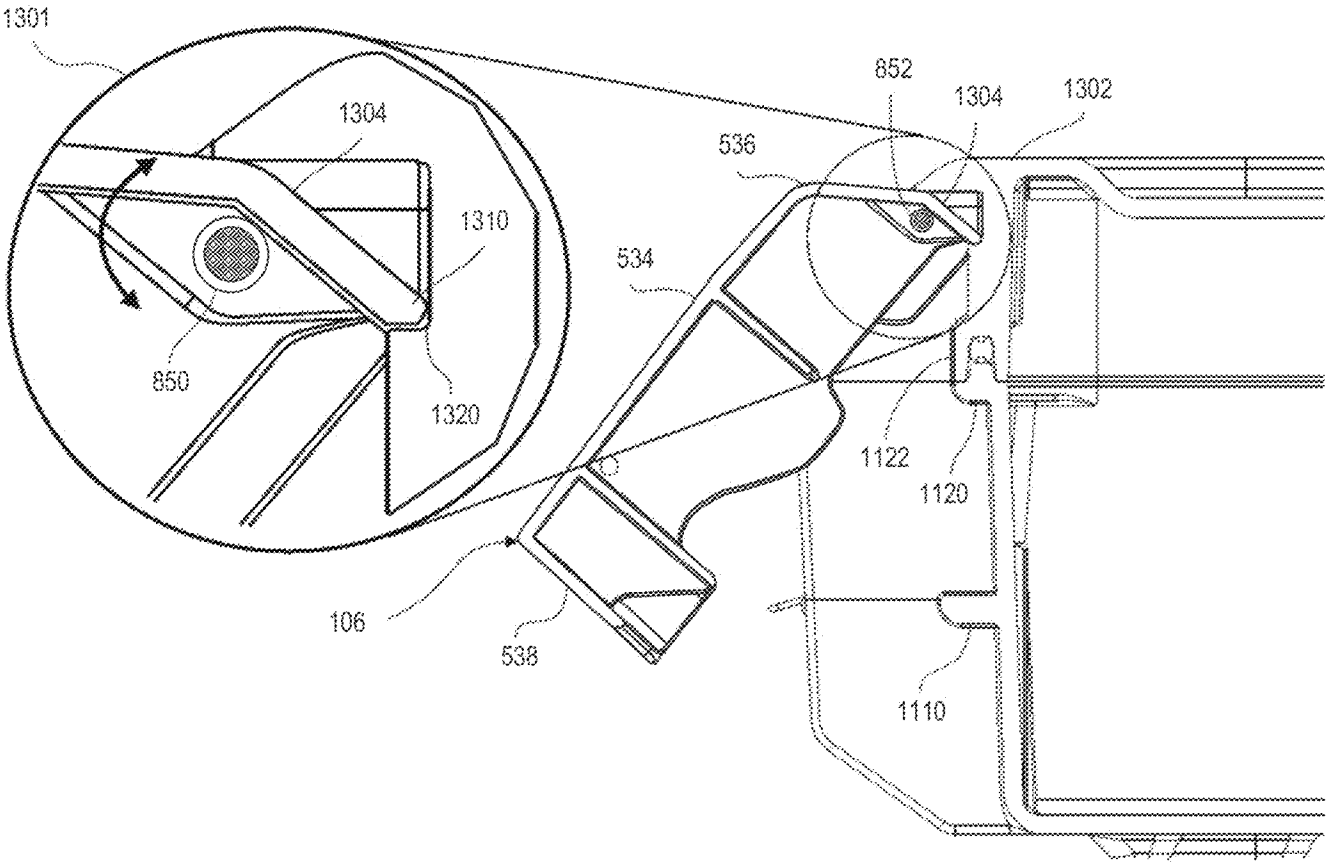
FIG. 13 illustrates another cross-sectional side view and an inset of a portion of the lockable case, as well as a detailed view of a detent-open mechanism configured to e be used with a latch of the lockable case, according to various aspects of the disclosure.

FIG. 13 shows another cross-sectional side view and an inset 1301 of a portion of case 100, included here to illustrate an exemplary embodiment of a detent-open mechanism. In this embodiment, pin 852 is arranged closer to a wall 1302 of lid 104 than a length of a top 1304 of latch 106. Thus, an arc formed by this edge of latch 106 passes through wall 1302. When opening and closing latch 106, this over-center arrangement acts as a detent and either biases latch 106 into a fully-open or optionally a fully-closed position (although this second option is not shown). Such an arrangement is especially useful for the open position, where latch 106 may be held in an open position rather than closing due to gravity. In other words, as latch 106 is disengaged and rotated clockwise in FIG. 13, a tip 1310 of latch 106 becomes caught in a recess 1320 of wall 1302, as shown in closer detail in inset 1301. The arc of movement of tip 1310 causes it to press against wall 1302 and into recess 1320. If sufficient force is applied to latch 106, tip 1310 can be made to slip past recess 1320 by slight deformation of latch 106, pin 852, and/or wall 1302. The sizing tolerances between the various components shown in FIG. 13 may also be specified to enable latch 106 to move past this over-center position between open and closed positions, in certain embodiments.

Figure 14:
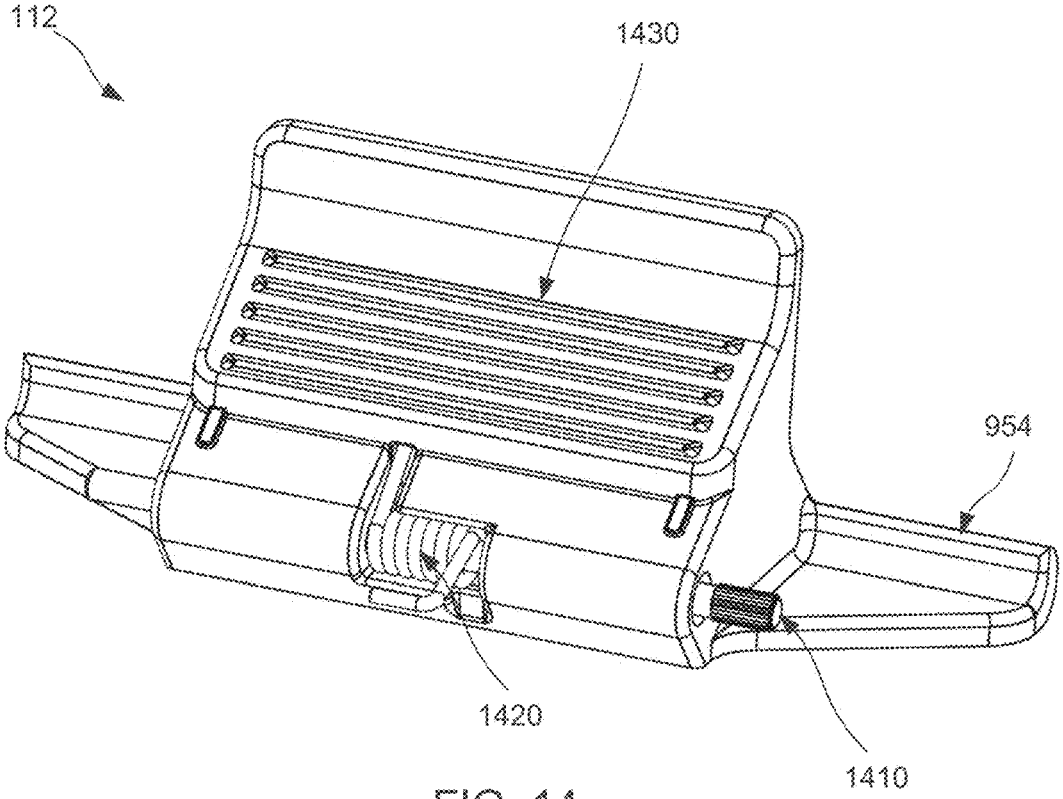
FIG. 14 shows a front perspective view of button of a latch, in accordance with various aspects of the disclosure.
Figure 15:
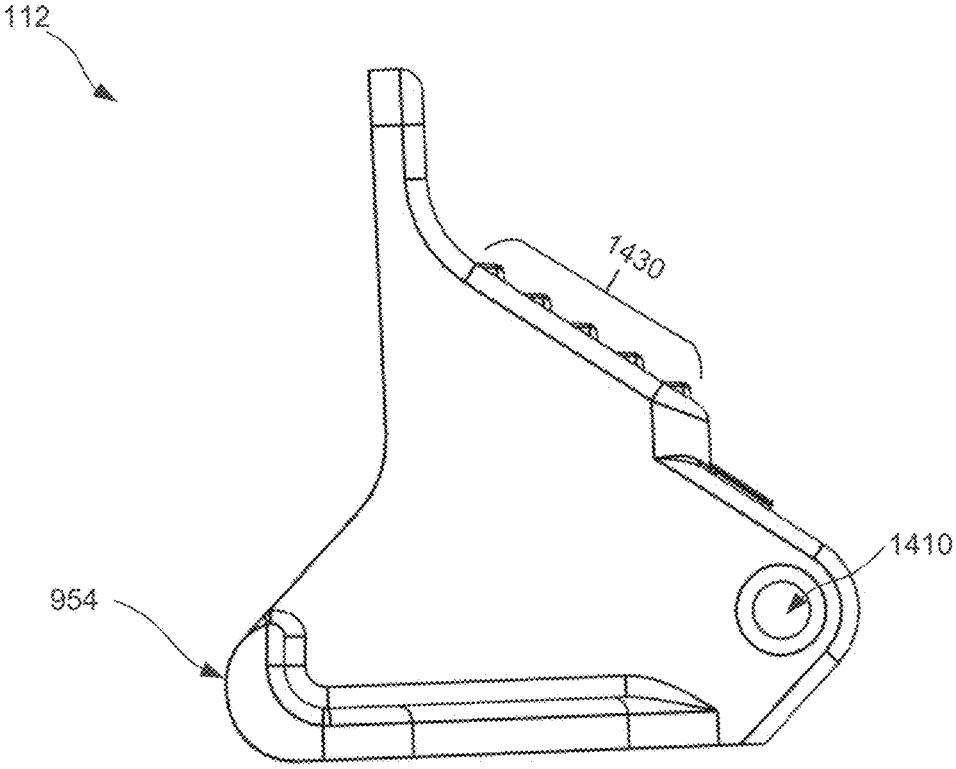
FIG. 15 shows a side view of the button in FIG. 14, in accordance with various aspects of the disclosure.

FIGS. 14 and 15 show front perspective and side views, respectively, of button 112 in isolation. As visible in FIG. 14, button 112 includes a latch pin 1410 configured for rotatably coupling with the rest of latch 106, for example via tab 1010 as shown in FIG. 10. A spring 1420 (e.g., a torsion spring) may be integrated into button 112 to bias button 112 to rotate in a clockwise direction as shown in FIG. 15 such that hook 954 is biased to remain in engagement with a corresponding feature in base 102, in accordance with certain embodiments. Optionally, latch pin 1410 and spring 1420 may collaborate to retain button 112 in a coupled configuration within latch 106. Further, as visible in both FIGS. 14 and 15, button 112 may include one or more ridges 1430 for providing improved grip for a user while engaging with button 112.

Figure 16:
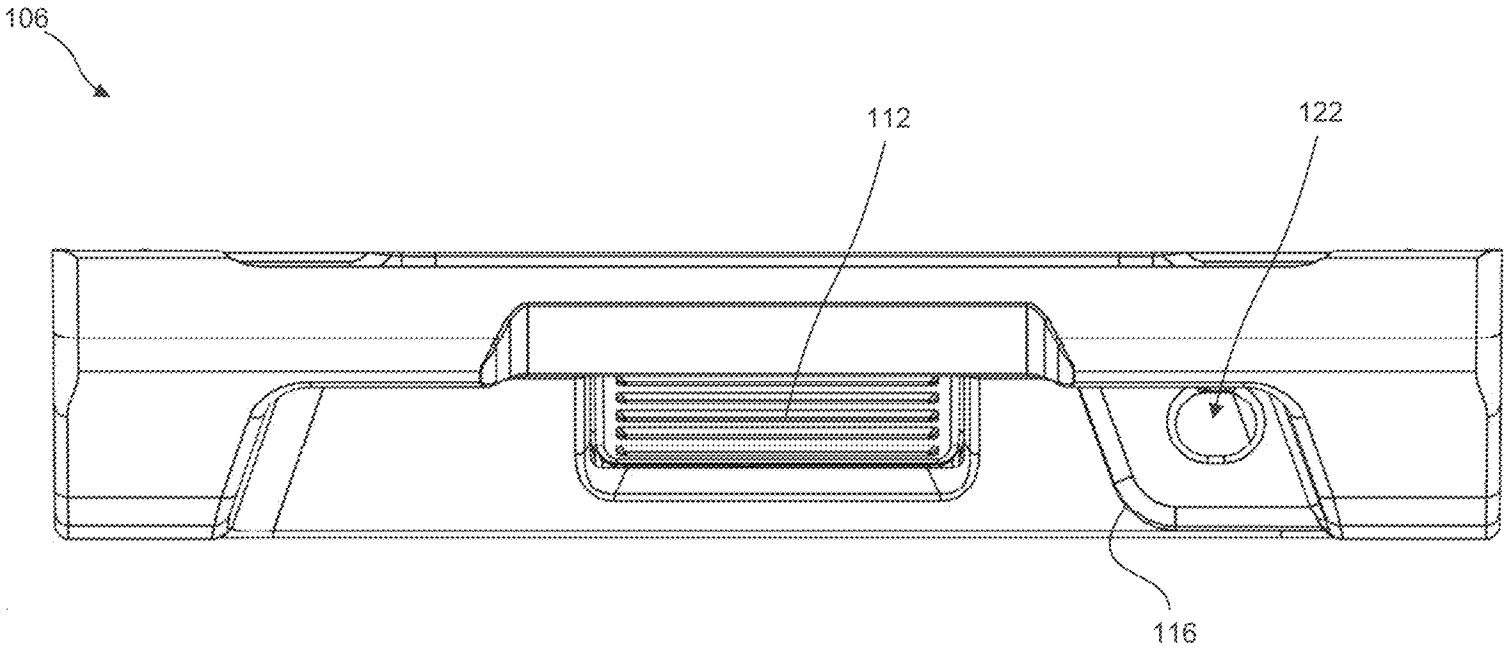
FIG. 16 shows a top close-up view of a portion of a lockable case having a latch, in accordance with various aspects of the disclosure.
Figure 17:
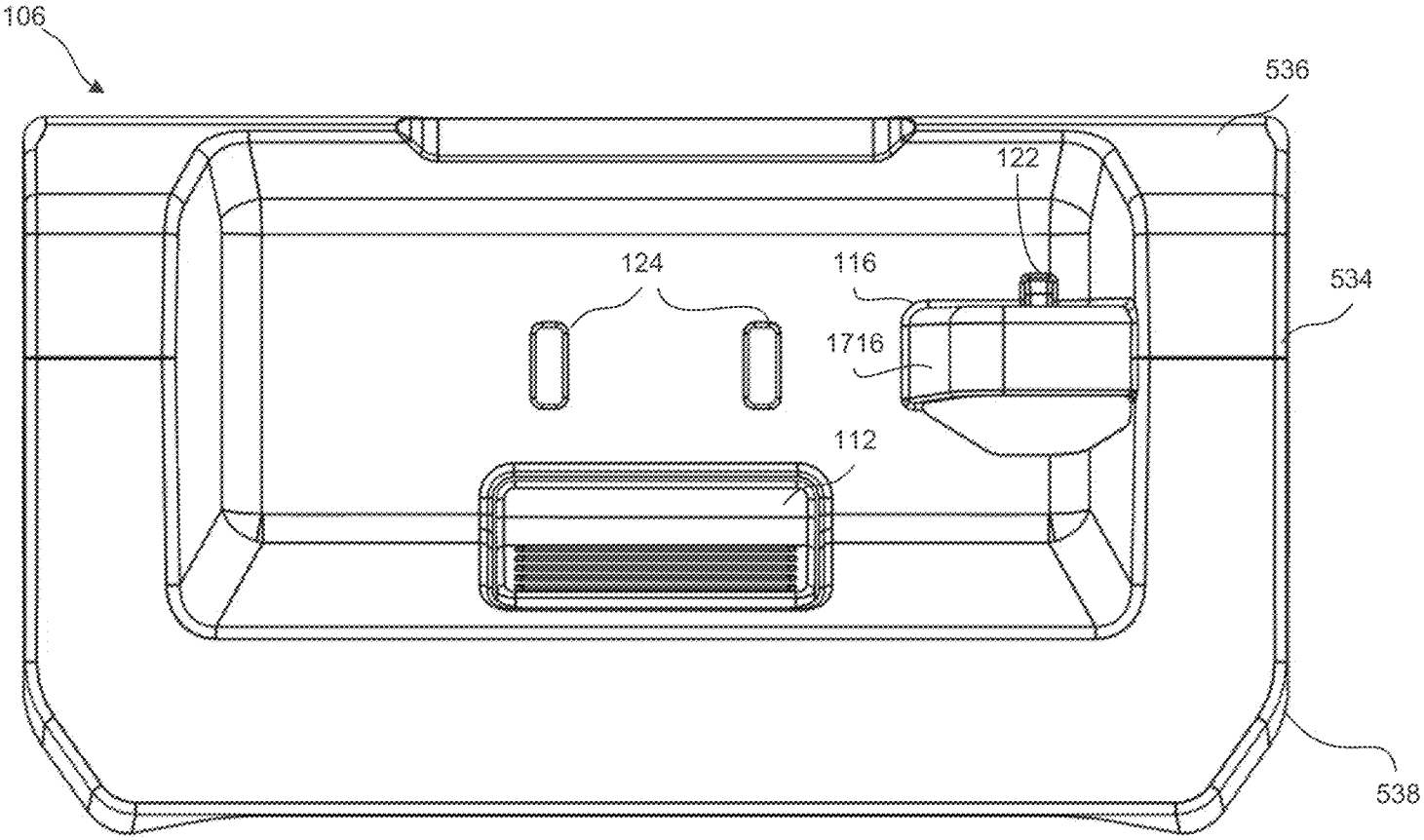
FIG. 17 shows a front close-up view of a portion of the lockable case, such as the lockable case shown in FIG. 16, in accordance with various aspects of the disclosure.

FIG. 16 shows a top close-up view of a portion of case 100 including latch 106 (e.g., latch 106 on the left side of case 100 as shown in FIG. 2). Similarly, FIG. 17 shows a front close-up view of the portion of case 100 shown in FIG. 16. As can be seen in FIGS. 16 and 17, latch 106 is configured to enable a user to readily access the button 112 and passthrough feature 116 from the front (i.e., latch side) of the lockable case 100, where the button 112 and passthrough feature 116 are integrated into latch 106 and configured to cooperate with a protrusion 1716 (including a hole (not visible) aligned with hole 122), in the illustrated embodiment. Further, passthrough feature 116 and hole 122 are configured such that, when a locking mechanism such as a padlock, key lock, zip-tie, wire, or cable is inserted into the hole 122 of the passthrough feature 116, and thus the corresponding hole (not visible from this angle) in protrusion 1716, the locking mechanism prevents latch 106 from being opened. That is, while latch 106 and optional button 112 serve to mechanically engage the base 102 with the lid 104, the addition of another locking mechanism (e.g., a zip-tie) into hole 122 of passthrough feature 116 adds an additional layer of protection by preventing disengagement of the latch 106 and/or button 112 such that case 100 may not be easily opened.

Figure 18:
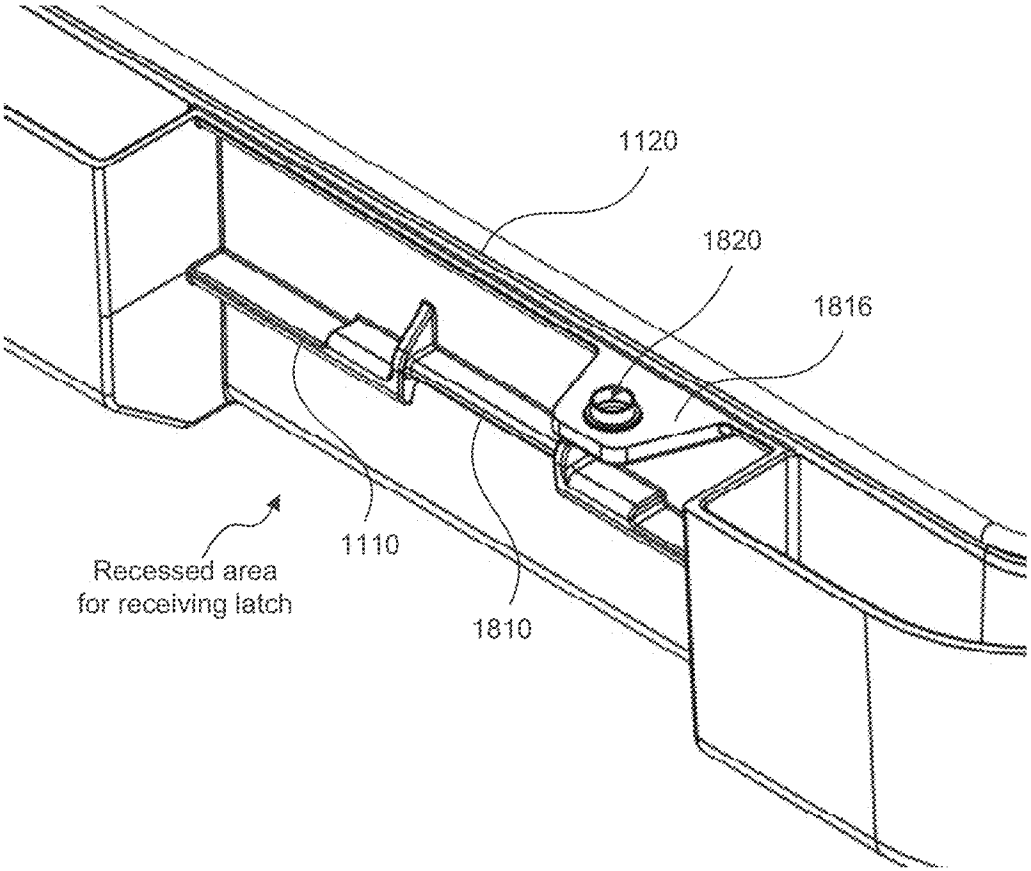
FIG. 18 depicts a front perspective view of a latch recess in a base of a lockable case, where at least a portion of the latch recess is configured to interface with or cooperate with a latch coupled to a lid of the lockable case, in accordance with various aspects of the disclosure.

FIG. 18 shows a front, top, perspective view (1800) of a recessed area 1818 (or simply, recess 1818) in base 102 of the lockable case 100, where the recessed area is configured to cooperate with and receive at least a portion of the latch 106 (not shown in FIG. 18), in accordance with certain embodiments. For example, the recess 1818 may be shaped and sized to receive at least a portion of the latch upon closure of the case, i.e., by rotating the latch such that the bottom end or protrusion interfaces with a protruding edge of the base 102, described in further detail below.

In particular, FIG. 18 shows an exemplary configuration of various features (e.g., shelf 1110 and protruding edge 1120 of FIG. 11) that are configured cooperate with the one or more protrusions (e.g., protrusions 950, 952, 542 shown in FIG. 9) of the latch 106. In some embodiments, the recessed area 1818 of the base may further comprise a lip 1810, where the lip 1810 may be configured to cooperate with the hook 954 of the button 112. Specifically, but without limitation, the hook 954 and lip 1810 may be shaped and sized in a manner that enables the hook 954 to latch (or clamp) onto the lip 1810, according to one or more embodiments of the present disclosure. Further, FIG. 18 shows a feature 1816 (e.g., a substantially flat horizontal surface that is perpendicular or orthogonal to the vertical side walls of the case 100) and a hole 1820 for cooperating with corresponding features in the latch 106, which enables the use of a locking mechanism (e.g., padlock, key lock, zip-tie, wire, or cable) therein to prevent disengagement of latch 106 from the base 102 (i.e., to assist in maintaining the case 100 in a closed position).

Figure 19:
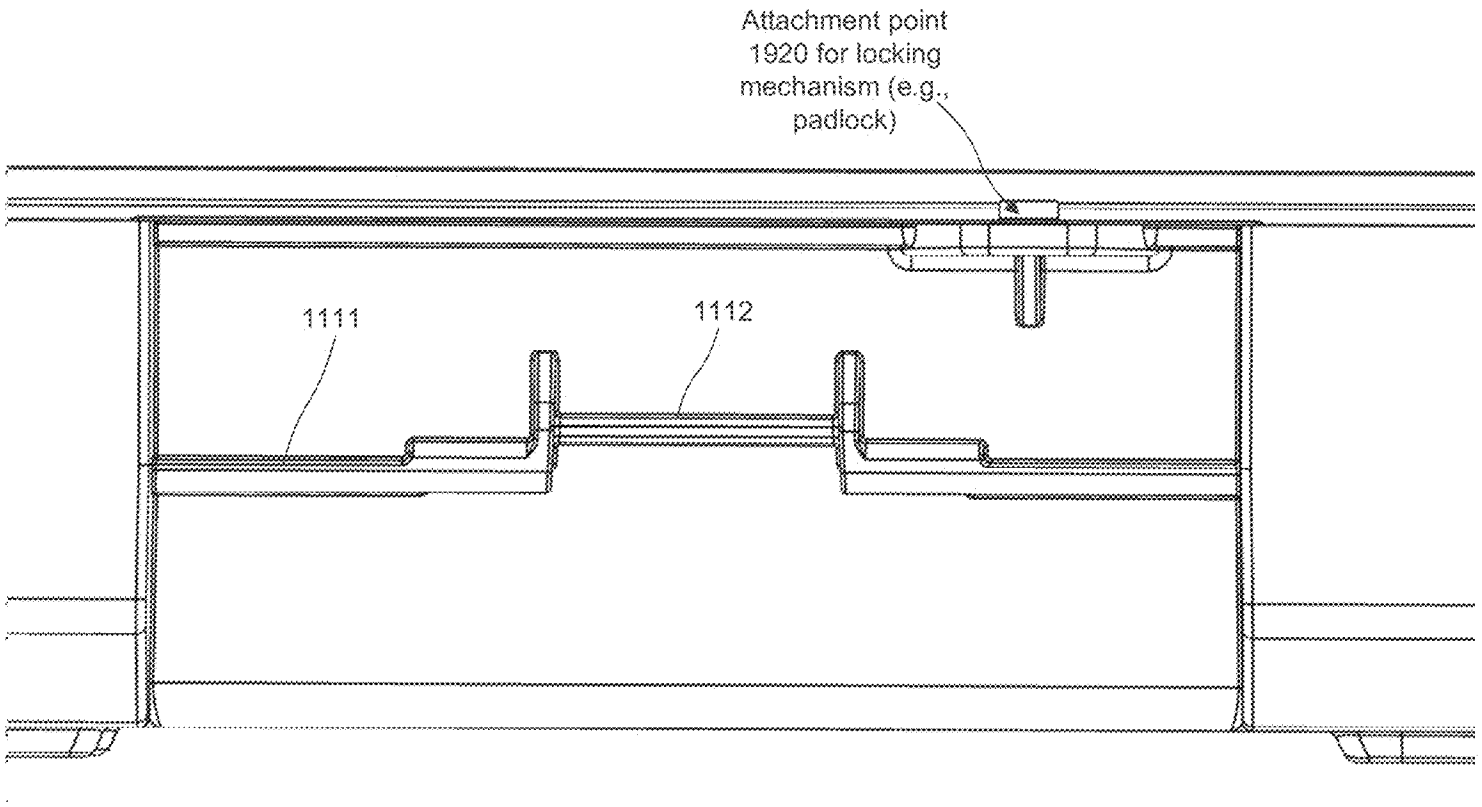
FIG. 19 shows a front view of another portion of the base illustrated in FIG. 18, depicting an alternative configuration of an attachment point for a locking mechanism of the lockable case, according to various aspects of the disclosure.

FIG. 19 shows a front view (1900) of a similar portion of the base 102 as illustrated in FIG. 18, showing an exemplary configuration of an attachment point 1920 formed into the base 102 for interfacing with a locking mechanism (e.g., padlock, keylock, chain lock, or any other applicable locking mechanism). It should be noted that other configurations of attachment points 1920 may be contemplated in different embodiments, and the examples listed herein are not intended to limit the scope and/or spirit of the present disclosure. In other words, other configurations of attachment points 1920 and/or locking mechanisms not discussed herein, included existing ones and other mechanisms contemplated in the future, may be considered part of the present disclosure.

As seen, FIG. 19 also depicts the shelf 1110 and the lip 1810 in the recessed area (e.g., recess 1818) and described above in relation to FIG. 18, in accordance with various aspects of the disclosure.

FIGS. 20A through 21B illustrate optional internal features that can be implemented within the lockable case 100, according to various aspects of the disclosure. For instance, one or more case organizers 2002 with interlocking edges and grooves 2006 may be used within the case 100. In some cases, the lockable case 100 may include internal ribs 2072 for interfacing with the case organizers 2002 to ensure secure retention of the case organizers 2002 within the case 100. For instance, internal ribs 2072 may provide frictional forces to retain an internal organization system within the case 100, especially when the case organizer 2002 is made of a malleable material such as an open cell foam. While FIGS. 20A and 20B only depict internal ribs 2072 within the base 102, it should be noted that this is not intended to be limiting. In fact, such internal ribs 2072 may be positioned inside the base 102 and/or the lid 104, in some embodiments.

Figure 20A:
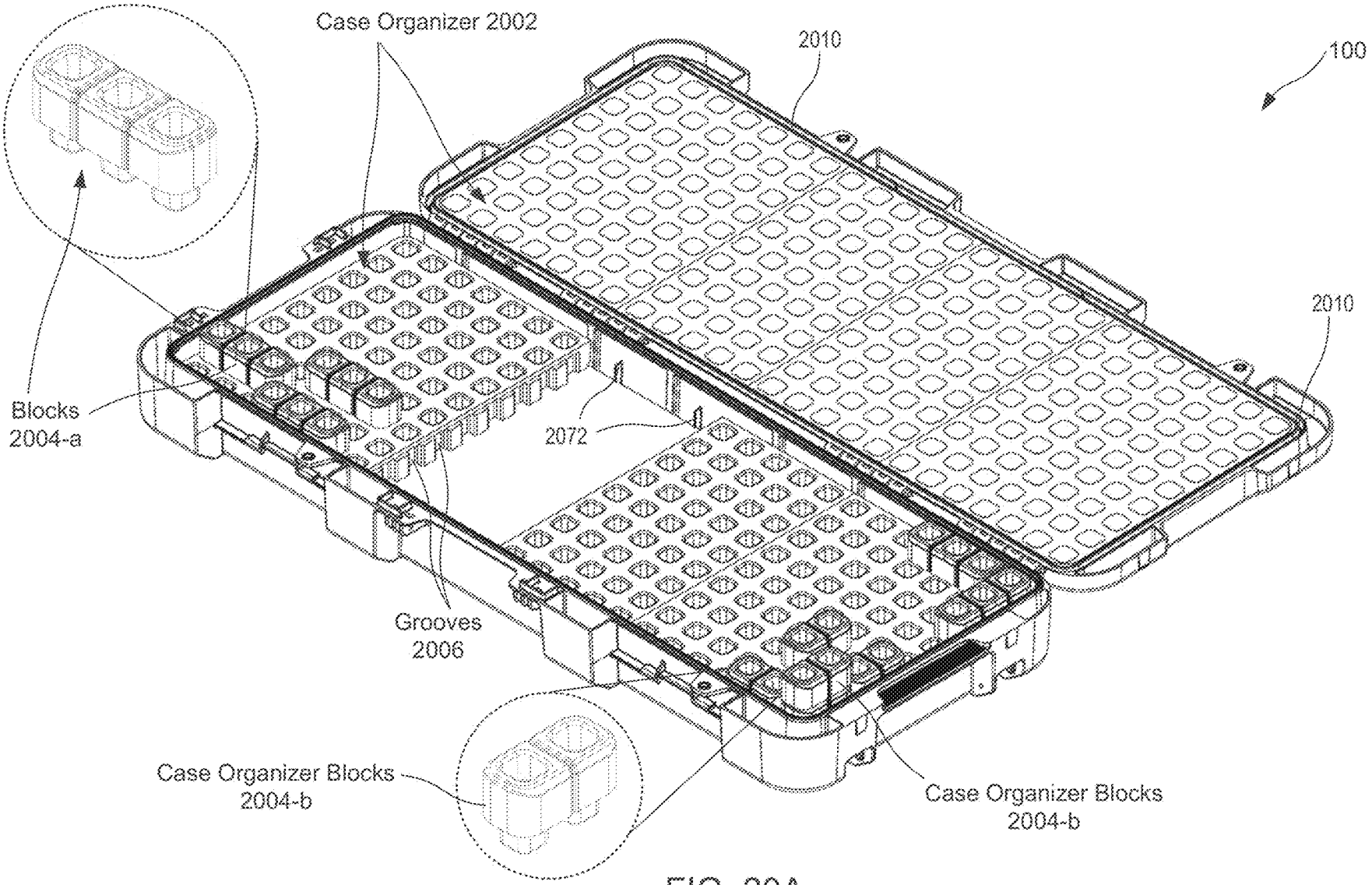
FIGS. 20A, 20B, 21A, and 21B illustrate an interior portion of a lockable case and depict a plurality of case organizers, case organizer blocks, and ribs along the perimeter of the lid and/or base of the lockable case to hold the case organizers in place, in accordance with various aspects of the disclosure.
Figure 20B:
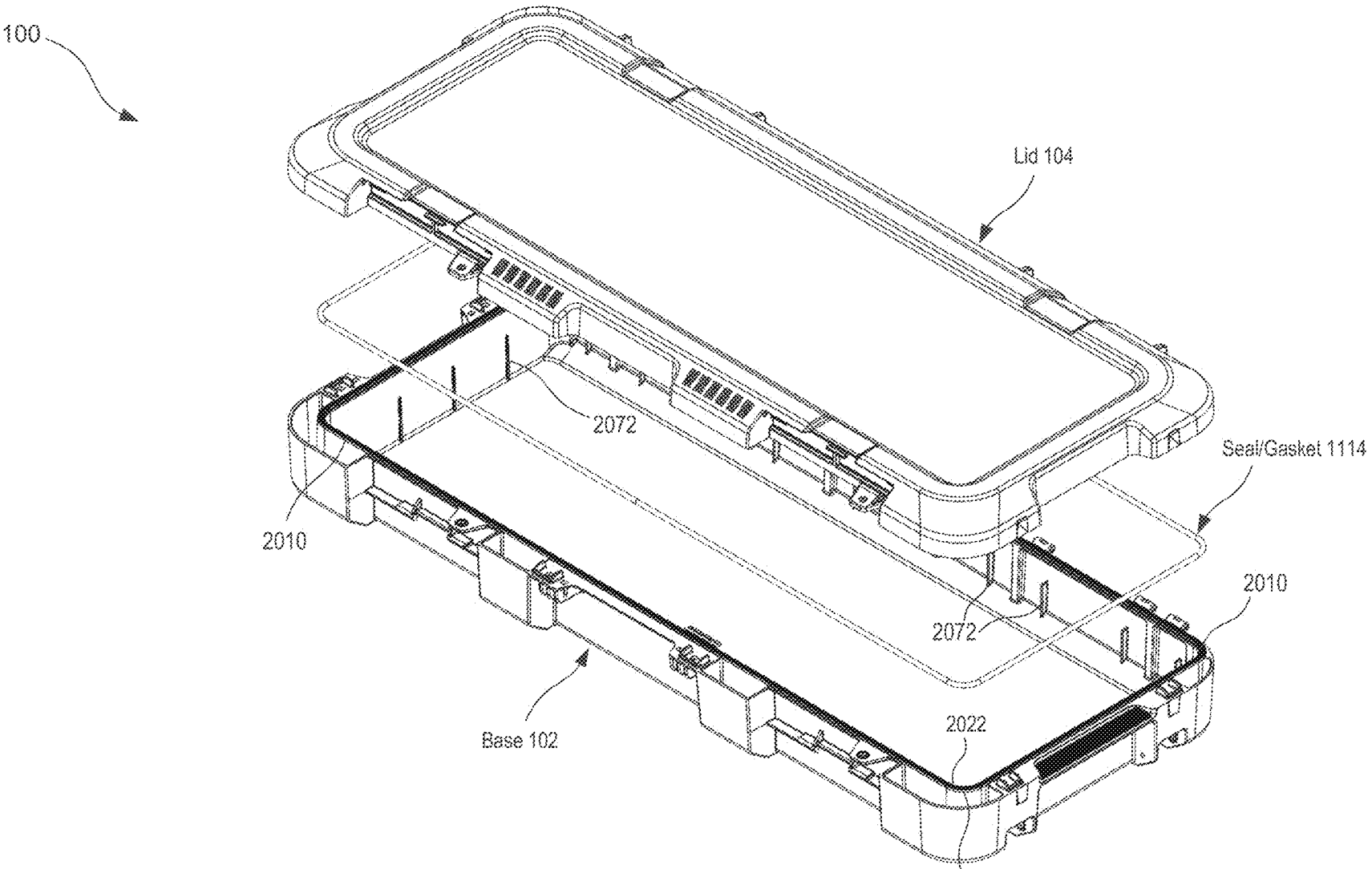

In some instances, case organizers 2002 may be configured as reconfigurable, modular components, and may include a grid of one or more through-holes (or depressions that do not go all the way through) for receiving one or more case organizer blocks therein. For example, FIG. 20A shows a plurality of case organizer blocks 2004-*a* (i.e., 3×1 case organizer blocks) and a plurality of case organizer blocks 2004-*b* (i.e., 2×1 case organizer blocks). Other sizes and/or variations of case organizer blocks, including 1×1 blocks or even larger blocks, such as 5×1 or 7×1 case organizer blocks are contemplated in different embodiments.

FIG. 20A also depicts a channel 2010 surrounding a perimeter of the lid, where the channel may be configured to receive a weather-resistant seal, further described below in relation to FIGS. 32A through 32E. FIG. 20 B shows an exploded view of the case 100, showing the lid 104, the base 102, a plurality of internal ribs 2072 for interfacing with the case organizers (not shown), an inner wall 2022, an outer wall 2021, a channel 2010 formed between the inner and outer walls 2022 and 2021, respectively, and a seal or gasket 1114 positioned within the channel 2010, further described below in relation to FIGS. 32A through 32E below. In this example, a single channel 2010 along the perimeter of the base is visible, however, in other embodiments, the lid 104 may also include a channel encircling the perimeter of the lid.

Figure 21A:
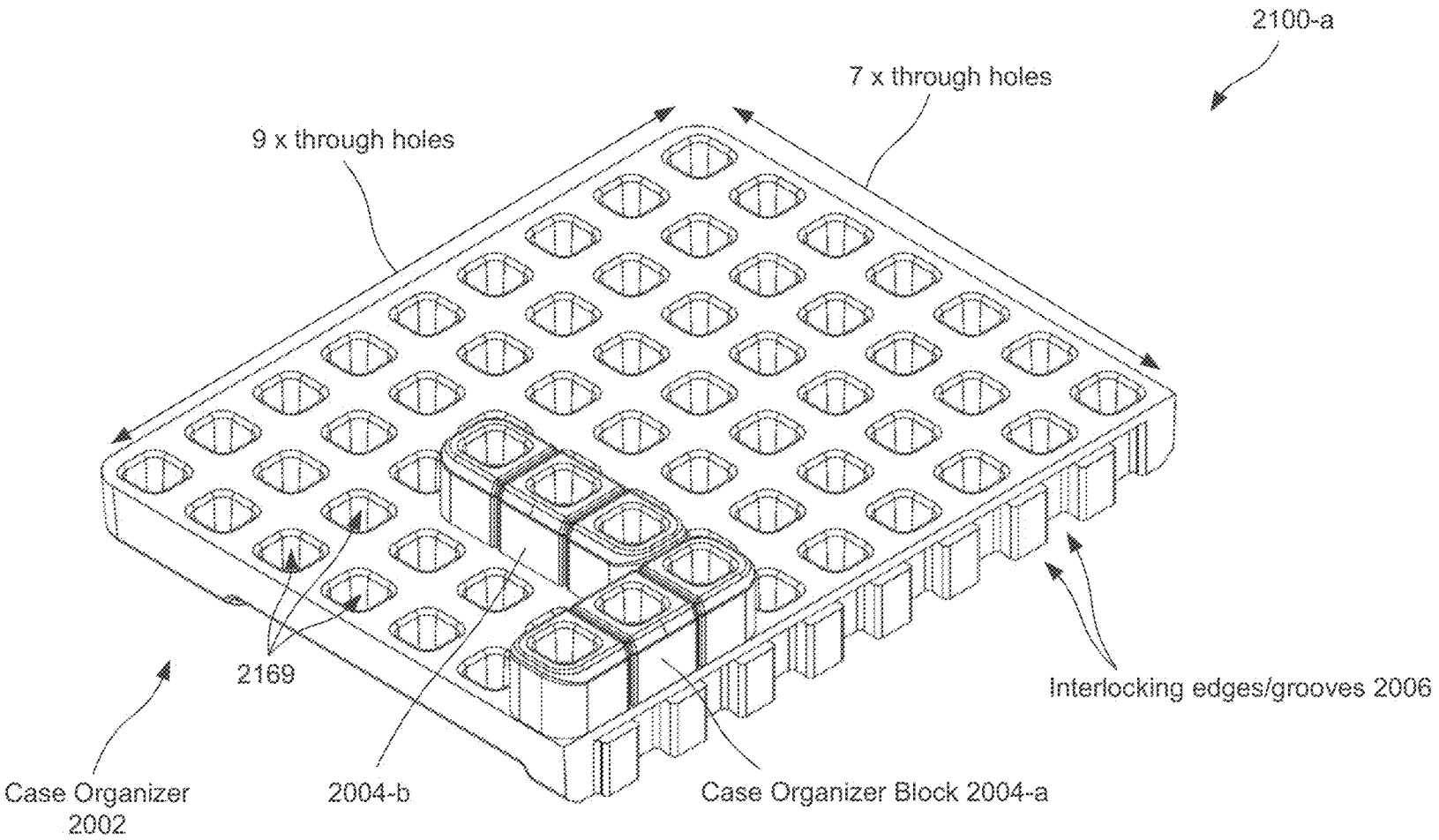
Figure 21B:
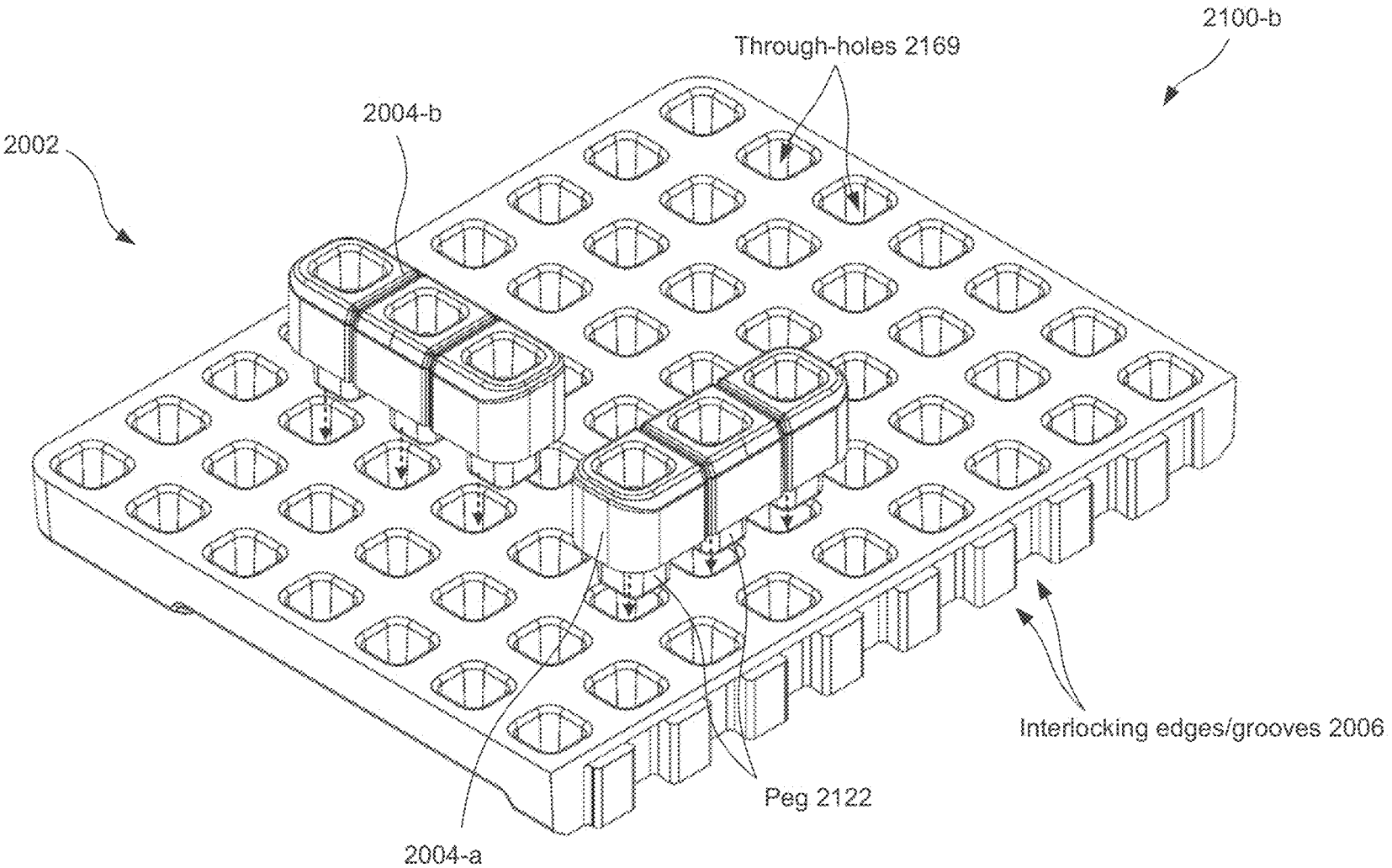

Turning now to FIG. 21A, which shows a detailed view (2100-*a*) of a case organizer 2002, according to various aspects of the disclosure. In this example, the case organizer 2002 comprises a plurality of interlocking edges/grooves 2006 for coupling with another case organizer (not shown), a plurality of through-holes 2269 arranged in a grid pattern, as well as a plurality of case organizer blocks 2004 positioned within the through holes. In the example shown in FIG. 21A, two case organizer blocks 2004-*a*, 2004-*b* are shown, where each case organizer block is a 3×1 case organizer block. These blocks may be arranged around items placed within the case (such as firearms, firearm accessories, musical instruments, scientific equipment, photography equipment, etc.) to prevent these items from shifting within the case during transport, in certain embodiments. As seen in the perspective view (2100-*b*) of another case organizer 2002 in FIG. 21B, each case organizer block 2004-*a*, 2004-*b* may include one or more pegs 2122, where each peg 2122 is configured to enter and form a friction fit within one of the through-holes or depressions 2169 in the case organizer 2002. In some embodiments, the case organizer, such as case organizer 2002, may be formed from modular panels of the same or different sizes and configurations allowing customization of the storage solution for a given case and between different sizes and shapes of cases. For example, the case organizers shown in FIGS. 21A and 21B have nine (9) through holes in the horizontal direction and seven (7) through holes in the vertical direction. In other cases, a case organizer may have the same number of through holes (e.g., 6 through holes in each direction) or may be longer than it is wider (e.g., 4 through holes in the vertical direction and 2 through holes in the horizontal direction).

Figure 22:
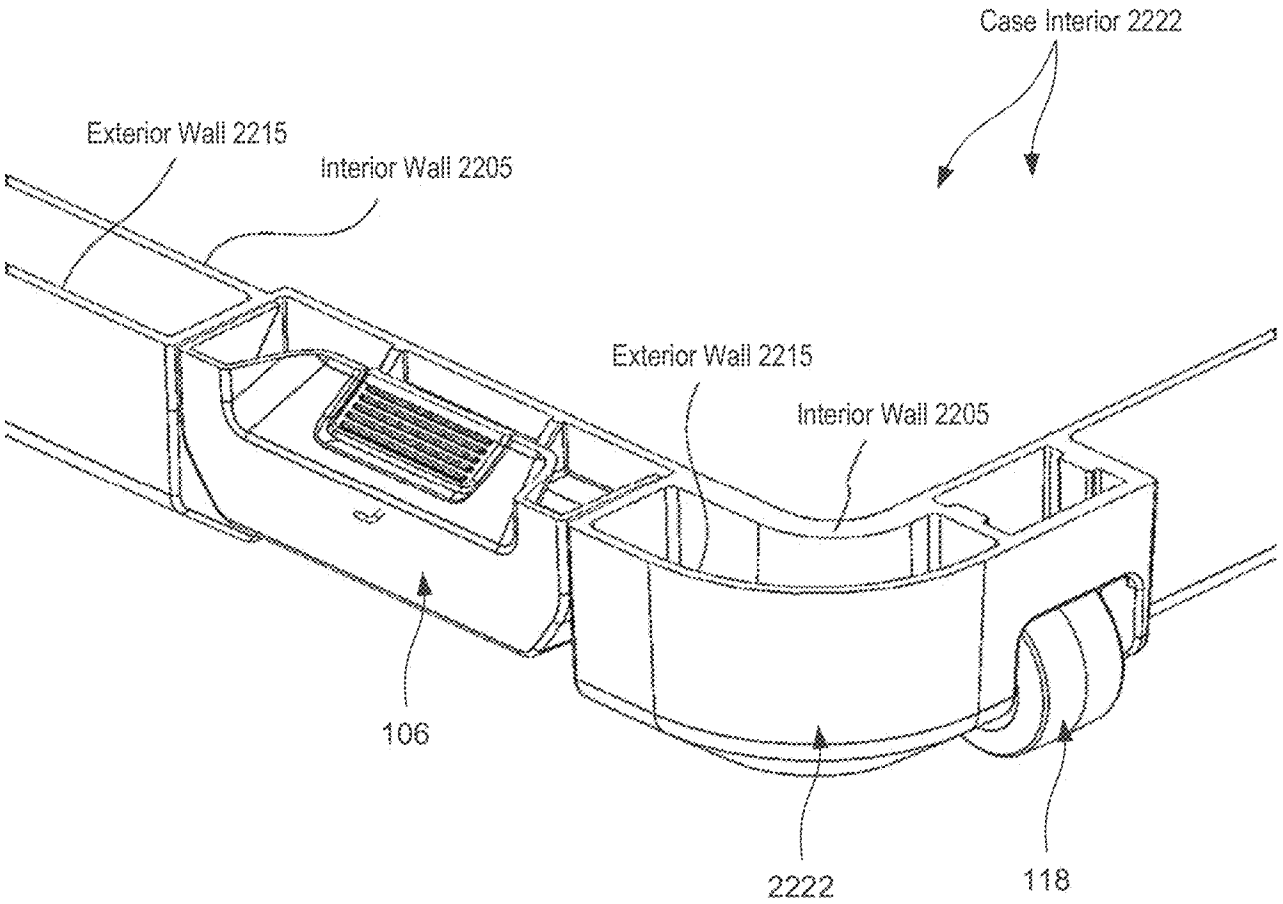
FIG. 22 illustrates a detailed view of a lockable case having a double wall design, including an interior wall and an exterior wall, where the interior and exterior walls can be separated by a channel, according to various aspects of the disclosure.

FIG. 22 illustrates a detailed view (2200) of a corner section of a base 102 of a lockable case 100, according to various aspects of the disclosure. In some embodiments, certain portions of the case 100, such as at the case corners 2222, areas between latches 106, and the portion into which the wheel 118 is recessed, may be formed of a double-wall construction, including an interior wall 2205 and an exterior wall 2215, as shown in FIG. 22 for example. The double-wall construction allows the overall case 100 to have a streamlined profile, with components such as the latches 106, the wheels 118, and the handles to be contained within the overall profile of the case 100 and, optionally, to add structural strength to the case 100 in specific areas.

Figure 23:
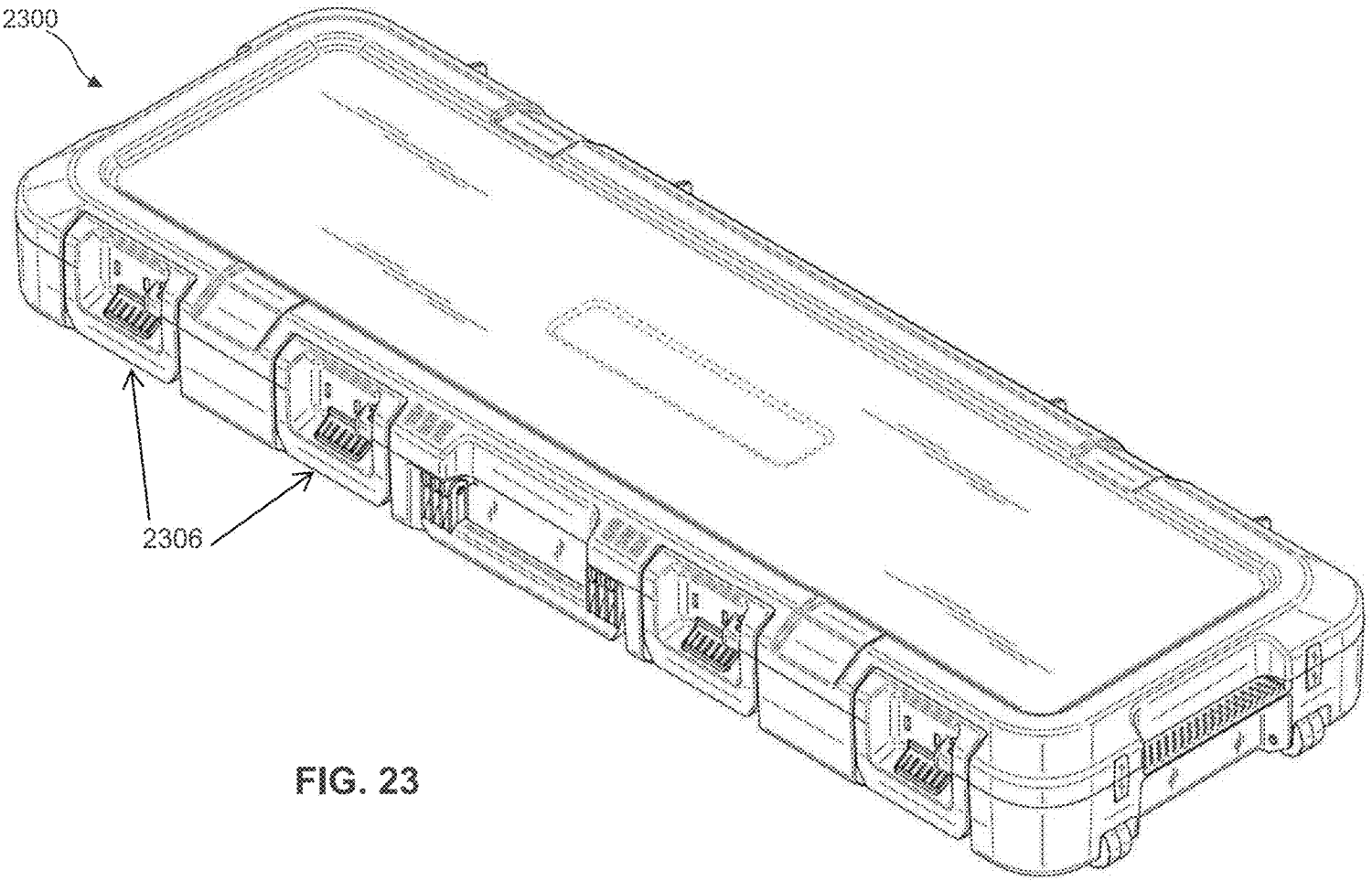
FIGS. 23 and 24 show alternative implementations of a lockable case, such as a firearm case, according to various aspects of the disclosure.
Figure 24:
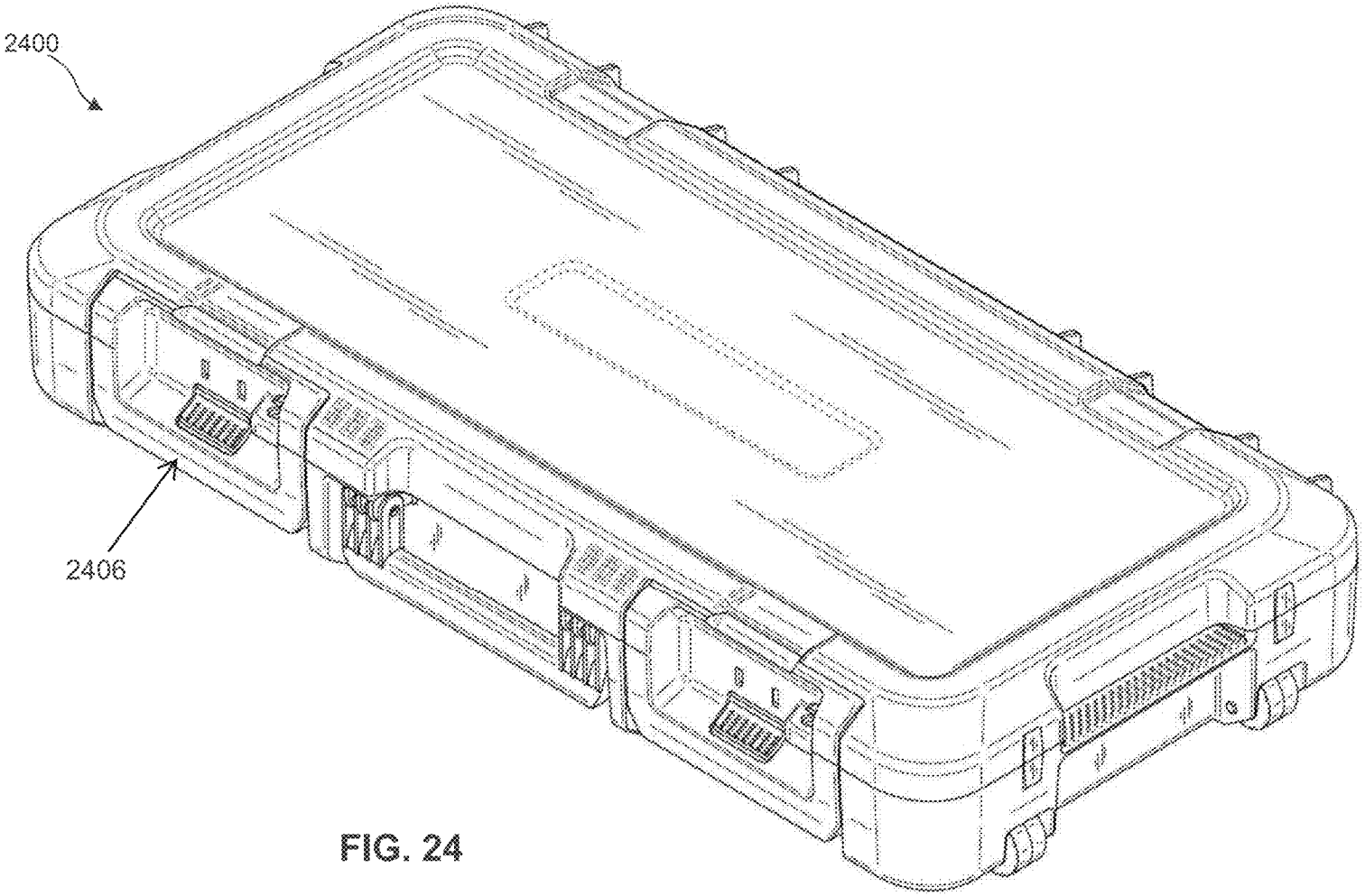

FIGS. 23 and 24 illustrate alternative embodiments of cases, in accordance with certain aspects of the present disclosure. As an example, case 2300 of FIG. 23 includes four latches 2306, which are shorter in width than the latches 106 described above. Such an implementation may be advantageous, for example, when the additional security of having more than two lockable latches is desirable despite the smaller latch size, or where a longer case benefits from a greater number of latches. Similarly, case 2400 of FIG. 24 includes a shorter case body compared to case 100 described above, while keeping the various features of case 100, such as the large, securable latches, low profile handles, etc. The smaller case dimensions of case 2400 may be useful for the storage and transport of smaller items, such as handguns or photography equipment. Despite the shorter dimensions of case 2400, the latches therein may have a longer dimension than those used in the longer case 2300. As discussed above, the exact dimensions, number, material composition, and placement of the latches may be modified according to the specific requirements of the case. For example, in certain embodiments, the latches may be selected, for example, for their size, and thereby their ability to accommodate a locking mechanism, such as a padlock, within the latch recess. In other cases, the size of one or more of the latches used with a particular case may be selected for their compatibility with a specific type of locking mechanism, such as a large profile padlock, a keypad, or other locking apparatus required for a specific use. For instance, certain embodiments may require the integration of a particular type of a lock (e.g., an electronic or biometric lock) that may need to be protected from impact damage during transport. Other modifications known and/or contemplated in the art may be utilized in different embodiments and are considered a part of the present disclosure.

Figure 25:
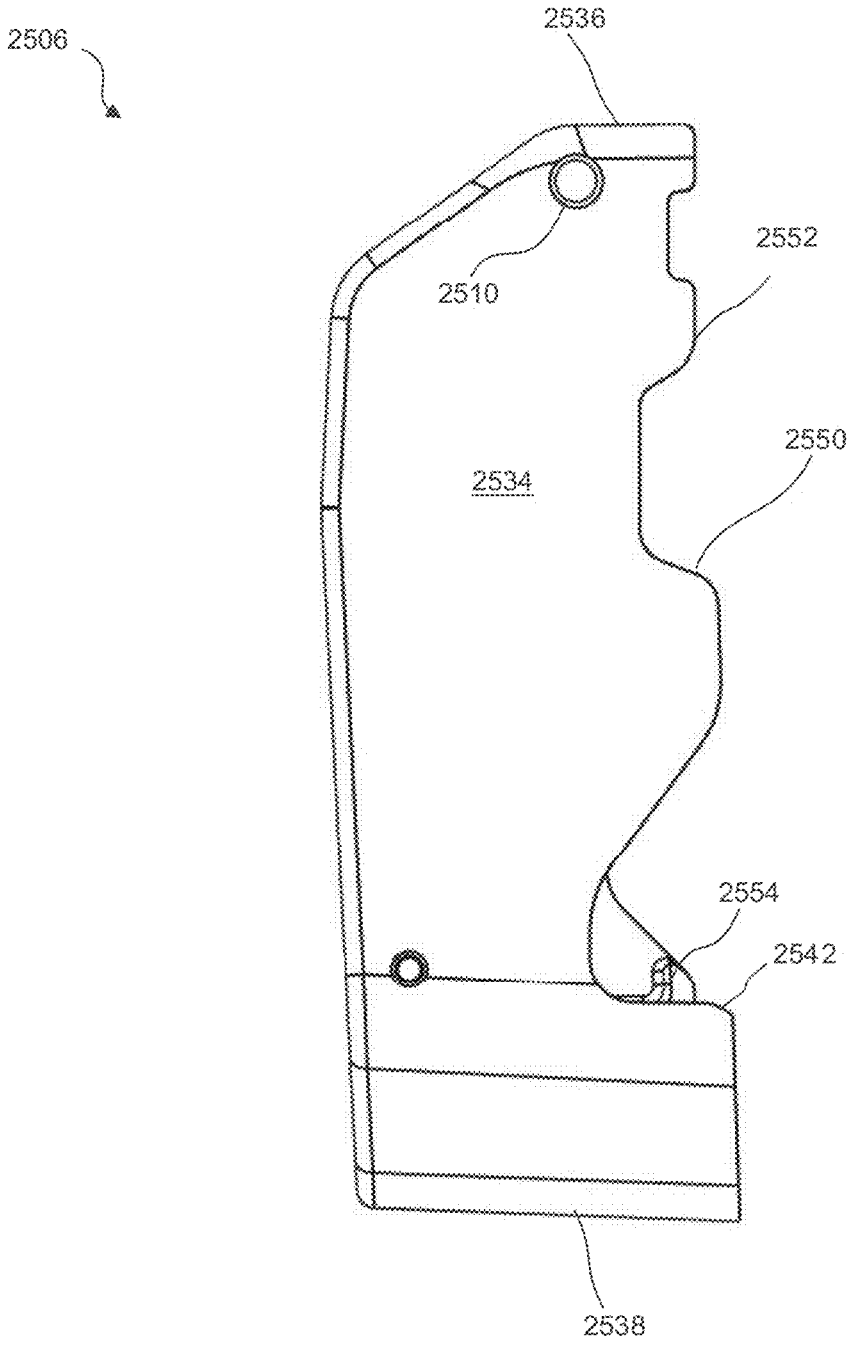
FIG. 25 shows a side view of an alternative configuration of a latch, in isolation, according to various aspects of the disclosure.
Figure 26:
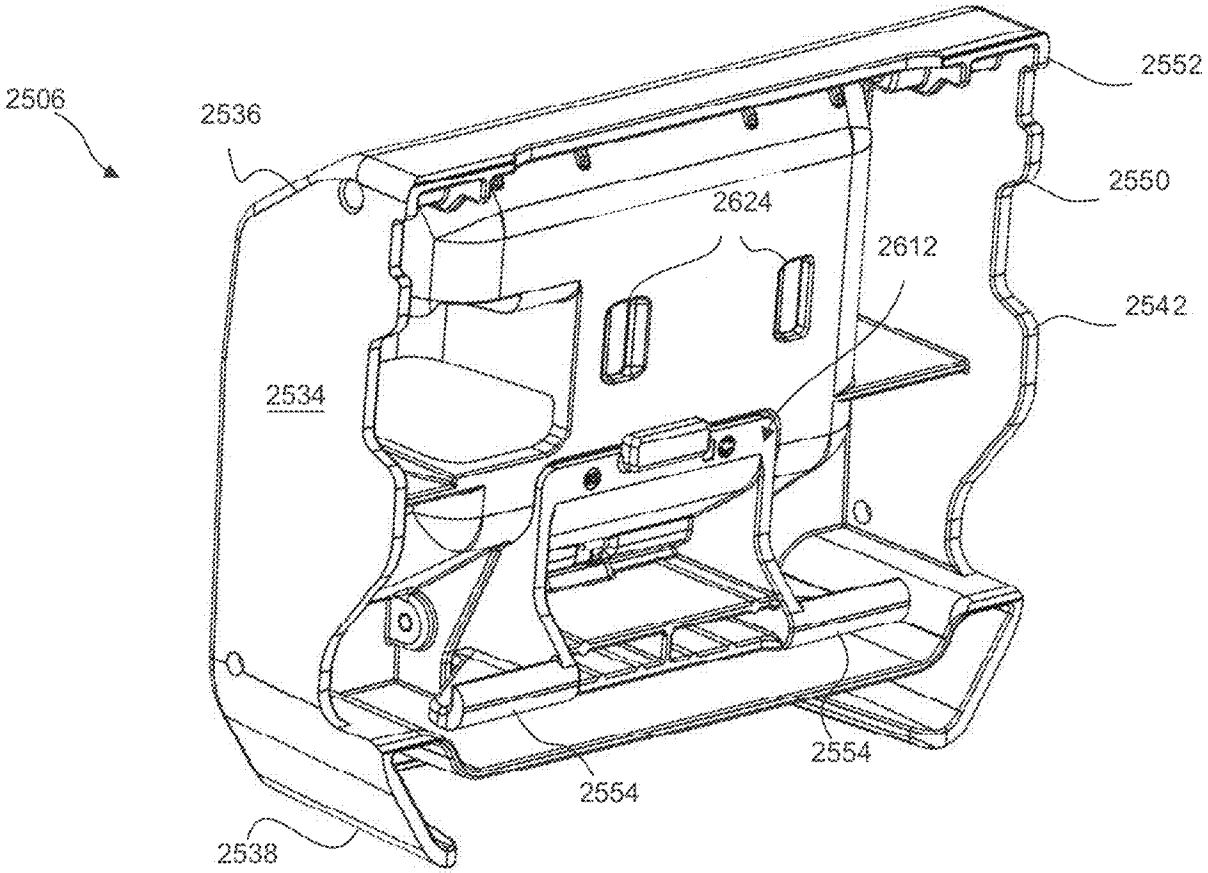
FIG. 26 illustrates a rear perspective view of the latch of FIG. 25, in isolation, in accordance with various aspects of the disclosure.

An alternative latch profile to that seen in FIGS. 9 and 10 can be seen in FIGS. 25 and 26. In particular, FIG. 25 shows a side view (2500) of an alternative configuration of a latch 2506 in isolation, in accordance with one or more implementations. As shown in FIG. 25, latch 2506 includes a hole 2510 for receiving a pin (not shown), about which pin latch 2506 rotates. In some embodiments, the pin received in hole 2510 may implement one or more aspects of the pin 852 described above in relation to FIGS. 8 and/or 9. Furthermore, the latch 2506 includes a latch body 2534 with a first end 2536 and a second, opposing end 2538. In some examples, the latch body 2534 comprises a plurality of protrusions 2542, 2550, and 2552 that may be configured for engaging with cooperative features formed into the lid 104 and/or base 102 of the case 100 when assembled. As shown in FIG. 25, the latch 2506 may further include a hook 2554, where the hook 2554 may form a part of a button (not visible in FIG. 25). In some aspects, the hook 2554 may implement one or more aspects of the hook 954 described above in relation to FIG. 14. Additionally, or alternatively, the button described in relation to FIG. 25 may be similar or substantially similar to the button 112 described herein. In some examples, the latch 2506 operates similarly or substantially similar to latch 106, described herein and elsewhere throughout the disclosure.

Further, FIG. 26 illustrates a rear perspective view of latch 2506 of FIG. 25, in isolation, in accordance with one or more implementations of the illustrated embodiments. The rear side of a button 2612, including hooks 2554, is visible in FIG. 26. Hooks 2554 may operate in a similar manner to hooks 954 of button 112, described in detail above. Latch 2506 also includes slotted holes 2624, similar to slotted holes 124 of case 100, for accommodating a zip-tie, cable, wire, or similar component for providing a further measure for preventing unintentional disengagement of latch 2506.

Figure 27:
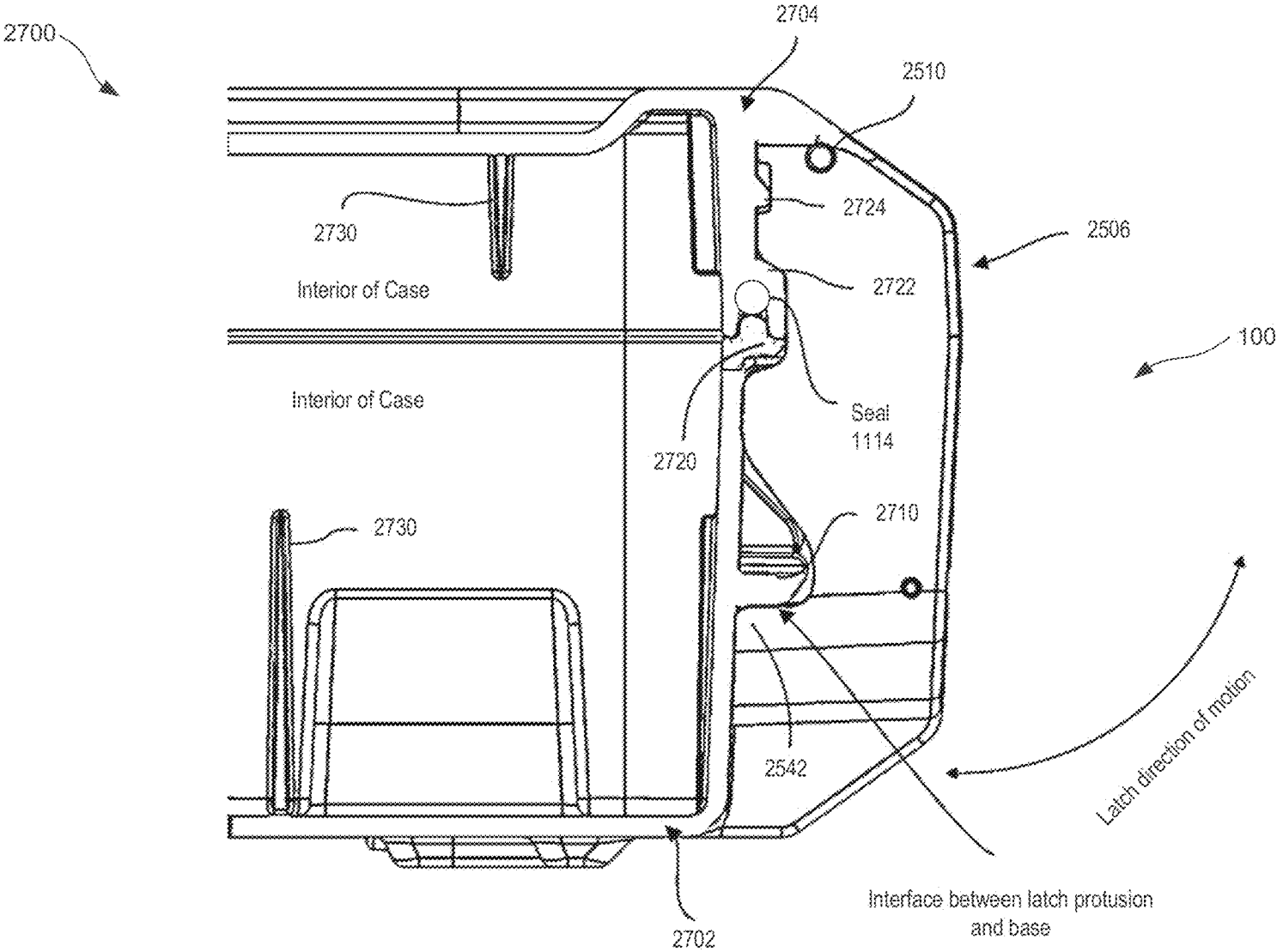
FIG. 27 depicts a side, partial cross-sectional view of the assembled lockable case, including a side view of the latch of FIG. 25, shown here to illustrate the operations of the engagement and disengagement of the latch, in accordance with various aspects of the disclosure.

FIG. 27 depicts a side, partial cross-sectional view (2700) of the assembled case 100 with a side view of the latch 2506 of FIG. 25, shown here to illustrate the operations of the engagement and disengagement of latch 2506, in accordance with an embodiment of the present disclosure. In a manner similar to the operations of latch 106 described in FIG. 11, FIG. 27 shows the latch 2506 engaging with a base 2702 and lid 2704. Base 2702 includes a shelf 2710 to define an interface between latch protrusion 2542 and the base 2702. Additionally, or alternatively, latch protrusion 2542 is configured to cooperate with the shelf 2710 to engage the latch 2506 with the base 2702, e.g., by a friction fit or snap fit, for example. This interface may also serve to provide a compressive force between base 2702 and lid 2704 to compress gasket 1114 therebetween, which helps provide a weather-resistant seal for the case 100. In other ways, compression of the gasket 1114 between the base 2702 and lid 2704 can help in one or more of pressure equalization (i.e., between the interior pressure of the case 100, and the external pressure outside the case) and moisture/humidity control (i.e., preventing water or humid air from entering the internal portion of the case). In some embodiments, an additional protruding edge 2720 on the base 2702 and/or another protruding edge 2722 on the lid 2704 may contribute in keeping the gasket 1114 trapped between the base 2702 and the lid 2704 by compressive forces. Optionally, lid 2704 may further include an additional protruding edge 2724, which may be configured to separately engage with the latch 2506, as will be described in detail relative to FIG. 29 below.

FIG. 27 also shows internal rib features 2730 in the base 2702 and/or the lid 2704, which may be useful in providing structural stability to the case 100 and/or provide additional functionality in the retention of mechanisms such as padding or case organizers, previously described above with respect to FIGS. 20A through 21B.

Figure 28:
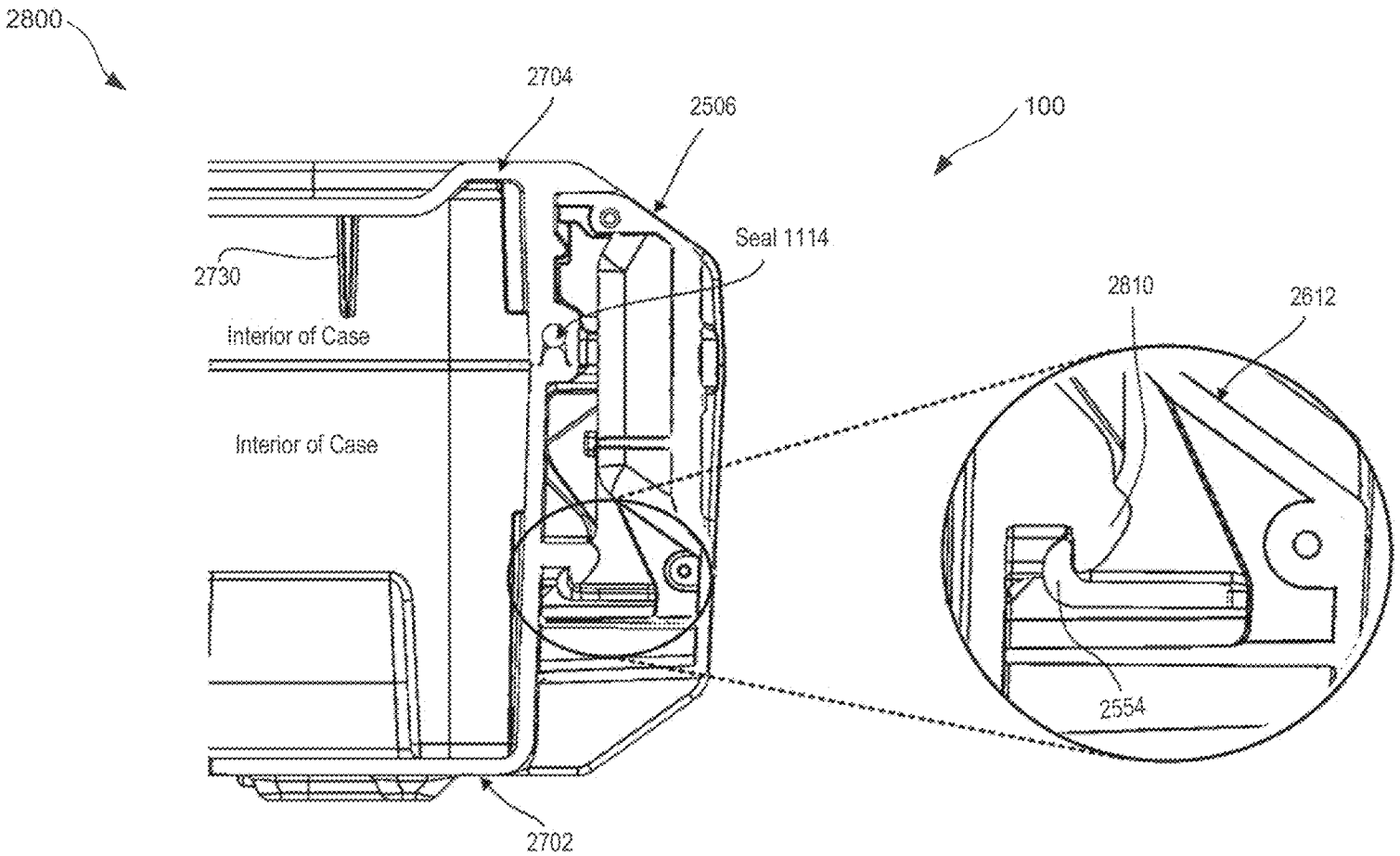
FIG. 28 depicts a side, partial cross-sectional view of the assembled case of FIG. 27, as well as a cross-sectional side view of the latch, in accordance with various aspects of the disclosure.

FIG. 28 depicts a side, partial cross-sectional view (2800) of the assembled case 100 of FIG. 27, this time including a cross-sectional side view of the latch 2506, in accordance with an embodiment. In particular, FIG. 28 shows the engagement of the hook 2554 of the button 2612 with a cooperating feature 2810, which may be formed as a part of the shelf 2710 of base 2702.

Figure 29:
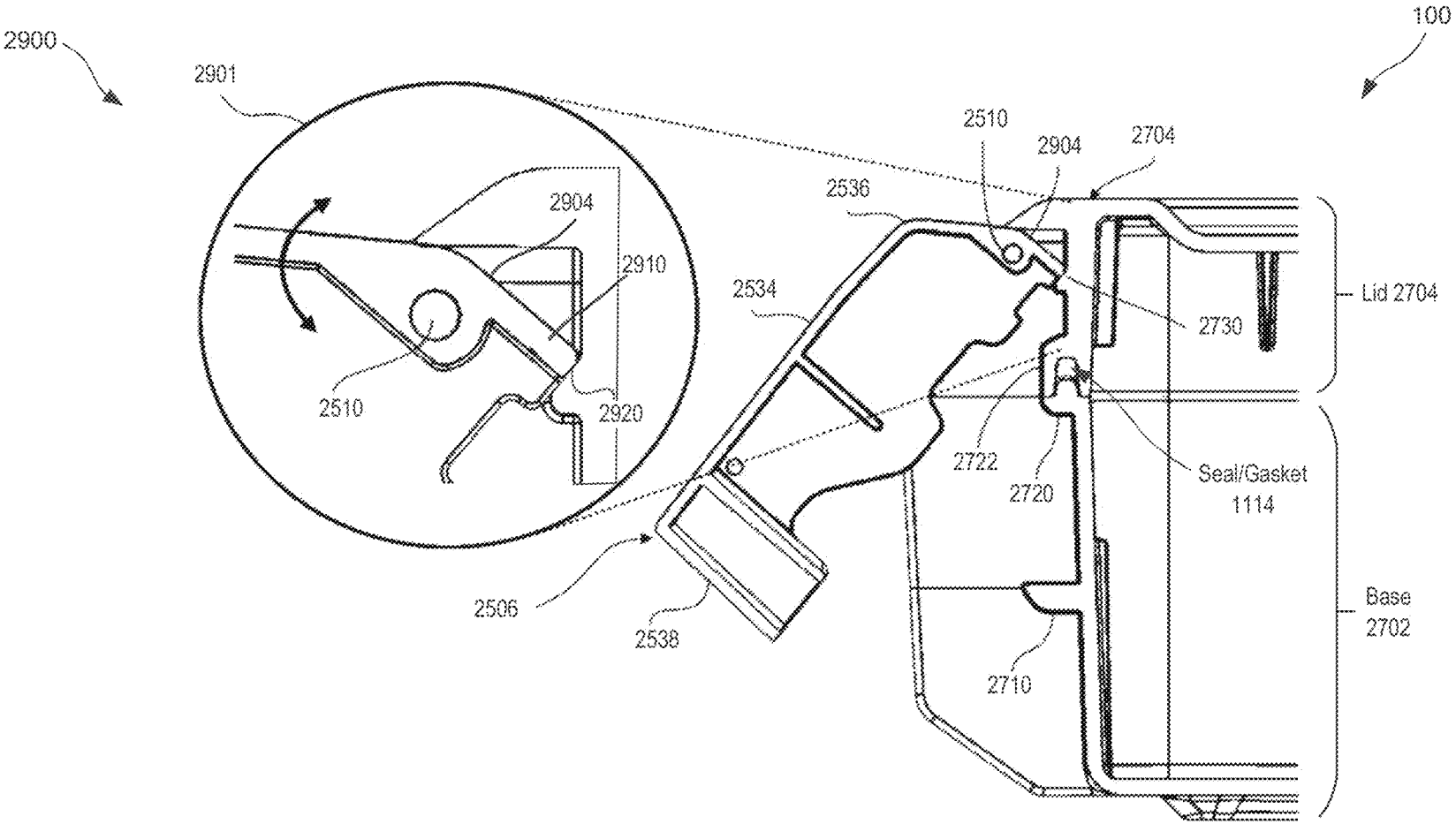
FIG. 29 illustrates another cross-sectional side view and an inset of a portion of the lockable case(s) of FIGS. 27 and/or 28, included here to illustrate a detent-open mechanism, in accordance with various aspects of the disclosure.

An alternative detent-open mechanism is shown in FIG. 29. More particularly, FIG. 29 illustrates another cross-sectional side view (2900) and an inset of a portion of the lockable case 100 of FIGS. 27 and 28, included here to illustrate a detent-open mechanism. Similar to the detent-open mechanism described with respect to FIG. 13 above, FIG. 29 illustrates an inset 2901 showing the engagement of a top portion 2904 of the latch 2506 with one or more cooperating features in the lid 2704. In particular, a tip 2910 of the latch 2506 may be configured to engage with a surface 2920, which forms a portion of protrusion 2730. This engagement of the tip 2910 and the surface 2920 is more clearly seen in inset 2901 in FIG. 29. In an example, surface 2920 may be shaped and sized to initially catch the tip 2910 when the latch 2506 is disengaged from the base 2702. Optionally, surface 2920 may be short enough such that, when sufficient additional upward force is applied to the latch 2506, the tip 2910 may be able to slip past surface 2920 and be opened further than shown in FIG. 29.

Figure 30:
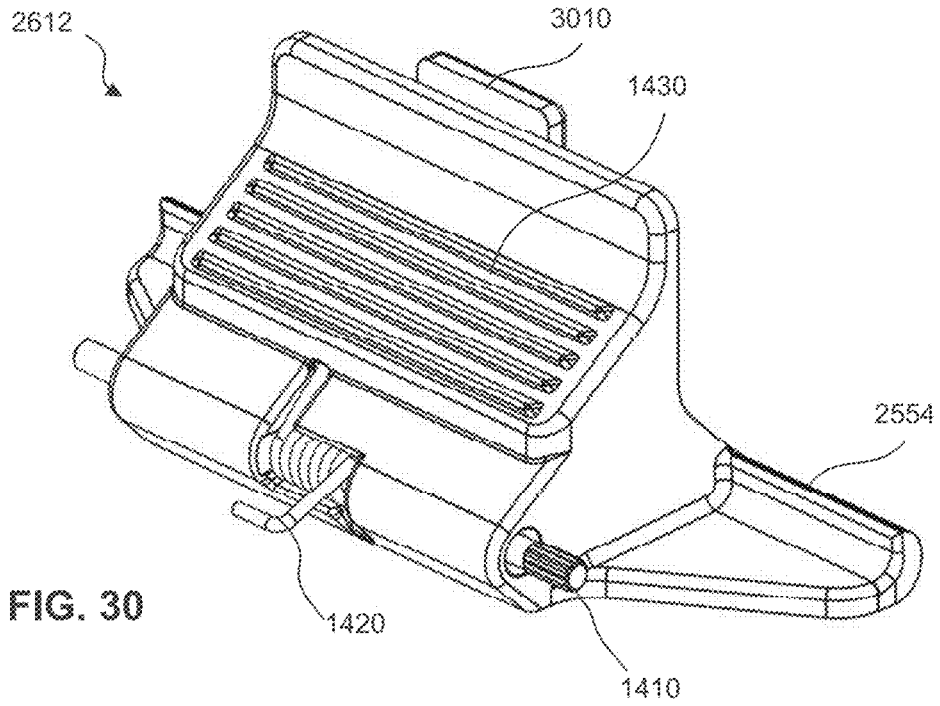
FIGS. 30 and 31 show front perspective and side views, respectively, of an alternative configuration of a button (in isolation) for use with any of the latches illustrated in the above figures, in accordance with various aspects of the disclosure.
Figure 31:
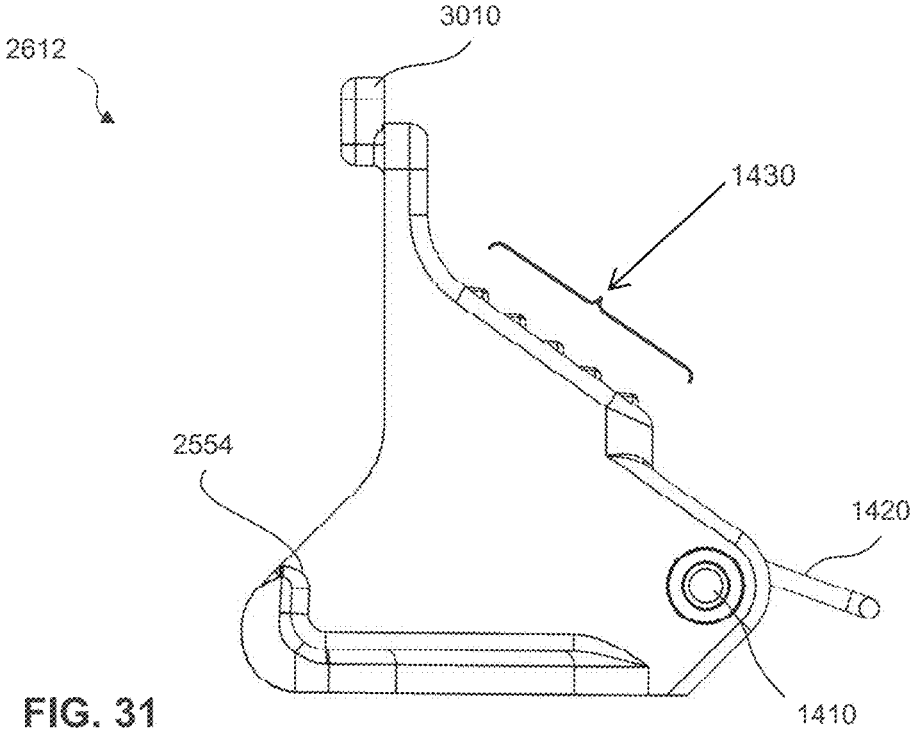

An alternative configuration of a button 2612 can be seen in FIGS. 30 and 31, in accordance with various aspects of the disclosure. FIGS. 30 and 31 show front perspective and side views, respectively, of button 2612 for use with the latch (e.g., latch 106, latch 2506) illustrated in the above figures, in accordance with an embodiment. It should be noted that the button 2612 illustrated in FIGS. 30 and/or 31 is shown in isolation (i.e., without other features of the latch, such as latch 2506, in which it may be installed). In addition to the various features of button 112 described above, button 2612 includes a tab 3010 for assisting with the retention of button 2612 in the appropriate position within latch 2506, in an embodiment. This helps secure the button 2612 within the latch, such as latch 2506, with minimal movement in undesired directions (e.g., lateral movement, tilting, front-rear movement).

While generally described in relation to firearms, it should be noted that the case 100 described herein may be utilized for transporting items other than firearms (e.g., rifles, pistols, and shotguns) and/or their accessories. For instance, musical, scientific, photographic, and technical equipment are just a few examples of other item types that may benefit from herein disclosed embodiments of storage and transport cases. Further, the case organizer(s) and/or case organizer blocks depicted in FIGS. 20A through 21B may be utilized with cases and containers other than the embodiments depicted herein. Similarly, embodiments of cases described herein may be utilized with any other type of case organizer known or contemplated in the art.

Figure 32A:
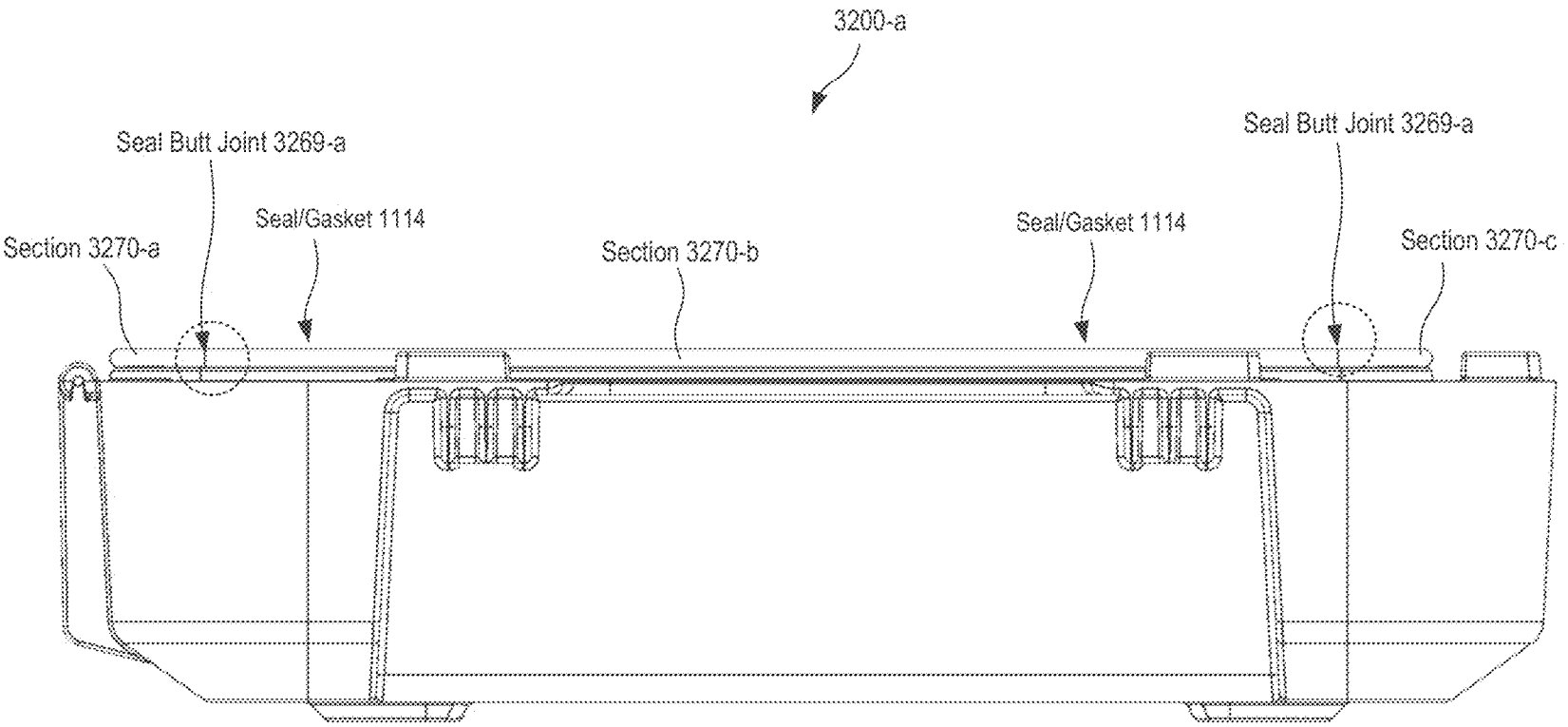
FIG. 32A depicts a side, cross-sectional view of the base of the lockable case, where a weather-resistant seal is installed over the upper or top perimeter of the base, such that it substantially encircles at least the inner perimeter of the case, in accordance with various aspects of the disclosure.

In some embodiments, and with reference to the example lockable cases, such as lockable case 100, described above, additional details on the gasket 1114 and/or weather-resistant seal are described below in relation to FIGS. 32A through 32C. As notd above, the disclosed lockable case (e.g., lockable firearm case 100) may employ a double wall design, such as the one described above in relation to FIGS. 20A-20B. Additionally, the double wall design may be configured with a channel, such as the channel 2010, therein. In some embodiments, the channel 2010 is fitted with a weather-resistant seal 1114 (also referred to as a gasket 1114, a seal 1114, or a seal/gasket 1114) within. For example, FIG. 32A illustrates an embodiment (3200-*a*) with the seal/gasket 1114 fitted within a channel (not shown). In some embodiments, the weather-resistant seal (i.e., seal/gasket 1114) is configured as one unitary piece that encircles the entire perimeter of case and is shaped and sized to within the channel 2010 (e.g., channel 2010 shown in FIG. 32B). In some other cases, the weather-resistant seal 1114 may be formed using multiple seal sections/pieces, where adjacent seal sections are joined or coupled together using one or more seal butt joints 3269 (e.g., seal butt joints 3269-*a*, 3269-*b*). For example, the seal/gasket 1114 includes a plurality of seal sections 3270-*a*, 3270-*b*, and 3270-*c*. Additionally, seal butt joint 3269-*a* is located where seal sections 3270-*a* and 3270-*b* butt against each other. Similarly, another seal butt joint 3269-*b* is positioned where seal sections 3270-*b* and 3270-*c* butt against each other.

These butt joints 3269 can be designed to vent, or allow some passage of air, at a given pressure differential between the inside and outside of the case. For instance, when a higher-pressure 'passive vent' is desired, two adjacent seal portions 3270 may be pressed tighter to each other forming a tighter butt joint. Alternatively, to allow pressure balancing at lower differentials, the butt joint(s) 3269 may be formed with the two adjacent seal portions (e.g., seal section 3270-*a*, 3270-*b*) touching but with little to no compression at the butt joint (e.g., seal butt joint 3269-*a*). In some embodiments, the seal/gasket 1114 is fixedly seated within the channel, such as channel 2010 in FIG. 32B, such that it cannot be removed. In other embodiments, the seal/gasket 1114 is removably seated within the channel 2010 so that it can be removed (e.g., for replacement with another seal or gasket).

Figure 32B:
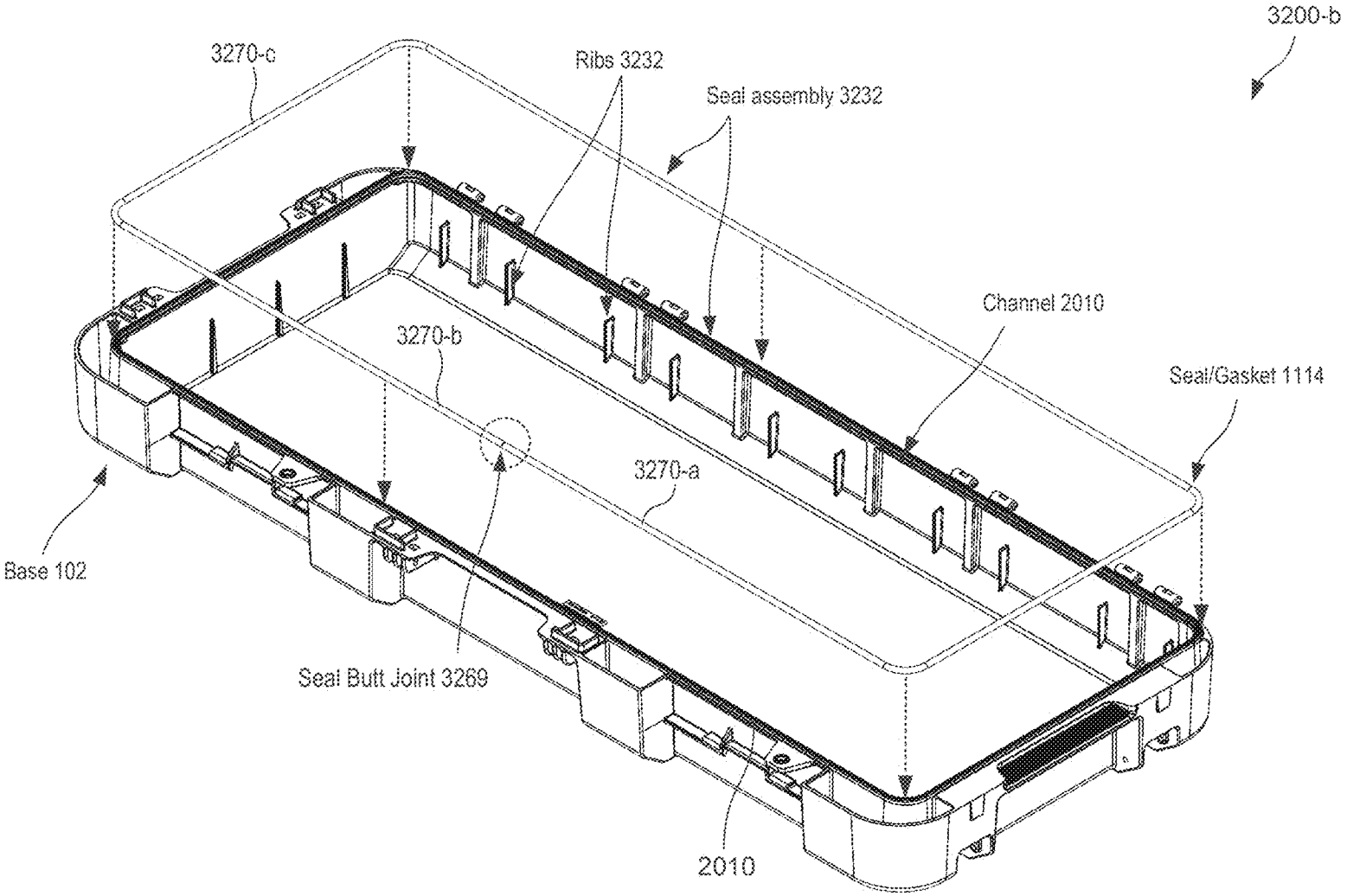
FIG. 32B illustrates a detailed view of the base and gasket in FIG. 32, according to various aspects of the disclosure.
Figure 32C:
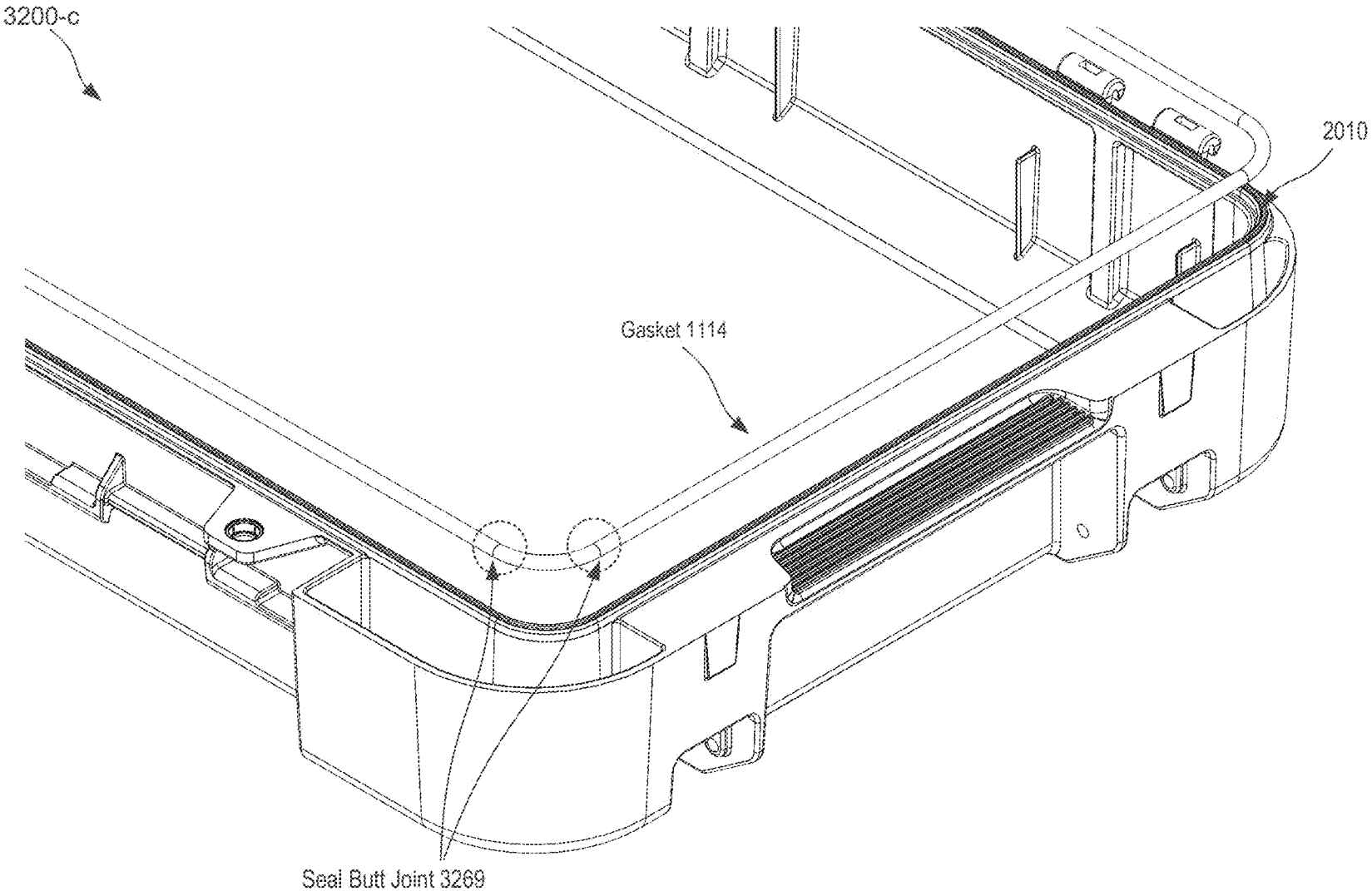
FIG. 32C illustrates a detailed exploded view of a corner section of the lockable case in FIG. 32A, showing an inner and outer wall separated by a channel, and a gasket or weather resistant seal configured to be seated in the channel, in accordance with various aspects of the disclosure.

Turning now to FIGS. 32B and 32C, which illustrate detailed exploded views (3200-*b*, 3200-*c*) of a seal assembly 3232 and a base 102, in accordance with various aspects of the disclosure. As used herein, the term "seal assembly" may be used to refer to the weather-resistant seal/gasket (e.g., seal/gasket 1114), the channel (e.g., channel 2010) within which the seal/gasket is fitted, the individual seal sections (if the seal or gasket is not formed as a unitary piece), and the seal butt joints (if any). Thus, in this example, the seal assembly 3232 comprises the seal/gasket 1114 and the channel 2010, where the seal 1114 further comprises a plurality of seal sections, such as seal sections 3270-*a*, 3270-*b*, 3270-*c*, and one or more seal butt joint(s) 3269 positioned between adjacent seal sections, as described above in relation to FIG. 32A. For sake of brevity, FIG. 32B does not individually label each and every one of the seal sections and seal butt joints. As noted above, in some embodiments, the seal 1114 may be configured as one unitary piece that encircles the entire case (i.e., entire inner perimeter of the case and/or entire perimeter of the channel) and is shaped and sized to fit within the channel 2010.

The embodiment (3200-*c*) shown in FIG. 32C shows a more detailed, close-up view of the embodiment (3200-*b*) described above, in relation to FIG. 32B.

Figure 32D:
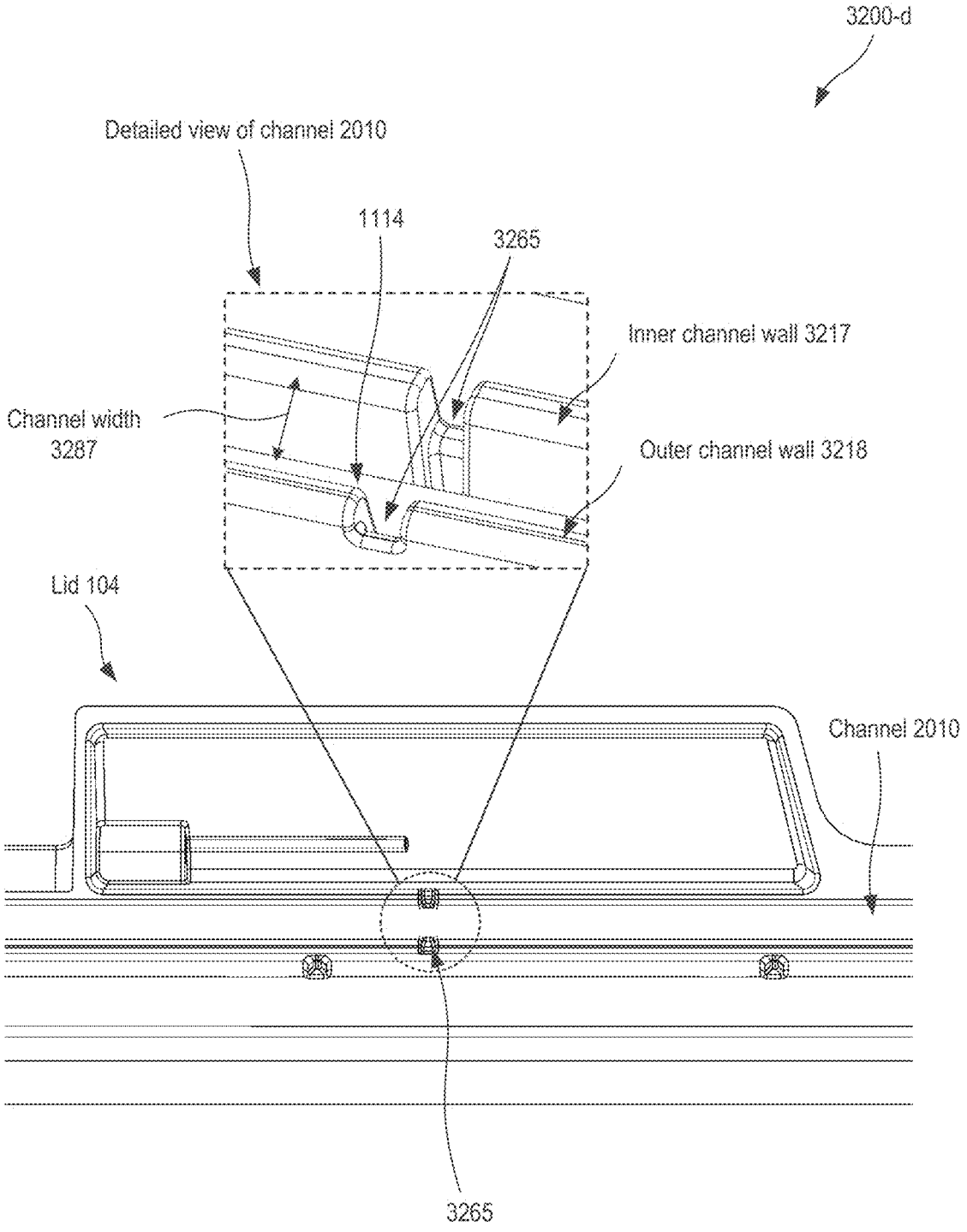
FIG. 32D illustrates a detailed view showing a gasket or weather-resistant seal seated in a channel formed between a respective inner wall and respective outer wall of a base or a lid, where the gasket and inner/outer walls incorporate features to assist in one or more pressure and/or moisture control of the lockable wall, according to various aspects of the disclosure.

FIG. 32D illustrates a portion 3200-*d* of the lockable case (e.g., lockable case 100), including a detailed view of the channel 2010, in accordance with various aspects of the disclosure. In this example, the detailed view of the channel 2010 depicts the view of the channel while looking up toward a bottom side of the lid.

In some embodiments, and with reference to FIG. 32D, the double wall design of the lid 104 may comprise one or more pass-through channels 3265. The pass-through channels 3265 may be configured to allow air to pass into the channel 2010 and through the seal or gasket 1114 to reduce a pressure differential between an inside and outside of the lockable case (e.g., lockable case 100) and help in an easier release of the lid 104 from the base (e.g., base 102) when opening the lockable case. That is, in some circumstances, the case can be difficult to open due to the seal/gasket 1114 and the differences in pressure between the outside of the closed case (e.g., ambient or atmospheric pressure outside of the closed case) and the internal pressure of the closed case (i.e., pressure inside of the closed case, which may be different from the atmospheric pressure outside of the closed case). In this example, the detailed view of the channel 2010 also shows an inner channel wall 3217, an outer channel wall 3218, and a channel width 3287, where the channel width corresponds to the distance between the inner channel 3217 and the outer channel wall 3218 of the double-walled lid design. Thus, in some aspects, the dimensions of the channel 2010 and the seal/gasket 1114 seated within the channel 2010 is based at least in part on the channel width 3287. In some embodiments, the diameter of the seal/gasket 1114 may be similar or substantially similar to the channel width 3287. In other cases, the diameter of the seal/gasket may be slightly smaller than the channel width 3287. In some non-limiting examples, the diameter of the seal 1114 may be around 99%, or 97%, or 95% of the channel width 3287. Such a design can facilitate easier removal of the seal/gasket 1114 from the channel 2010. In some other cases, however, the seal/gasket is not removable and is configured to be fixedly seated within the channel 2010, in which case the diameter of the seal/gasket 1114 may be roughly equal to the channel width 3287. As seen in the detailed view of the channel 2010 in FIG. 32D, each of the inner and outer channel walls 3217, 3218 comprise a pass-through channel 3265, where the pass-through channels 3265 of the inner and outer walls are aligned or substantially aligned with each other. In some aspects, the combination of the pass-through channels 3265 along with a gap in the seal 1114 facilitate air flow between the inside and the outside of the case 100, thereby reducing any adverse effects due to a pressure differential between the interior and exterior of the case 100. In some examples, this pressure differential is more pronounced when the lockable case is closed (i.e., by closure of the latches, such that the latches are securely coupled to both the lid and the base) at a lower elevation (e.g., at or near sea level) and then transported to a higher elevation (e.g., via a plane, where the plane may or may not be pressurized, in either case a pressure differential results since jet planes are typically pressurized such that the cabin pressure is at or around 8,000 feet (2400 meters)). In other cases, the lockable case 100 may be closed at a higher elevation (e.g., at a military site located at 9,000 feet AMSL on a mountain in Colorado) than the elevation of the destination (e.g., naval base located at 5 feet AMSL in San Diego) to which it is being transported and where it will be unlocked/opened. In some aspects, the pass-through channels 3265, combined with the optional gap in the seal 1114 can facilitate in reducing or minimizing the pressure differential between the inside and outside of the case 100, especially when the case is being transported between locations that are at substantially different elevations (i.e., altitude above mean sea level or AMSL). This, in turn, allows the lockable case to be more easily opened, thus enhancing user experience. While the illustrations in the present disclosure generally only depict the lid 104 as having pass-through channels 3265, it should be understand that, in some embodiments, the base (e.g., base 102) may also include one or more pass-through channels 3265. In some embodiments, both the base 102 and the lid 104 may comprise pass-through channels 3265. Furthermore, the pass-through channels 3265 of the lid and the base may be aligned with each other (i.e., in a vertical direction), or the pass-through channels 3265 of the lid and base may not be aligned with each other. In the latter case, each pass-through channel 3265 of the lid may be separated by a fixed distance from adjacent pass-through channels 3265 of the base. In other words, in one non-limiting example, each pass-through channel 3265 of the lid may be positioned at or around mid-way between adjacent pass-through channels 3265 of the base.

Figure 32E:
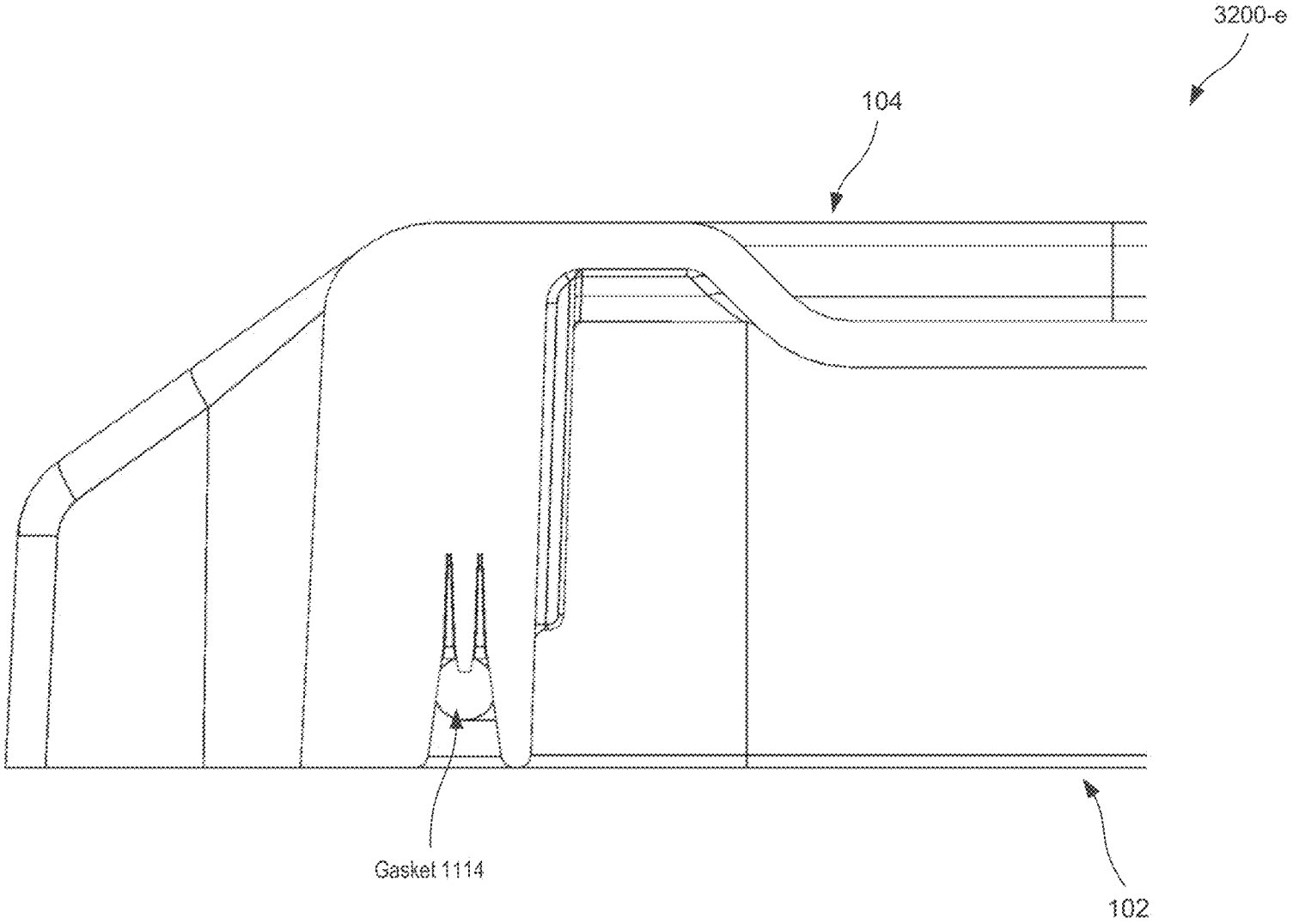
FIG. 32E illustrates a cross-sectional view of a gasket or weather-resistant seal positioned in between a channel formed by the inner and outer walls of one of the base or lid, according to various aspects of the disclosure . . .

FIG. 32E depicts a detailed cross-sectional view (3200) of the gasket 1114 compressed between the lid 104 and base 102 of a lockable case, such as case 100, in accordance with various aspects of the disclosure.

In some embodiments, the weather-resistant gasket 2010, such as the ones described with reference to FIGS. 20A, 20B and FIGS. 32A through E, may be fabricated of a low density polyethylene (LDPE) material. In other embodiments, the weather-resistant gasket 2010 comprises a gasket made of an elastomeric material (e.g., Neoprene Rubber, Silicone, Fluorosilicone, Fluoroelastomers, Ethylene Propylene (EPDM), and Epichlorohydrin, to name a few non-limiting examples). In some cases, the elastomeric material selected to manufacture the gasket 1114 may depend on the consideration of numerous factors, including, but not limited to, use case (e.g., civilian use, military or law enforcement use, scientific use), products being transported within the case (e.g., musical instruments, firearms or other weapons, scientific instruments, photography equipment), environmental conditions of the location where the case will primarily be utilized (e.g., arid or desert, very humid or tropical rainforest, temperate climate, arctic or tundra, high elevations, for instance, above 7500 AMSL), temperature range (e.g., during typical use, variation in temperature will be <10 degrees Celsius; during typical use, the lockable case may be exposed to a broad temperature range of up to 80-90 degrees Celsius, for instance, anywhere from a low of −40 degrees Celsius in winter to a high of 40-50 degrees Celsius in summer). In some instances, the weather-resistant seal or gasket 1114 is configured to also help in controlling the moisture or humidity level in the interior portion of the case, for instance, by sealing against the intrusion of water or moisture-laden air into the interior portion of the lockable case 100.

It should be noted that, although the present disclosure generally describes a single weather-resistant seal, such as seal/gasket 1114, this is not intended to be limiting. For example, in some embodiments, a second weather-resistant seal can also be used, which can potentially provide redundancy and/or greater resistance to water/moisture intrusion. Furthermore, in some embodiments, if two seals/gaskets are used (e.g., a first gasket fitted within the channel in the lid and a second gasket fitted with the channel in the base), the two gaskets may or may not be formed of the same elastomeric material. For instance, in one non-limiting example, the first gasket in the lid may be formed of Fluorosilicone, while the second gasket in the base may be formed of Epichlorohydrin. In another non-limiting example, the first gasket may be formed as a unitary piece and fitted within a first channel in the lid, while the second gasket may be fitted within a second channel in the base, where the second gasket may be formed using multiple seal pieces/sections and one or more seal butt joints located where adjacent seal pieces or sections butt against each other. Other configurations and/or variations of the gasket(s), channel design(s), and/or pass-through channel(s) are contemplated in different embodiments, and the examples described herein are not intended to limit the scope and/or spirit of the present disclosure.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The terms and expressions employed herein are used as terms and expressions of description and not of limitation, and there is no intention, in the use of such terms and expressions, of excluding any equivalents of the features shown and described or portions thereof. Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms-even if only the function or result is the same. Such equivalent, broader, or even more generic terms should be considered to be encompassed in the description of each element or action. Such terms can be substituted where desired to make explicit the implicitly broad coverage to which this disclosure is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of a "protrusion" should be understood to encompass disclosure of the act of "protruding"—whether explicitly discussed or not—and, conversely, were there only disclosure of the act of "protruding", such a disclosure should be understood to encompass disclosure of a "protrusion". Such changes and alternative terms are to be understood to be explicitly included in the description.

The invention claimed is:

1. A locking case comprising:

a base and a lid, wherein at least one of the base and the lid comprises a double wall design, the double wall design including a first wall, a second wall, and a channel formed between the first and the second wall;

a gasket positioned within the channel;

at least one passive pressure equalization element integrated into the case;

a latch comprising a first end and a second end, and a first one or more protrusions positioned between the first end and the second end, the second end comprising a second protrusion configured for removably engaging with a third protrusion of the base, wherein the first end is rotatably coupled to the lid; and wherein, closure of the latch is configured to cause the first one or more protrusions of the latch to interface with a respective one or more protrusions of the base, and closure of the latch is configured to cause the lid to compress the gasket between the base and the lid.

2. The locking case of claim 1, wherein, when the closing force is applied between the base and the lid, the locking case is in a closed position and the latch is engaged with both the base and the lid; and when the locking case is in an open position, the second end of the latch is disengaged from the first portion of the base.

3. The case of claim 1, wherein, the first portion of the base comprises a shelf feature for engaging with the second end of the latch, and the shelf feature is configured to transfer an engagement force from the latch toward the lid when the second end of the latch is engaged with the first portion of the base, such that the gasket becomes more compressed between the base and the lid than when the second end of the latch is not engaged with the first portion of the base.

4. The locking case of claim 1, wherein the first one or more protrusions of the latch comprises a second protrusion configured to interface with one of a protruding edge on the base or a protruding edge on the lid.

5. The locking case of claim 4, wherein the first one or more protrusions of the latch comprise the second protrusion and a third protrusion, and wherein the third protrusion is configured to interface with another one of the protruding edge on the base or the protruding edge on the lid.

6. The locking case of claim 5, wherein, when the closing force is applied between the base and the lid:

the gasket becomes more compressed between the base and the lid when the latch includes both the second and third protrusions as compared to when the latch only includes the second protrusion.

7. The locking case of claim 1, wherein the at least one passive pressure equalization element comprises one or more of a valve and a vent, and wherein the at least one passive pressure equalization element is configured to regulate pressure gradients between an internal pressure in an interior of the locking case and an atmospheric pressure external of the locking case.

8. The locking case of claim 7, wherein the gasket comprises a weather-resistant seal that is configured to be fitted within the channel and shaped and sized to encircle a perimeter of the locking case, and wherein one of:

the weather-resistant seal is formed as a unitary piece; or the weather-resistant seal comprises one or more seal sections and one or more seal butt joints.

9. The locking case of claim 8, wherein the one or more seal sections comprise a plurality of seal sections, and wherein the one or more seal butt joints comprise a plurality of seal butt joints, and wherein each of the plurality of seal butt joints is placed between adjacent seal sections, and wherein one or more of the plurality of seal butt joints are configured to vent or allow passage of air.

10. The locking case of claim 9, wherein the one or more of the plurality of seal butt joints are configured to vent or allow passage of air when a pressure differential between the internal pressure and the atmospheric pressure exceeds a pressure vent threshold, and wherein the pressure vent threshold is based at least in part on a tightness or compression level of the one or more seal butt joints.

11. The locking case of claim 10, wherein, the tightness or compression level is based on a corresponding spacing between adjacent seal sections and a length of a respective seal butt joint positioned between the adjacent seal sections;

the weather-resistant seal is fixedly seated within the channel or removably seated within the channel; and the weather-resistant seal is fabricated of a low density polyethylene (LDPE) material, an elastomeric material, or a combination thereof.

12. The locking case of claim 8, wherein the double-wall design of at least one of the lid and the base comprises one or more pass-through channels, and wherein the one or more pass-through channels are configured to allow passage of air into the channel and through the weather-resistant seal to reduce the pressure differential between the internal pressure in an interior of the locking case and an atmospheric pressure external of the locking case.

13. A locking case, comprising:

a base and a lid having a clamshell coupling, wherein, at least one of the base and the lid comprises:

an inner wall and an outer wall;

a channel formed between the inner wall and the outer wall at an interface between the base and the lid, wherein the channel is formed on one of the base or the lid;

a seal arranged within the channel;

one or more pass-through channels extending through at least one of a portion of the inner wall and a portion of the outer wall; and at least one latch configured to be rotatable between an open position and a closed position, wherein rotation of the at least one latch to the closed position exerts a compressive force on the seal.

14. The locking case of claim 13, wherein each of the at least one latch comprises:

a first end pivotably coupled to the lid;

a second end configured to removably engage with the base, wherein the second end of a respective latch comprises an end-protrusion configured for removably engaging with a first protruding edge of the base, and wherein the rotation of the at least one latch between the open position and the closed position is based at least in part on an engagement or disengagement of the second end of the respective latch with the base; and at least one protrusion arranged between the first end and the second end of the respective latch.

15. The locking case of claim 14, wherein the at least one protrusion comprises a first protrusion arranged at or near the first end of a respective latch and a second protrusion arranged between the first protrusion and the end-protrusion, and wherein, the first protrusion is configured to interface with one of a second protruding edge on the base or a protruding edge on the lid; and the second protrusion is configured to interface with another one of the protruding edge on the base or the protruding edge on the lid.

16. The locking case of claim 13, wherein each of the lid and the base comprise an inner wall facing an interior portion of the locking case, and an outer wall integrated into an outer profile of the locking case, and wherein:

the seal along with the one or more pass-through channels are configured to regulate pressure between an internal pressure of the locking case and an atmospheric pressure external to the locking case.

17. The locking case of claim 16, wherein the seal comprises a weather-resistant seal that is configured to be fitted within the channel and shaped and sized to encircle a perimeter of the locking case, and wherein one of:

the weather-resistant seal is formed as a unitary piece; or the weather-resistant seal comprises one or more seal sections and one or more seal butt joints.

18. The locking case of claim 17, wherein the weather-resistant seal comprises a plurality of seal sections and a plurality of seal butt joints, and wherein:

each of the plurality of seal butt joints is placed between adjacent seal sections; and one or more of the plurality of seal butt joints are configured to vent or allow passage of air when a pressure differential between the internal pressure of the locking case and the atmospheric pressure external to the locking case exceeds a pressure vent threshold, wherein the pressure vent threshold is based at least in part on a tightness or compression level of the one or more seal butt joints of the plurality of seal butt joints.

19. The locking case of claim 18, wherein, the tightness or compression level is based on a corresponding spacing between adjacent seal sections and a length of a respective seal butt joint positioned between the adjacent seal sections, the weather-resistant seal is fixedly seated within the channel or removably seated within the channel, and the weather-resistant seal is fabricated of a low density polyethylene (LDPE) material, an elastomeric material, or a combination thereof.

20. A method of using a locking case, comprising:

providing a base and a lid;

forming a clamshell coupling between the base and the lid by coupling one edge of the base with one edge of the lid;

forming one or more channels at an interface between the base and the lid, wherein each of the one or more channels is formed on one of the base or the lid;

arranging one or more seals within the one or more channels;

forming one or more pass-through channels extending through at least one of a portion of the inner wall and a portion of the outer wall; and installing at least one latch wherein each of the at least one latch is movable between an open position and a closed position; and wherein rotating the at least one latch to the closed position exerts a compressive force on the seal.

* * * * *